US012371879B2

(12) United States Patent
Nanbu et al.

(10) Patent No.: US 12,371,879 B2
(45) Date of Patent: Jul. 29, 2025

(54) SHOVEL AND SHOVEL DIAGNOSTIC SYSTEM

(71) Applicant: SUMITOMO CONSTRUCTION MACHINERY CO., LTD., Tokyo (JP)

(72) Inventors: Taiga Nanbu, Chiba (JP); Soutarou Otoh, Chiba (JP); Hiroyuki Tsukamoto, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 320 days.

(21) Appl. No.: 17/652,502

(22) Filed: Feb. 25, 2022

(65) Prior Publication Data

US 2022/0178111 A1 Jun. 9, 2022

Related U.S. Application Data

(63) Continuation of application No. PCT/JP2020/032784, filed on Aug. 28, 2020.

(30) Foreign Application Priority Data

| | | |
|---|---|---|
| Aug. 29, 2019 | (JP) | 2019-156621 |
| Aug. 29, 2019 | (JP) | 2019-156622 |
| Oct. 9, 2019 | (JP) | 2019-186174 |
| Oct. 31, 2019 | (JP) | 2019-199299 |

(51) Int. Cl.
*E02F 9/20* (2006.01)
*E02F 9/26* (2006.01)

(52) U.S. Cl.
CPC ..... *E02F 9/2058* (2013.01); *E02F 9/26* (2013.01)

(58) Field of Classification Search
CPC . E02F 9/2058; E02F 9/26; E02F 9/267; E02F 9/22; G07C 5/0808
USPC ..... 701/99
See application file for complete search history.

(56) References Cited

U.S. PATENT DOCUMENTS

| | | | | |
|---|---|---|---|---|
| 2005/0262838 | A1 | 12/2005 | Kageyama et al. | |
| 2007/0171035 | A1 | 7/2007 | Ikari et al. | |
| 2013/0221746 | A1 | 8/2013 | Nakayama | |
| 2015/0112544 | A1 | 4/2015 | Tsukamoto | |
| 2016/0005286 | A1* | 1/2016 | Kiyota | E02F 9/262 340/435 |

(Continued)

FOREIGN PATENT DOCUMENTS

| | | |
|---|---|---|
| EP | 3434912 | 1/2019 |
| JP | H09-032039 | 2/1997 |

(Continued)

OTHER PUBLICATIONS

International Search Report for PCT/JP2020/032784 mailed on Nov. 10, 2020.

*Primary Examiner* — Marc Burgess
*Assistant Examiner* — John D Holman
(74) *Attorney, Agent, or Firm* — IPUSA, PLLC

(57) ABSTRACT

A shovel includes a lower traveling body, an upper turning body turnably mounted on the lower traveling body, an engine mounted on the upper turning body, a hydraulic pump mounted on the upper turning body and configured to be driven by the engine, and processing circuitry configured to collect diagnostic data of the shovel, in response to detecting that the engine is driven under a constant driving condition.

20 Claims, 19 Drawing Sheets

SYS

(56) References Cited

U.S. PATENT DOCUMENTS

| | | | | |
|---|---|---|---|---|
| 2016/0186630 | A1* | 6/2016 | Osburn | F01N 11/00 60/277 |
| 2017/0203645 | A1 | 7/2017 | Imai et al. | |
| 2018/0016772 | A1* | 1/2018 | Tsukamoto | E02F 9/267 |
| 2019/0113031 | A1 | 4/2019 | Kawabuchi et al. | |
| 2019/0376262 | A1 | 12/2019 | Koga | |
| 2022/0100595 | A1* | 3/2022 | Shapiro | G06F 11/0736 |
| 2022/0205221 | A1 | 6/2022 | Koga | |

FOREIGN PATENT DOCUMENTS

| | | |
|---|---|---|
| JP | H09-292312 | 11/1997 |
| JP | 2002-323013 | 11/2002 |
| JP | 2005-207413 | 8/2005 |
| JP | 2005-226493 | 8/2005 |
| JP | 2005-330935 | 12/2005 |
| JP | 2007-292316 | 11/2007 |
| JP | 2008-009935 | 1/2008 |
| JP | 2010-198159 | 9/2010 |
| JP | 2011-038273 | 2/2011 |
| JP | 2012-097670 | 5/2012 |
| JP | 2015-063864 | 4/2015 |
| JP | 2016-023489 | 2/2016 |
| JP | 2019-031205 | 2/2019 |
| WO | 2016/108291 | 7/2016 |
| WO | 2018/155629 | 8/2018 |
| WO | 2021/054417 | 3/2021 |

* cited by examiner

SHOVEL AND SHOVEL DIAGNOSTIC SYSTEM

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/032784, filed on Aug. 28, 2020, and designating the U.S., which claims priority to Japanese Patent Application No. 2019-156622 filed on Aug. 29, 2019, Japanese Patent Application No. 2019-199299 filed on Oct. 31, 2019, Japanese Patent Application No. 2019-156621 filed on Aug. 29, 2019, and Japanese Patent Application No. 2019-186174 filed on Oct. 9, 2019. The entirety of the foregoing applications are incorporated herein by reference.

BACKGROUND

Technical Field

The present disclosure relates to a shovel.

Description of Related Art

For example, a technique is known in which a shovel is caused to perform a specified movement according to operator's operations, and detection data of various sensors of the shovel at the time of the specified movement is acquired as diagnostic data related to the shovel.

SUMMARY

An aspect of an embodiment of the present disclosure provides a shovel that includes a lower traveling body, an upper turning body turnably mounted on the lower traveling body, an engine mounted on the upper turning body, a hydraulic pump mounted on the upper turning body and configured to be driven by the engine, and processing circuitry configured to collect diagnostic data of the shovel, in response to detecting that the engine is driven under a constant driving condition.

DETAILED DESCRIPTION

For example, a technique is known in which a shovel is caused to perform a specified movement according to operator's operations, and detection data of various sensors of the shovel at the time of the specified movement is acquired as diagnostic data related to the shovel.

However, in the above-described technique, it is necessary for the operator to perform the lever operations to cause the shovel to perform the specified movement such as a movement of an attachment and a turning movement. Therefore, due to movements of hydraulic actuators, sufficiently reliable diagnostic data may not be acquired.

Accordingly, it is desired to provide a technique capable of collecting more reliable diagnostic data.

Hereinafter, an embodiment for carrying out the invention will be described with reference to the drawings.

[Overview of Shovel Management System]

Firstly, overview of a shovel management system SYS according to the present embodiment is explained with reference to FIG. 1.

Figure 1:
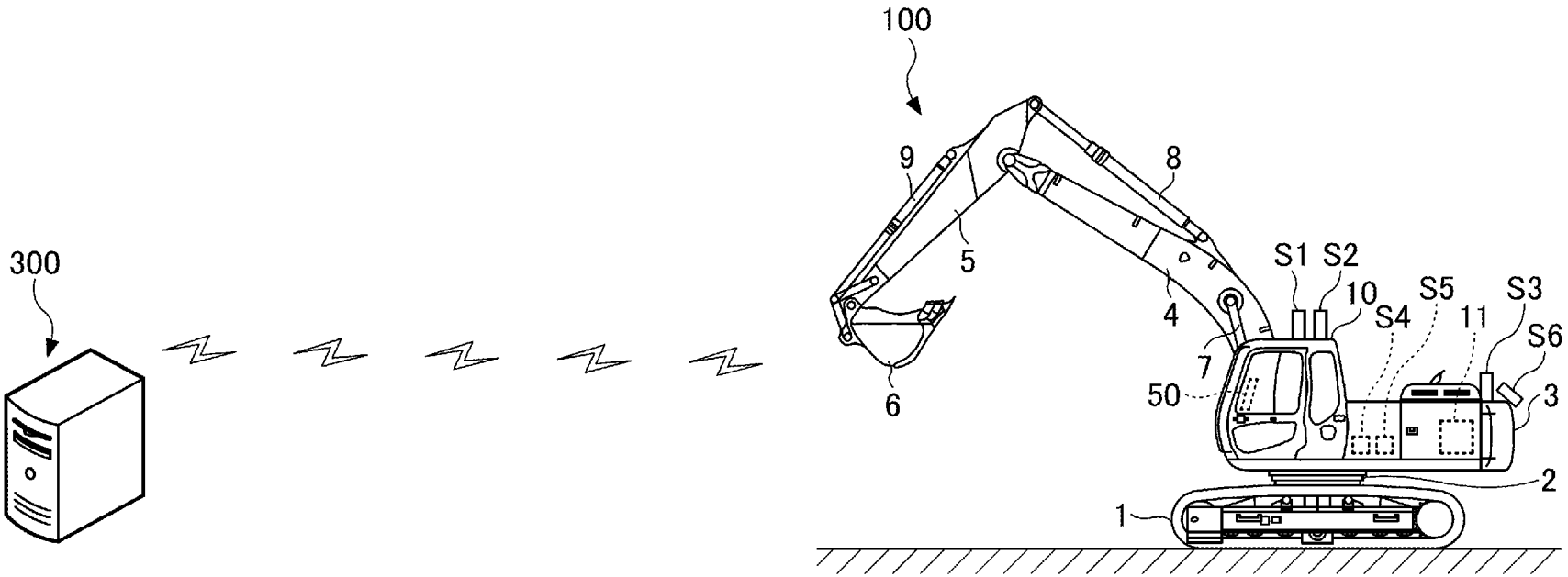
FIG. 1 is a schematic diagram illustrating an example of a shovel management system.

FIG. 1 is a schematic diagram illustrating an example of a shovel management system SYS according to the present embodiment.

As illustrated in FIG. 1, a shovel management system SYS (an example of a shovel diagnostic system) includes a shovel 100 and a management apparatus 300.

<Overview of Shovel>

A shovel 100 according to the present embodiment includes a lower traveling body 1, an upper turning body 3 pivotally mounted on the lower traveling body 1 with a turning mechanism 2, a boom 4, an arm 5, a bucket 6, and a cab 10. The boom 4, the arm 5, and the bucket 6 constitute an excavation attachment (working machine).

A pair of left and right crawlers are hydraulically driven by traveling hydraulic motors 1L, 1R (see FIG. 2), so that the lower traveling body 1 causes the shovel 100 to travel.

The upper turning body 3 is driven by a turning hydraulic motor 2A (see FIG. 2) to turn with respect to the lower traveling body 1.

The upper turning body 3 may be electrically driven by an electric motor instead of the turning hydraulic motor 2A.

The boom 4 is pivotally attached to the center at the front of the upper turning body 3 to be able to vertically pivot. The arm 5 is pivotally attached to the end of the boom 4 to be able to pivot vertically. The bucket 6 serving as an end attachment is pivotally attached to the end of the arm 5 to be able to pivot vertically. The boom 4, the arm 5, and the bucket 6 are hydraulically driven by a boom cylinder 7, an arm cylinder 8, and a bucket cylinder 9, respectively, serving as hydraulic actuators.

It should be noted that the bucket 6 is an example of an end attachment. According to the content of task and the like, instead of the bucket 6, other end attachments such as, for example, a slope finishing bucket, a dredging bucket, a breaker, and the like may be attached to the end of the arm 5.

The cab 10 is an operation room in which the operator rides, and is mounted on the front left of the upper turning body 3.

Also, the shovel 100 according to the present embodiment includes a transmission apparatus S1 and a reception apparatus S2, and is communicably connected to the management apparatus 300 via predetermined communication network. For example, the predetermined communication network may include, for example, short-distance wireless communication network such as Bluetooth (registered trademark) and WiFi, a mobile communication network that includes a base station as a terminal, a satellite communication network that uses a communication satellite, an Internet network, and the like. Accordingly, for example, the shovel 100 can transmit (upload) information about various states of the shovel 100 to the management apparatus 300.

<Overview of Management Apparatus>

The management apparatus 300 is communicably connected to the shovel 100 via the predetermined communication network, and performs management of the state and the operation of the shovel 100 on the basis of various kinds of information received from the shovel 100.

The management apparatus 300 is typically a fixed terminal apparatus, for example, a computer (what is termed as a cloud server) provided in a management center or the like outside the construction site of the shovel 100. For example, the management apparatus 300 may be an edge server that is disposed at a location relatively close to the shovel 100 (for example, a management office in the construction site, and communication facilities such as a wireless base station and a communication site in proximity to the construction site). For example, the management apparatus 300 may be a fixed computer terminal (a fixed terminal) such as a management office and the like in the construction site of the shovel 100. For example, the management apparatus 300 may be a portable terminal that can be carried by the manager and the like of the shovel 100 (for example, a smartphone, a tablet terminal, a laptop computer terminal, and the like).

[Configuration of Shovel Management System]

Next, a specific configuration of a shovel management system SYS according to the present embodiment is explained with reference to FIG. 1 and FIG. 2 to FIG. 4.

Figure 2:
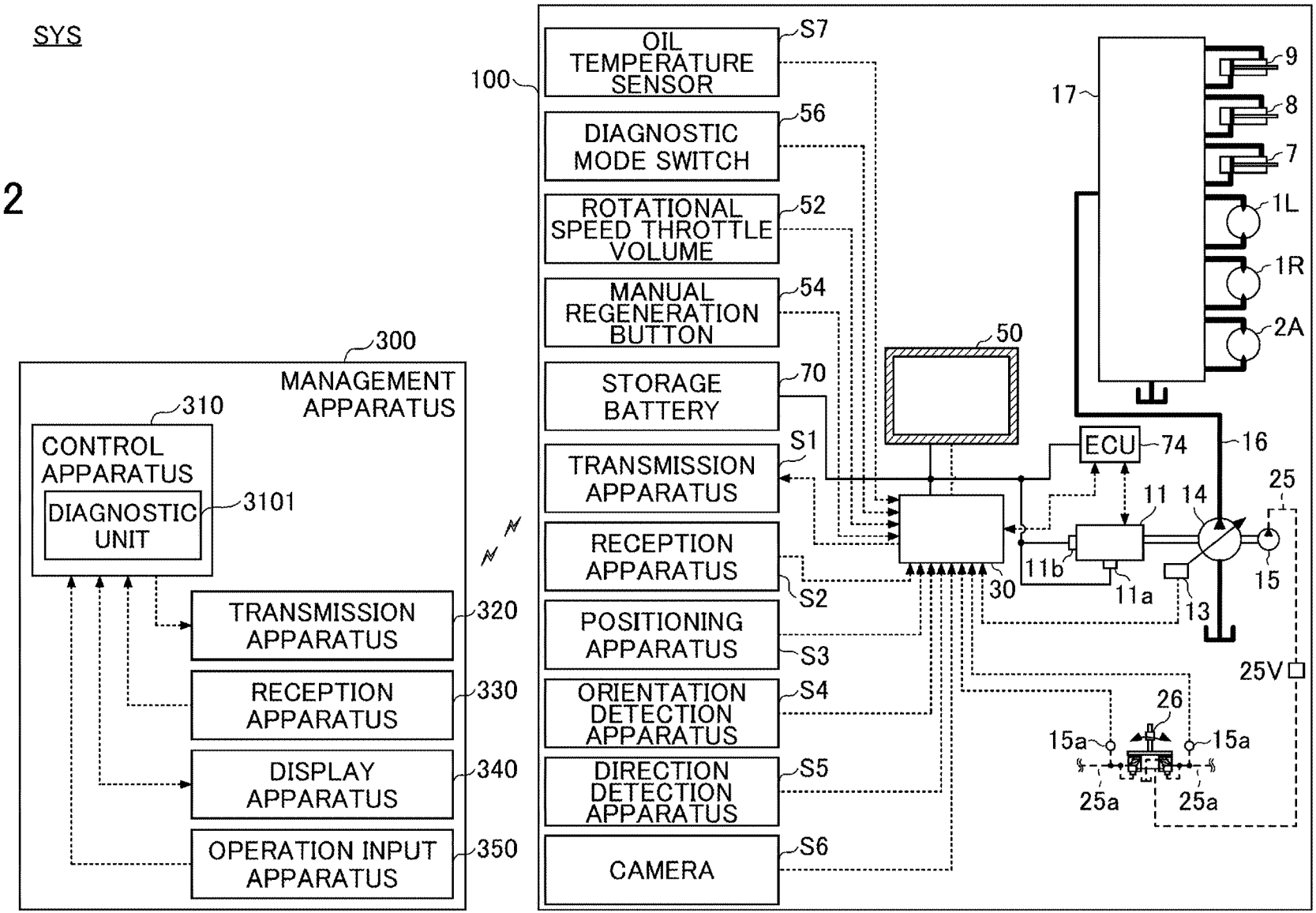
FIG. 2 is a block diagram illustrating an example of configuration of the shovel management system.
Figure 3:
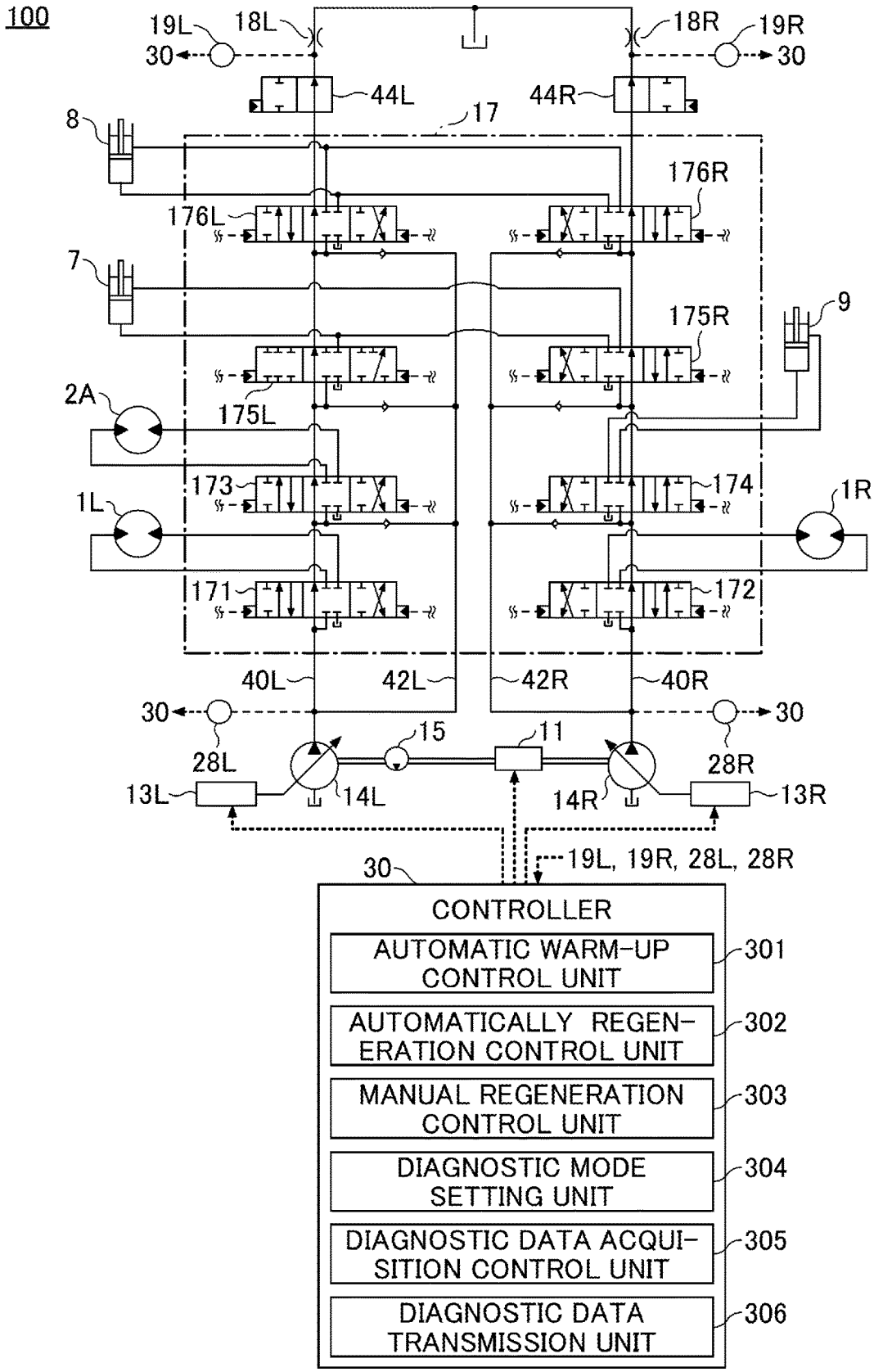
FIG. 3 is a diagram schematically illustrating an example of configuration of a hydraulic system of a shovel.
Figure 4:
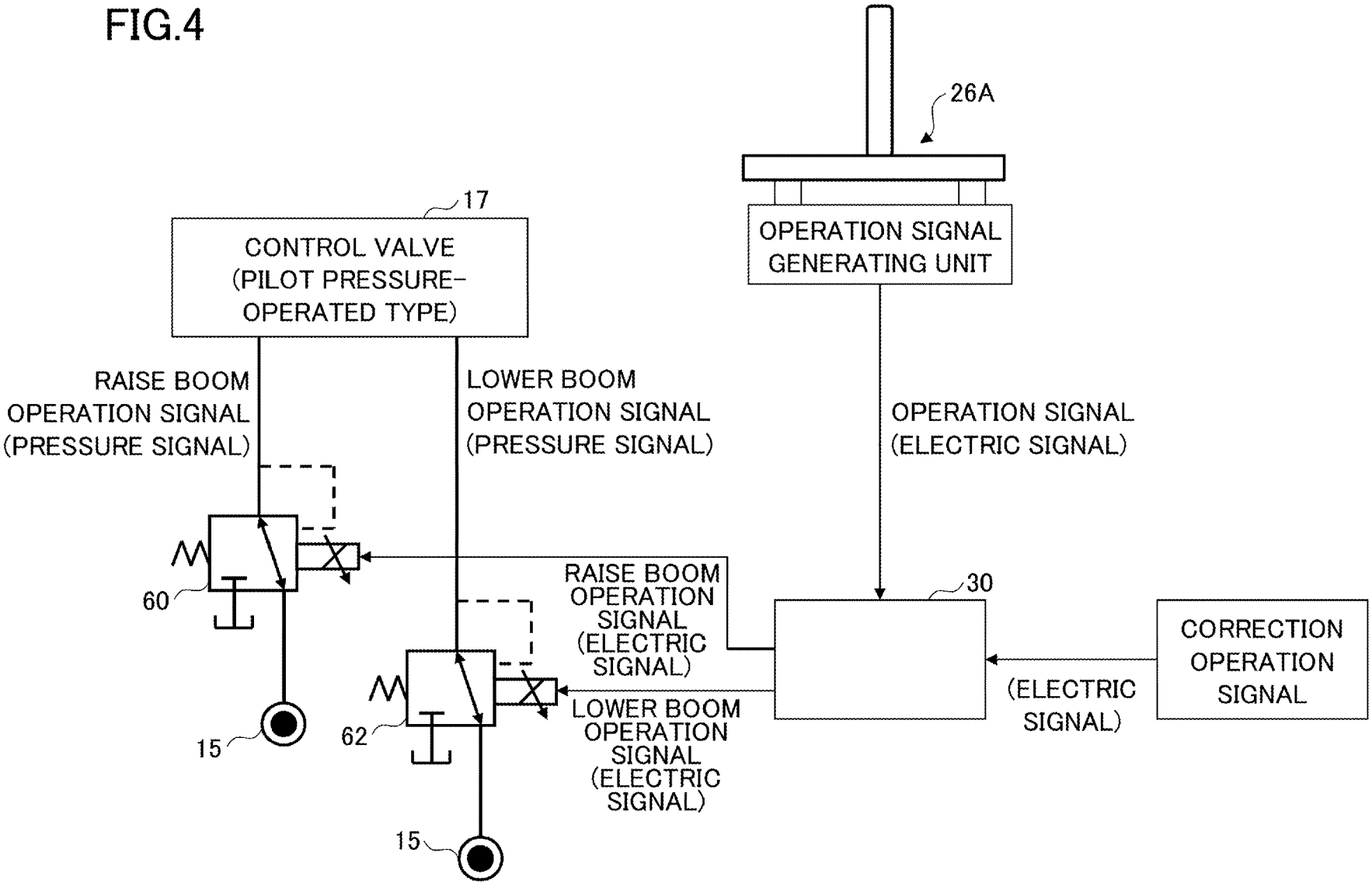
FIG. 4 is a diagram illustrating an example of an electric-type operating apparatus.

FIG. 2 is a block diagram schematically illustrating an example of configuration of a shovel management system SYS according to the present embodiment. FIG. 3 is a drawing schematically illustrating an example of configuration of a hydraulic system of the shovel 100 according to the present embodiment. FIG. 4 is a diagram illustrating an example of an electric-type operating apparatus 26. Specifically, FIG. 4 is a drawing illustrating an example of an electric-type lever apparatus 26A for operating the boom 4 (the boom cylinder 7) included in the operating apparatus 26, and represents a pilot circuit for applying a pilot pressure to a control valve 17 (the control valves 175L, 175R) hydraulically controlling the boom cylinder 7.

In FIG. 2, a mechanical power line, a hydraulic line, a power source line, a pilot line, and an electric signal line are indicated by a double line, a thick solid line, a thin solid line, a dashed line, and a dotted line, respectively. In FIG. 3, a mechanical power line, a hydraulic line, and an electric signal line are indicated by a double line, a solid line, and a dotted line, respectively. The pilot circuit hydraulically controlling the arm cylinder 8 and the bucket cylinder 9 is expressed in substantially the same manner as the pilot circuit of FIG. 4 for hydraulically controlling the boom cylinder 7. The pilot circuit hydraulically controlling the traveling hydraulic motors 1L, 1R for driving the lower traveling body 1 (i.e., the left and right crawlers) is expressed in substantially the same manner as FIG. 4. The pilot circuit hydraulically controlling the turning hydraulic motor 2A driving the upper turning body 3 is expressed in substantially the same manner as FIG. 4. Therefore, lever apparatuses, pedal apparatuses, and the like for operating the left and right crawlers (the lower traveling body 1), the upper turning body 3, the arm 5, and the bucket 6 included in the electric-type operating apparatus 26 are not illustrated.

<Configuration of Shovel>

As described above, the hydraulic driving system of the shovel 100 according to the present embodiment includes hydraulic actuators such as the traveling hydraulic motors 1L, 1R, the turning hydraulic motor 2A, the boom cylinder 7, the arm cylinder 8, and the bucket cylinder 9, and the like. Also, the hydraulic driving system of the shovel 100 according to the present embodiment includes a hydraulic system constituted by the engine 11, the regulator 13, the main pump 14, the control valve 17, and the like. The traveling hydraulic motors 1L, 1R, the turning hydraulic motor 2A, the boom cylinder 7, the arm cylinder 8, the bucket cylinder 9, the engine 11, the regulator 13, the main pump 14, the control valve 17, and the like constituting the hydraulic driving system are included in the devices of the shovel 100.

The engine 11 is a main power source in the hydraulic drive system, and is, for example, a diesel engine using light oil as fuel. The engine 11 is mounted on the rear part of the upper turning body 3, for example. Specifically, under the control by an engine control apparatus (engine control unit, ECU) 74 explained later, the engine 11 rotates constantly at a preset target rotational speed that is configured in advance. The output axis of engine 11 is connected to each input axis of the main pump 14 and the pilot pump 15. The engine 11 drives the main pump 14 and the pilot pump 15. In addition, a generator 11*a* driven by the motive power of the engine 11, a starter 11*b* for starting the engine 11, and the like are mounted on the engine 11. In addition, an exhaust gas processing apparatus for performing purification processing of exhaust gas is connected to the engine 11. Examples of exhaust gas processing apparatuses include a particulate matter (PM) regeneration apparatus (for example, diesel particulate filter (DPF) and diesel particulate diffuser (DPD)) for reducing particle matter (PM) in the exhaust gas and a NOx regeneration apparatus (for example, a urea selective catalytic regeneration (SCR) system) for reducing NOx (nitrogen oxides) in the exhaust gas.

The regulator 13 is configured to control the discharge amount of the main pump 14. For example, the regulator 13 adjusts the tilt angle of the swash plate of the main pump 14 in response to control commands from a controller 30. As illustrated in FIG. 3, the regulator 13 includes, for example, regulators 13L, 13R.

Similarly with the engine 11, the main pump 14 (an example of a hydraulic pump) is mounted on, for example, the rear part of the upper turning body 3, and provides hydraulic oil through a high-pressure hydraulic line 16 to the control valve 17. As described above, the main pump 14 is driven by the engine 11. The main pump 14 is, for example, a variable displacement hydraulic pump, in which the regulator 13 controls the tilt angle of the swashplate to adjust the stroke length of a piston under the control performed by the controller 30 as described above, so that the discharge flowrate is controlled. As illustrated in FIG. 3, the main pump 14 includes, for example, main pumps 14L, 14R.

The control valve 17 is configured to control the flow of hydraulic oil in the hydraulic system. The control valve 17 is a hydraulic control apparatus that is installed, for example, at the center of the upper turning body 3, and that controls the hydraulic driving system according to operator's operation with the operating apparatus 26 or according to a control instruction. The control valve 17 is connected to the main pump 14 via the high-pressure hydraulic line 16 as described above, and hydraulic oil supplied from the main pump 14 is selectively supplied to the hydraulic actuator (the traveling hydraulic motors 1L, 1R, the turning hydraulic motor 2A, the boom cylinder 7, the arm cylinder 8, and the bucket cylinder 9) according to the operation content with the operating apparatus 26 or according to the remote operation content.

As illustrated in FIG. 3, for example, the control valve 17 is a valve unit of multiple hydraulic pilot-type control valves (control valves 171, 172, 173, 174, 175L, 175R, 176L, and 176R). The control valves 171, 172, 173, 174, 175L, 175R, 176L, and 176R control the flowrates and the flow directions of hydraulic oil supplied from the main pump 14 to the respective hydraulic actuators. Specifically, the control valve 171 corresponds to the traveling hydraulic motor 1L, the control valve 172 corresponds to the traveling hydraulic motor 1R, and the control valve 173 corresponds to the turning hydraulic motor 2A. Also, the control valve 174 corresponds to the bucket cylinder 9, the control valves 175L, 175R correspond to the boom cylinder 7, and the control valves 176L, 176R correspond to the arm cylinder 8.

As illustrated in FIG. 3, in the hydraulic system of the shovel 100 according to the present embodiment, hydraulic oil is circulated from the main pumps 14L, 14R driven by the engine 11 to the hydraulic oil tank through center bypass pipelines 40L, 40R and parallel pipelines 42L, 42R.

The regulators 13L, 13R adjust the amounts of discharge of the main pumps 14L, 14R by adjusting the tilt angles of the swashplates of the main pumps 14L, 14R, respectively, under the control of the controller 30. Specifically, for example, the regulator 13L may reduce the amount of discharge by adjusting the tilt angle of the swashplate of the main pump 14L according to the increase of the discharge pressure of the main pump 14L. The regulator 13R operates substantially in the same manner. Accordingly, the suction horse power of the main pump 14 expressed by a product of the discharge pressure and the amount of discharge does not exceed the output horse power of the engine 11.

The center bypass pipeline 40L starts from the main pump 14L, passes through the control valves 171, 173, 175L, and 176L arranged in the control valve 17 in this order, and reaches the hydraulic oil tank.

The center bypass pipeline 40R starts from the main pump 14R, passes through the control valves 172, 174, 175R, and 176R arranged in the control valve 17 in this order, and reaches the hydraulic oil tank.

The control valve 171 is a spool valve that supplies hydraulic oil discharged from the main pump 14L to the traveling hydraulic motor 1L, and that discharges hydraulic oil discharged from the traveling hydraulic motor 1L to the hydraulic oil tank.

The control valve 172 is a spool valve that supplies hydraulic oil discharged from the main pump 14R to the traveling hydraulic motor 1R, and that discharges hydraulic oil discharged from the traveling hydraulic motor 1R to the hydraulic oil tank.

The control valve 173 is a spool valve that supplies hydraulic oil discharged from the main pump 14L to the turning hydraulic motor 2A, and that discharges hydraulic oil discharged from the turning hydraulic motor 2A to the hydraulic oil tank.

The control valve 174 is a spool valve that supplies hydraulic oil discharged from the main pump 14R to the bucket cylinder 9, and that discharges hydraulic oil in the bucket cylinder 9 to the hydraulic oil tank.

The control valves 175L, 175R are spool valves that supply hydraulic oil discharged from the main pumps 14L, 14R, respectively, to the boom cylinder 7, and that discharge hydraulic oil in the boom cylinder 7 to the hydraulic oil tank. Specifically, the control valve 175L is a spool valve that switches the flow of hydraulic oil in order to supply hydraulic oil discharged from the main pump 14L to the boom cylinder 7. The control valve 175R is a spool valve that supplies hydraulic oil discharged from the main pump 14R to the boom cylinder 7 and that discharges hydraulic oil in the boom cylinder 7 to the hydraulic oil tank.

The control valves 176L, 176R are spool valves that supply hydraulic oil discharged from the main pumps 14L, 14R, respectively, to the arm cylinder 8, and that discharge hydraulic oil in the arm cylinder 8 to the hydraulic oil tank.

The control valves 171, 172, 173, 174, 175L, 175R, 176L, and 176R adjust the flowrates and switch the flow direction of hydraulic oil supplied to or discharged from the hydraulic actuators in accordance with the pilot pressures applied to the pilot ports.

The parallel pipeline 42L extends in parallel with the center bypass pipeline 40L, and supplies hydraulic oil of the main pump 14L to the control valves 171, 173, 175L, and 176L in parallel with the center bypass pipeline 40L. Specifically, on the upstream side of the control valve 171, the parallel pipeline. 42L branches off from the center bypass pipeline 40L, and is configured to be able to supply hydraulic oil of the main pump 14L in parallel with the control valves 171, 173, 175L, and 176R. Accordingly, in a case where any one of the control valves 171, 173, and 175L limits or cuts off the flow of hydraulic oil passing through the center bypass pipeline 40L, the parallel pipeline 42L can supply hydraulic oil to a control valve further downstream.

The parallel pipeline 42R extends in parallel with the center bypass pipeline 40R, and supplies the hydraulic oil of the main pump 14R to the control valves 172, 174, 175R, and 176R in parallel with the center bypass pipeline 40R. Specifically, on the upstream side of the control valve 172, the parallel pipeline 42R branches from the center bypass pipeline 40R, and is configured to supply the hydraulic oil of the main pump 14R in parallel with each of the control valves 172, 174, 175R, and 176R in parallel. Accordingly, in a case where any one of the control valves 172, 174, and 175R limits or cuts off the flow of the hydraulic oil passing through the center bypass pipeline 40R, the parallel pipeline 42R can supply the hydraulic oil to a control valve further downstream.

Cut-off valves 44L, 44R are provided on the downstream side (hydraulic oil tank side) with respect to the control valves 176L, 176R in the center bypass pipelines 40L, 40R.

The opening of the cut-off valves 44L, 44R (an example of a center bypass cut-off valve) is adjusted under a control of the controller 30.

In addition, in the center bypass pipelines 40L, 40R, negative control throttles 18L, 18R are provided between the cut-off valves 44L, 44R and the hydraulic oil tank. Accordingly, the flow of hydraulic oil discharged from the main pumps 14L, 14R is limited by the negative control throttles 18L, 18R. The negative control throttles 18L, 18R generate a control pressure (hereinafter referred to as a "negative control pressure") so as to control the regulators 13L, 13R.

Also, the hydraulic system of the shovel 100 according to the present embodiment includes a relief valve and a check valve. The relief valve is configured to relieve hydraulic oil to the hydraulic oil tank when the pressure of hydraulic oil in the center bypass pipeline 40 exceeds a predetermined relief pressure. This is because an excessive increase in the pressure of hydraulic oil in the center bypass pipeline 40 may result in damage to the hydraulic devices constituting the hydraulic system and its structure. For example, the relief valve is provided in a relief pipeline connecting the center bypass pipeline 40 and the hydraulic oil tank. In addition, the above-described check valve is provided in the relief pipeline.

The check valve is configured to stop the flow of hydraulic oil from the hydraulic oil tank to the center bypass pipeline 40. For example, the check valve may include a left check valve for stopping the flow of hydraulic oil from the hydraulic oil tank to the center bypass pipeline 40L and a right check valve for stopping the flow of hydraulic oil from the hydraulic oil tank to the center bypass pipeline 40R.

The bypass pipeline includes a center relief pipeline, a left relief pipeline, and a right relief pipeline. The left relief pipeline connects the center bypass pipeline 40L and the center relief pipeline, and the right relief pipeline connects the center bypass pipeline 40R and the center relief pipeline. Accordingly, the relief pipeline merges the left relief pipeline and the right relief pipeline, of which ends are connected to the center bypass pipelines 40L, 40R, to the center relief pipeline at the other ends thereof, and is connected to the hydraulic oil tank via the center relief pipeline.

For example, the relief valve may be provided in the center relief pipeline, the left check valve may be provided in the left relief pipeline, and the right check valve may be provided in the right relief pipeline. Accordingly, with the single relief valve, hydraulic oil in the center bypass pipeline 40L and the center bypass pipeline 40R can be discharged. Alternatively, the relief valve may be separated into a left relief valve for discharging hydraulic oil in the center bypass pipeline 40L to the hydraulic oil tank and a right relief valve for discharging hydraulic oil in the center bypass pipeline 40R to the hydraulic oil tank. In this case, the left relief valve is provided in the left relief pipeline connecting the center bypass pipeline 40L and the hydraulic oil tank, and the right relief valve is provided in the right relief pipeline connecting the center bypass pipeline 40R and the hydraulic oil tank.

The operation system of the shovel 100 according to the present embodiment includes a pilot pump 15, a gate lock valve 25V, and an operating apparatus 26.

The pilot pump 15 is mounted on the rear part of the upper turning body 3, for example. The pilot pump 15 supplies, via the pilot line 25, the pilot pressure to various kinds of hydraulic devices such as the operating apparatus 26. For example, the pilot pump 15 is a fixed displacement hydraulic pump, and is driven by the engine 11, as described above.

Alternatively, the functions of the pilot pump 15 may be achieved by the main pump 14. In other words, in addition to the function of supplying hydraulic oil to the control valve 17, the main pump 14 may have a function of supplying hydraulic oil to the operating apparatus 26 and the like upon reducing the pressure of hydraulic oil with a throttle and the like. In this case, the pilot pump 15 is omitted.

In the pilot line 25, the gate lock valve 25V is provided Upstream of all of the various kinds of hydraulic devices that receive hydraulic oil from the pilot pump 15. The gate lock valve 25V switches the communicating state and the blocked state (the non-communicating state) of the pilot line 25 according to an ON/OFF operation of a limit switch synchronized with the operation of the gate lock lever in the cab 10. Specifically, in a case where the gate lock lever is pulled up, i.e., the operator's seat is open, the limit switch is turned OFF, and a voltage is not applied to the solenoid of the gate lock valve 25V from a storage battery 70, so that the gate lock valve 25V attains the non-communicating state. Therefore, the pilot line 25 is caused to be in the blocked state, and accordingly, hydraulic oil is not supplied to the operating apparatus 26 or various kinds of hydraulic devices including operation hydraulic control valves explained later. Conversely, in a case where the gate lock lever is pushed down, i.e., the operator's seat is closed, the limit switch is turned ON, and a voltage is applied to the solenoid of the gate lock valve 25V from the storage battery 70, so that the gate lock valve 25V attains the communicating state. Therefore, the pilot line 25 is caused to be in the communicating state, and accordingly, hydraulic oil is supplied to the operating apparatus 26 or various kinds of hydraulic devices including operation hydraulic control valves explained later.

The gate lock valve 25V may be configured to be able to switch between the communicating state and the blocked state in response to control commands received from the controller 30.

The operating apparatus 26 is provided near the operator's seat of the cab 10, and is operation input means allowing the operator to operate various types of driven elements (such as the lower traveling body 1, the upper turning body 3, the boom 4, the arm 5, the bucket 6, and the like) of the shovel 100. In other words, the operating apparatus 26 is an operation input means with which the operator operates the hydraulic actuator (i.e., the traveling hydraulic motors 1L, 1R, the turning hydraulic motor 2A, the boom cylinder 7, the arm cylinder 8, the bucket cylinder 9, and the like) for driving the driven elements.

For example, as illustrated in FIG. 2, the operating apparatus 26 is of a hydraulic pilot type. Specifically, the operating apparatus 26 uses hydraulic oil supplied from the pilot pump 15 through the pilot line 25 to output the pilot pressure according to the operation content to a pilot line 25*a* on its secondary side. The pilot pressure that is output from the operating apparatus 26 changes according to the operation direction and the operation amount of the operating apparatus 26. The pilot line 25*a* is connected to the control valve 17. Accordingly, the control valve 17 (control valve) receives a pilot pressure corresponding to the operation content of the operating apparatus 26. Therefore, the control valve 17 can achieve movement of the hydraulic actuators according to the operation content of the operating apparatus 26 by the operator.

The operating apparatus 26 includes, for example, lever apparatuses for operating the boom 4 (the boom cylinder 7), the arm 5 (the arm cylinder 8), the bucket 6 (the bucket cylinder 9), and the upper turning body 3 (the turning hydraulic motor 2A). In addition, the operating apparatus 26 includes, for example, pedal devices or lever devices for operating the pair of left and right crawlers (traveling hydraulic motors 1L, 1R) of the lower traveling body 1.

Also, as illustrated in FIG. 4, the operating apparatus 26 is an electric type. Specifically, the operating apparatus 26 outputs an electric signal (hereinafter referred to as an "operation signal") according to the operation content, and the operation signal is retrieved by the controller 30. Also, the controller 30 outputs a control command corresponding to the operation signal to a hydraulic control valve (for example, an electromagnetic proportional valve) (hereinafter referred to as an "operation hydraulic control valve") provided in the pilot line between the pilot pump 15 and (the control valves 171, 172, 173, 174, 175L, 175R, 176L, and 176R of) the control valve 17. Accordingly, the pilot pressure according to the operation content of the operating apparatus 26 is supplied from the operation hydraulic control valve to the control valve 17. Therefore, the control valve 17 can achieve movement of the shovel 100 according to the operator's operation content with the operating apparatus 26. Also, the controller 30 may achieve remote operations by controlling the operation hydraulic control valve. Specifically, the controller 30 may control the operation hydraulic control valve according to a signal corresponding to the content of remote operations received from an external apparatus (hereinafter referred to as a "remote operation signal"). Accordingly, the pilot pressure according to the content of the remote operation is supplied from the operation hydraulic control valve to the control valve 17. Therefore, the control valve 17 can achieve the movement of the shovel 100 according to the content of the remote operation. Also, when the operating apparatus 26 is of an electric type, the control valves 171, 172, 173, 174, 175L, 175R, 176L, and 176R in the control valve 17 may be an electromagnetic solenoid-type spool valve that is directly driven by an operation signal from the operating apparatus 26 (or a control command from the controller 30).

The pilot circuit of this example includes, as the above-described operation hydraulic control valve, an electromagnetic valve 60 for a raising operation of the boom 4 (hereinafter referred to as a "boom-raising operation") and an electromagnetic valve 62 for a lower operation of the boom 4 (hereinafter referred to as a "boom-lowering operation").

The electromagnetic valve 60 is configured to be able to adjust the pressure of hydraulic oil in the pipeline (the pilot line) that connects the pilot pump 15 and the pilot port of the boom-raising side of the control valve 17 of the pilot pressure-operated type (i.e., the control valves 175L, 175R (see FIG. 3)).

The electromagnetic valve 62 is configured to be able to adjust the pressure of hydraulic oil in the pipeline (the pilot line) that connects the pilot pump 15 and the pilot port of the boom-lowering side of the control valve 17 (i.e., the control valves 175L, 175R).

In a case where the boom 4 (the boom cylinder 7) is manually operated, the controller 30 generates a boom-raising operation signal (an electric signal) or a boom-lowering operation signal (an electric signal) according to an operation signal (an electric signal) output from the lever apparatus 26A (an operation signal generation unit). An operation signal (an electric signal) that is output from the lever apparatus 26A represents the operation content (for example, the amount of operation and the operation direction) of the lever apparatus 26A. A boom-raising operation signal (an electric signal) and a boom-lowering operation signal (an electric signal) that are output from the operation signal generation unit of the lever apparatus 26A change according to the operation content of the lever apparatus 26A (the amount of operation and operation direction).

Specifically, in a case where the lever apparatus 26A is operated in a boom-raising direction, the controller 30 outputs a boom-raising operation signal (an electric signal) according to the amount of operation to the electromagnetic valve 60. The electromagnetic valve 60 moves according to the boom-raising operation signal (an electric signal) to control the pilot pressure applied to the pilot port of the boom-raising side of the control valves 175L, 175R, i.e., a boom-raising operation signal (a pressure signal). Likewise, in a case where the lever apparatus 26A is operated in a boom-lowering direction, the controller 30 outputs a boom-lowering operation signal (an electric signal) according to the amount of operation to the electromagnetic valve 62. The electromagnetic valve 62 moves according to a boom-lowering operation signal (an electric signal) to control the pilot pressure applied to the pilot port of the boom-lowering side of the control valves 175L, 175R, i.e., a boom-lowering operation signal (a pressure signal). Therefore, the control valve 17 can achieve movement of the boom cylinder 7 (the boom 4) according to the operation content of the lever apparatus 26A.

Also, movements of the arm 5 (the arm cylinder 8), the bucket 6 (the bucket cylinder 9), the upper turning body 3 (the turning hydraulic motor 2A), and the lower traveling body 1 (the traveling hydraulic motors 1L, 1R) based on substantially the same pilot circuit are also substantially the same as the movement of the boom 4 (the boom cylinder 7).

In a case where the operating apparatus 26 is of an electric type, the controller 30 invalidates the operation signal received from the operating apparatus 26 (the operation signal generation unit) so as not to output an electric signal to the electromagnetic valves 60, 62, so that the operation with the operating apparatus 26 can be invalidated.

Back to FIG. 2, the control system of the shovel 100 according to the present embodiment includes an operation pressure sensor 15*a*, negative control pressure sensors 19L, 19R, discharge pressure sensors 28L, 28R, a display apparatus 50, a rotational speed throttle volume 52, a manual regeneration button 54, a diagnostic mode switch 56, a transmission apparatus S1, a reception apparatus S2, a positioning apparatus S3, an orientation detection apparatus S4, a direction detection apparatus S5, a camera S6, and an oil temperature sensor S7. Also, the control system of the shovel 100 according to the present embodiment includes a controller 30 and an ECU 74.

The operation pressure sensor 15*a* detects a pilot pressure (an operation pressure) of the pilot line 25*a* corresponding to the operation content of the operating apparatus 26. The output of the operation pressure sensor 15*a* is received by the controller 30. Accordingly, the controller 30 can acquire the operation content of the operating apparatus 26.

In a case where the operating apparatus 26 is of an electric type, the operation pressure sensor 15*a* is omitted.

The negative control pressure sensors 19L, 19R detect negative control pressures of the negative control throttles 18L, 18R. The detection signals corresponding to negative control pressures detected by the negative control pressure sensors 19L, 19R are received by the controller 30.

The discharge pressure sensors 28L, 28R detect the discharge pressures of the main pumps 14L, 14R, respectively. The detection signals corresponding to the discharge pressures detected by the discharge pressure sensors 28L, 28R are received by the controller 30.

The display apparatus 50 is provided at a position that can be easily seen by the operator who sits on the seat in the cab 10, and the display apparatus 50 displays various kinds of information images under the control of the controller 30. The display apparatus 50 is, for example, a liquid crystal display, an organic electroluminescence (EL) display, or the like. The display apparatus 50 may be connected to the controller 30 via an onboard communication network such as controller area network (CAN) and the like, and may be connected to the controller 30 via a private telecommunications circuit for connection between two locations.

For example, the display apparatus 50 displays images showing the situation of the surroundings of the shovel 100 (hereinafter referred to as a "surroundings image") on the basis of a captured image captured by the camera S6. The surroundings image may be a captured image captured by the camera S6, or may be a viewpoint-transformed image (for example, a perspective view image and the like showing the surroundings as seen from above the shovel 100) generated from captured images captured by the camera S6. The display apparatus 50 may display a composite image of multiple images captured by multiple cameras S6. The display apparatus 50 may display a composite image to which various kinds of image processing such as viewpoint-transformation processing is applied.

The rotational speed throttle volume 52 is used by the operator to set the target rotational speed of the engine 11. The output of the rotational speed throttle volume 52 is received by the controller 30.

The manual regeneration button 54 is used by the operator to manually cause the shovel 100 to execute an operation (hereinafter referred to as "regeneration") for burning, at a high temperature, soot and PM accumulated in the PM regeneration apparatus (for example, DPF) included in the exhaust gas processing apparatus. The output, i.e., the operation state (ON/OFF), of the manual regeneration button 54 is received by the controller 30.

The diagnostic mode switch 56 is used to transition the operation mode of the shovel 100 to a diagnostic mode for performing various kinds of diagnoses of the shovel 100 and forcibly cancelling the diagnostic mode. Examples of diagnoses of the shovel 100 include abnormality diagnosis (malfunction diagnosis) of various kinds of devices (for example, the engine 11, the main pump 14, and the like) implemented on the shovel 100, output diagnosis of the engine 11, and the like. The abnormality diagnosis includes: determination as to whether there is an abnormality (a malfunction) in the target device; determination of a location of abnormality where such an abnormality occurs; determination of the content of the abnormality, and the like. For example, in the diagnostic mode, data for performing various kinds of diagnoses of the shovel 100 is collected. The output, i.e., the operation state (ON/OFF) of the diagnostic mode switch 56 is received by the controller 30.

Operation means for transitioning the operation mode of the shovel 100 to the diagnostic mode and operation means for canceling the diagnostic mode of the shovel 100 may be provided separately. Also, the function of the diagnostic mode switch 56 may be achieved by the management apparatus 300. In this case, when the diagnostic mode switch is operated on the management apparatus 300, a signal corresponding to the operation input is transmitted from the management apparatus 300 to the shovel 100. Then, in response to reception of the signal, the controller 30 may transition the operation mode of the shovel 100 to the diagnostic mode, or may forcibly cancel the diagnostic mode. Accordingly, a user of the management apparatus 300 such as a manager, a worker, and the like can remotely transition the operation mode of the shovel 100 to the diagnostic mode, or can forcibly cancel the diagnostic mode of the shovel 100. Also, in the case where operation means for transition to the diagnostic mode and operation means for canceling the diagnostic mode are provided separately, both of them may be achieved by the management apparatus 300.

The transmission apparatus S1 transmits information to the outside (for example, the management apparatus 300) via the predetermined communication network under the control of the controller 30. For example, the transmission apparatus S1 transmits diagnostic data acquired by the shovel 100 to the management apparatus 300 by wireless communication with the management apparatus 300. The diagnostic data represents multiple detection values continuously detected by the sensors with constant time intervals in the chronological order, and is used to perform various kinds of diagnoses as explained later.

The reception apparatus S2 receives information from the outside (for example, the management apparatus 300) via the predetermined communication network under the control of the controller 30.

The positioning apparatus S3 measures the position of the shovel 100 (the upper turning body 3), and acquires information about the position of the shovel 100. For example, the positioning apparatus S3 is a GNSS (Global Navigation Satellite System) module, and detects the position of the upper turning body 3 (for example, latitude, longitude, altitude of the position where the shovel 100 is existent). For example, the GNSS includes Global Positioning System (GPS), GLONASS, Galileo, and the like. A detection signal corresponding to the position of the upper turning body 3 measured by the positioning apparatus S3 is received by the controller 30.

The orientation detection apparatus S4 detects the body and the orientation state of the excavation attachment of the shovel 100. For example, the orientation detection apparatus S4 may include a boom angle sensor for detecting an orientation angle (hereinafter referred to as a "boom angle") of the boom 4, an arm angle sensor for detecting an angle (hereinafter referred to as an "arm angle") of the arm 5, a bucket angle sensor for detecting an orientation angle (hereinafter referred to as a "bucket angle") of the bucket 6, a body inclination sensor for detecting an orientation angle (an inclination angle) of the upper turning body 3, and the like. Examples of such sensors include a rotary encoder, an acceleration sensor, a six-axis sensor, an inertial measurement unit (IMU), and the like. Detection signals corresponding to the boom angle, the arm angle, the bucket angle, and the inclination angle detected by the orientation detection apparatus S4 are received by the controller 30.

The direction detection apparatus S5 detects the direction of the shovel 100 (i.e., the upper turning body 3). For example, the direction detection apparatus S5 is a geomagnetic sensor. The direction detection apparatus S5 may be a resolver (or an encoder), a gyro sensor, or the like corresponding to the turning axis of the turning mechanism 2.

For example, the controller 30 can calculate the position of a working portion (for example, teeth end, back surface, and the like) of the bucket 6 on the basis of the outputs of the positioning apparatus S3, the orientation detection apparatus S4, and the direction detection apparatus S5. The reference coordinate system used for position information of the working portion may be, for example, the World Geodetic System.

The camera S6 captures images of the surroundings of the shovel 100, and acquires image information showing the situation of the surroundings of the shovel 100. The camera S6 is, for example, a monocular wide-angle camera with an extremely wide angle of view. The camera S6 may be a stereo camera, a distance image camera, a depth camera, and the like. Specifically, the camera S6 is attached to the upper surface of the upper turning body 3, and captures images of the situation of the surroundings of the upper turning body 3. As illustrated in FIG. 1, the camera S6 includes a rear camera that captures images behind the upper turning body 3. Also, instead of or in addition to the rear camera, the camera S6 includes at least one of a front camera, a left camera, and a right camera that captures images in front, left, and right, respectively, of the shovel 100. The captured images acquired by the camera S6 are received by the controller 30.

For example, the camera S6 functions as a surroundings monitor apparatus, and may be configured to detect an object that is present in the surroundings within a predetermined distance from the shovel 100 (hereinafter referred to as a "monitor area"). The detection target object (hereinafter referred to as a "monitor object") includes, for example, persons, animals, vehicles, construction machines, buildings, walls, fences, halls, or the like. Also, instead of or in addition to the camera S6 that may include a stereo camera, a distance image camera, a depth camera, and the like, the shovel 100 may include, as a surroundings monitor apparatus, for example, an ultrasonic sensor, a millimeter wave radar, a light detection ranging (LIDAR) device, an infrared sensor, and the like.

For example, the oil temperature sensor S7 is provided in the hydraulic oil tank, and detects the temperature of hydraulic oil used in the hydraulic driving system (the hydraulic system) of the shovel 100. The output (the detection signal) of the oil temperature sensor S7 is received by the controller 30. Accordingly, the controller 30 can acquire (the detection value of) the oil temperature of hydraulic oil of the hydraulic driving system (the hydraulic system).

For example, the controller 30 is provided in the cab 10, and performs various kinds of controls of the shovel 100. The functions of the controller 30 may be achieved by any given hardware, a combination of hardware and software, and the like. For example, the controller 30 is mainly constituted by a computer including a central processing unit (CPU), a memory device such as a random access memory (RAM), a nonvolatile auxiliary storage device such as a read only memory (ROM), and an interface device, and the like. For example, the controller 30 achieves various kinds of functions by loading various kinds of programs installed in the auxiliary storage device to the memory device and causing the CPU to execute the programs. In addition, the controller 30 is connected to the transmission apparatus S1, the reception apparatus S2, the positioning apparatus S3, the orientation detection apparatus S4, the direction detection apparatus S5, the camera S6, the oil temperature sensor S7, the display apparatus 50, the rotational speed throttle volume 52, the manual regeneration button 54, and the diagnostic mode switch 56. For example, the controller 30 may execute various kinds of calculations on the basis of information that is output from the reception apparatus S2, the positioning apparatus S3, the orientation detection apparatus S4, the direction detection apparatus S5, and the camera S6. Also, the controller 30 may transmit information generated based on the calculation result to an external apparatus via the transmission apparatus S1, and may display the information on the display apparatus 50. The controller 30 is an example of processing circuitry.

For example, as necessary, the controller 30 may output a control command to the regulator 13 in accordance with the received output of the operation pressure sensor 15*a*, and change the discharge quantity of the main pump 14.

Also, for example, the controller 30 may control the regulators 13L, 13R according to the discharge pressures of the main pumps 14L, 14R detected by the discharge pressure sensors 28L, 28R, and adjust the discharge quantities of the main pumps 14L, 14R. Specifically, in accordance with an increase in the discharge pressure of the main pump 14L, the controller 30 may control the regulator 13L and adjust the tilt angle of the swash plate of the main pump 14L, so that the discharge quantity is reduced. This is also applicable to the regulator 13R. Accordingly, the controller 30 can perform total horse power control of the main pumps 14L, 14R so that suction horse powers of the main pumps 14L, 14R expressed by a product of the discharge pressure and the amount of discharge does not exceed the output horse power of the engine 11.

Also, the controller 30 may adjust the amounts of discharges of the main pumps 14L, 14R by controlling the regulators 13L, 13R according to the negative control pressures detected by the negative control pressure sensors 19L, 19R. Specifically, as the negative control pressure increases, the controller 30 decreases the amounts of discharges of the main pumps 14L, 14R, and as the negative control pressure decreases, the controller 30 increases the amounts of discharges of the main pumps 14L, 14R.

Specifically, in a case where the hydraulic actuator in the shovel 100 is in a standby state (a state as illustrated in FIG. 3) in which no operation is performed, the hydraulic oils discharged from the main pumps 14L, 14R pass through the center bypass pipelines 40L, 40R to reach the negative control throttles 18L, 18R. Then, the flows of the hydraulic oils discharged from the main pumps 14L, 14R increase the negative control pressures generated at the upstream of the negative control throttles 18L, 18R. As a result, the controller 30 decreases the amounts of discharges of main pumps 14L, 14R to the allowable minimum amounts of discharges, and reduces pressure force loss (pumping loss) that occurs when the discharged hydraulic oils pass through the center bypass pipelines 40L, 40R.

Conversely, in a case where any one of the hydraulic actuators is operated by the operating apparatus 26, the hydraulic oils discharged from the main pumps 14L, 14R flow via the corresponding control valves to the operation target hydraulic actuators. Accordingly, the amounts of the hydraulic oils discharged from the main pumps 14L, 14R and reaching the negative control throttles 18L, 18R decrease or disappear, so that the negative control pressures occurring at the upstream of the negative control throttles 18L, 18R decrease. As a result, the controller 30 increases the amounts of discharges of the main pumps 14L, 14R, and circulate hydraulic oils sufficient for the hydraulic actuators of the operation targets, so that the hydraulic actuators of the operation targets can be driven reliably.

Also, for example, the controller 30 sets the target rotational speed in accordance with the output of the rotational speed, throttle volume 52, and performs driving control for constantly rotating the engine 11 via the ECU 74.

Also, for example, the controller 30 monitors whether there is a monitor object entering the monitor area in the surroundings of the shovel 100 with the surroundings monitor apparatus (for example, the camera S6). Specifically, the controller 30 may detect the monitor object in the monitor area on the basis of the output of the surroundings monitor apparatus. Also, the controller 30 may identify (find) the type and the position of the monitor object by using a technique such as conventional machine learning and the like on the basis of the output of the surroundings monitor apparatus. Also, in a case where the monitor object is detected in the monitor area, the controller 30 may send, by a predetermined method, a notification that the monitor object is detected in the monitor area to the operator or the surroundings of the shovel 100. Alternatively, only when the detected monitor object is determined to be a person, the controller 30 may send a notification to the operator and the surroundings of the shovel 100. For example, notification to the operator in the cab 10 may be given by a visual method or an auditory method through the display apparatus 50 in the cab 10 or a sound output apparatus (for example, a buzzer, a speaker, and the like). Also, for example, notification to the surroundings of the shovel 100 may be given by an auditory method or a visual method through a sound output apparatus (for example, a buzzer, an alarm, and the like) or a lighting apparatus (for example, headlights, red lamps, or the like) mounted on the upper turning body 3. Also, for example, notification to the operator of remote operation may be given by an auditory method or a visual method through a sound output apparatus or a display apparatus installed in an external apparatus (for example, the management apparatus 300) that supports remote operation by transmitting a signal requesting notification to the external apparatus. Also, when the monitor object is detected in the monitor area, the controller 30 may limit movement of the actuators (driven units) of the shovel 100 by a predetermined method. Also, only when the detected monitor object is determined to be a person, the controller 30 may limit the movement of the actuators (driven units) of the shovel 100. Limiting of the movement of the actuators includes a control aspect for relatively reducing the movement speed of the actuators with respect to operations. Also, limiting of the movement of the actuators includes a control aspect for maintaining the stopped state of the actuators irrespective of whether an operation is performed. For example, limiting of the movement of the actuators (maintaining of the stopped state) may be achieved by causing the gate lock valve 25V to be in the non-communicating state. Also, in a case where the operating apparatus 26 is of an electric-type, the controller 30 may achieve limiting of the movement of the actuators (maintaining of the stopped state) by invalidating an operation signal without outputting a signal for the operation hydraulic control valve even if such an operation signal is received.

Also, for example, as explained above, in the diagnostic mode of the shovel 100, the controller 30 may monitor, with the surroundings monitor apparatus, whether there is a monitor object entering the monitor area in the surroundings of the shovel 100. In this case, the controller 30 may continue processing of acquisition of diagnostic data even if a monitor object (for example, a person) is detected in the monitor area. This is because, as explained above, in the processing for acquisition of the diagnostic data, the operation of the shovel 100 (the actuators) is invalidated, so that the attachment and the like of the shovel 100 does not come into proximity to the monitor object such as a person in the surroundings due to movement of the driven units of the shovel 100. Furthermore, in a case where the processing for acquisition of the diagnostic data ends but the monitor object (for example, a person) continues to be detected in the monitor area, the controller 30 may limit the movement of the actuators. This is because when the processing for acquisition of the diagnostic data ends, the shovel 100 (the actuators) is ready to operate, so that there is a risk that the attachment and the like of the shovel 100 comes into proximity to the monitor object in the surroundings due to movement of the driven units of the shovel 100.

Also, for example, during execution of the automatic warm-up driving function of the shovel 100 (i.e., during the warm-up mode of the shovel 100), the controller 30 may monitor, with the surroundings monitor apparatus, whether there is a monitor object entering the monitor area in the surroundings of the shovel 100. Likewise, for example, during execution of the automatic regeneration function and the manual regeneration function of the shovel 100 (i.e., during the automatic regeneration mode and the manual regeneration mode of the shovel 100), the controller 30 may monitor, with the surroundings monitor apparatus, whether there is a monitor object entering the monitor area in the surroundings of the shovel 100. During the warm-up mode, the automatic regeneration mode, and the manual regeneration mode of the shovel 100, the controller 30 may continue the processing for acquisition of the diagnostic data even if the monitor object (for example, a person) is detected in the monitor area. Furthermore, the controller 30 may limit the movement of the actuators in a case where the warm-up mode, the automatic regeneration mode, or the manual regeneration mode ends, and where the monitor object (for example, a person) continues to be detected in the monitor area.

Also, as illustrated in FIG. 3, the controller 30 includes an automatic warm-up control unit 301, an automatic regeneration control unit 302, a manual regeneration control unit 303, a diagnostic mode setting unit 304, a diagnostic data acquisition control unit 305, and a diagnostic data transmission unit 306.

When the shovel 100 starts (i.e., the key switch is turned ON), the automatic warm-up control unit 301 automatically performs warm-up driving of the engine 11 and the hydraulic system (the hydraulic oil) of the shovel 100 (hereinafter referred to as "warm-up driving of the shovel 100"). Specifically, the automatic warm-up control unit 301 achieves the automatic warm-up driving function of the shovel 100.

The automatic regeneration control unit 302 determines whether it is necessary to regenerate the exhaust gas processing apparatus (the PM regeneration apparatus), and in a case where the regeneration is determined to be necessary, the automatic regeneration control unit 302 automatically regenerates the exhaust gas processing apparatus. For example, when the shovel 100 drives with a relatively high load, the automatic regeneration control unit 302 maintains the engine 11 at a relatively high load state, so that soot and PM accumulated in the PM regeneration apparatus are burnt with a high-temperature exhaust gas. Specifically, the automatic regeneration control unit 302 achieves the automatic regeneration function of the exhaust gas processing apparatus (the PM regeneration apparatus).

During execution of the automatic regeneration function with the automatic regeneration control unit 302, collection of the diagnostic data explained later is not carried out.

In a case where the regeneration of the exhaust gas processing apparatus (the PM regeneration apparatus) cannot be completed in the automatic regeneration function due to the driving state of the shovel 100 and the like (for example, continuation of a relatively low load driving state), the manual regeneration control unit 303 sends the operator a notification that it is necessary to manually regenerate the exhaust gas processing apparatus through the display apparatus 50 and the like. Then, when the operator turns on the manual regeneration button 54, the manual regeneration control unit 303 maintains the engine 11 at a relatively high load state to burn soot and PM accumulated in the PM regeneration apparatus with a high-temperature exhaust gas. Specifically, the manual regeneration control unit 303 achieves the manual regeneration function of the exhaust gas processing apparatus (the PM regeneration apparatus).

The diagnostic mode setting unit 304 sets (transitions) the operation mode of the shovel 100 to the diagnostic mode in accordance with a predetermined condition (for example, an ON operation of the diagnostic mode switch). Also, the diagnostic mode setting unit 304 cancels the diagnostic mode of the shovel 100 according to a predetermined condition (for example, an OFF operation of the diagnostic mode switch).

The diagnostic data acquisition control unit 305 acquires the diagnostic data of the shovel 100 under a constant driving condition (for example, by applying a constant load to the shovel 100). For example, the diagnostic data acquisition control unit 305 may apply a constant hydraulic load to the hydraulic system of the shovel 100 by closing the cut-off valves 44L, 44R and changing the discharge pressure of the main pump 14 to the relief pressure irrespective of the operation lever during the warm-up mode explained later, and may acquire the diagnostic data of the shovel 100 in that state. Examples of diagnostic data acquired by the diagnostic data acquisition control unit 305 include a fuel injection rate (0 to 100%) of the engine 11, a rotational speed command value of the engine 11, an actual rotational speed of the engine 11, the tilt angles of the swash plates of the main pumps 14L, 14R, discharge pressures of the main pumps 14L, 14R, a boost pressure of the turbine provided in the engine 11, a common rail pressure, an oil pressure of the engine 11, a temperature of the exhaust gas, a NOx measurement value of the exhaust gas, a hydraulic oil temperature, and the like. However, the diagnostic data acquired by the diagnostic data acquisition control unit 305 is not limited thereto, and may be any information so long as the information can be detected by sensors provided in the shovel 100.

The diagnostic data transmission unit 306 transmits the diagnostic data acquired by the diagnostic data acquisition control unit 305 to the management apparatus 300 via wireless communication with the management apparatus 300 by the transmission apparatus S1.

Some of the functions of the controller 30 may be achieved by another controller (a control apparatus). Specifically, the functions of the controller 30 may be achieved as being distributed across multiple controllers.

The ECU 74 performs the driving control of the engine 11 under the control of the controller 30. For example, the ECU 74 controls the fuel injection quantity and the like of the engine 11 so that the engine rotational speed of the engine 11 attains the preset engine rotational speed. Specifically, the ECU 74 controls various kinds of actuators implemented in the engine 11 (for example, an injector and the like injecting fuel into the cylinder) on the basis of the outputs of various kinds of sensors implemented in the engine 11 (for example, an engine rotational speed sensor, a water temperature sensor, and the like). Also, the outputs of various kinds of sensors implemented in the engine 11 are received via the controller 30 via the ECU 74. Accordingly, the controller 30 can acquire (the detection value of) the water temperature and the like of the engine 11.

The power supply system of the shovel 100 according to the present embodiment includes the storage battery 70.

The storage battery 70 supplies electric power to various kinds of electric devices of the shovel 100 (for example, the starter 11*b*, the controller 30, the display apparatus 50, the ECU 74, and the like). The storage battery 70 is charged by the power generated by the generator 11*a* driven by the motive power of the engine 11. For example, the storage battery 70 is, for example, a lead battery.

<Configuration of Management Apparatus>

The management apparatus 300 includes a control apparatus 310, a transmission apparatus 320, a reception apparatus 330, a display apparatus 340, and an operation input apparatus 350.

The control apparatus 310 performs various kinds of controls of the management apparatus 300. The control apparatus 310 may be achieved by any given hardware, a combination of hardware and software, and the like. For example, the control apparatus 310 is mainly constituted by a computer including a CPU, a memory device such as a RAM, a nonvolatile auxiliary storage device such as a ROM, and an interface device for various kinds of inputs and outputs, and the like. For example, the control apparatus 310 achieves various kinds of functions by loading various kinds of programs installed in the auxiliary storage device to the memory device and causing the CPU to execute the programs. The control apparatus 310 includes a diagnostic unit 3101.

The diagnostic unit 3101 performs various kinds of diagnoses of the shovel 100 on the basis of the diagnostic data received from the shovel 100 through the reception apparatus 330. For example, the diagnosis of the shovel 100 includes abnormality diagnosis (malfunction diagnosis) of various kinds of devices implemented in the shovel 100 (for example, the engine 11, the main pump 14, and the like), the output diagnosis of the engine 11, and the like. The abnormality diagnosis includes: determination as to whether there is an abnormality (a malfunction) in the target device; determination of a location of abnormality where such an abnormality occurs; determination of the content of the abnormality, and the like.

Also, the diagnostic unit 3101 may transmit a diagnostic result to the shovel 100 through the transmission apparatus 320. Accordingly, a user of the shovel 100 such as an operator can ascertain the diagnostic result through the display apparatus 50 and the like of the shovel 100. Also, the diagnostic unit 3101 may transmit the diagnostic result to another management apparatus (for example, a portable terminal such as a smartphone used by the user of the shovel management system SYS) through the transmission apparatus 320. Accordingly, for example, the user can cause the diagnostic result to be displayed on the screen of the smartphone and the like, and ascertain the diagnostic result.

It should be noted that the functions for performing various kinds of diagnoses of the shovel 100 (the function of the diagnostic unit 3101) may be achieved by the shovel 100 (for example, the controller 30).

The transmission apparatus 320 transmits information (for example, a control command for the shovel 100) to an external apparatus through the predetermined communication network.

The reception apparatus 330 receives information (for example, diagnostic data from the shovel 100) from an external apparatus through the predetermined communication network.

The display apparatus 340 displays various kinds of information images about the management apparatus 300 (for example, the diagnostic data received from the shovel 100, the diagnostic result of the shovel 100 diagnosed by the control apparatus 310, and the like) for the manager of the management apparatus 300 and the worker under the control of the control apparatus 310. For example, the display apparatus 340 is a liquid crystal display and an organic EL display.

The operation input apparatus 350 receives an operation input from a user such as the manager of the management apparatus 300 and the worker, and outputs the operation input to the control apparatus 310. The operation input apparatus 350 may include, for example, a keyboard, a mouse, a touch panel, and the like.

First Example of Diagnostic Data Acquisition Processing

Next, a first example of control processing about acquisition of diagnostic data by the controller 30 (hereinafter referred to as "diagnostic data acquisition processing") is explained with reference to FIG. 5 to FIG. 9.

<Procedure of Diagnostic Data Acquisition Processing>

Figure 5:
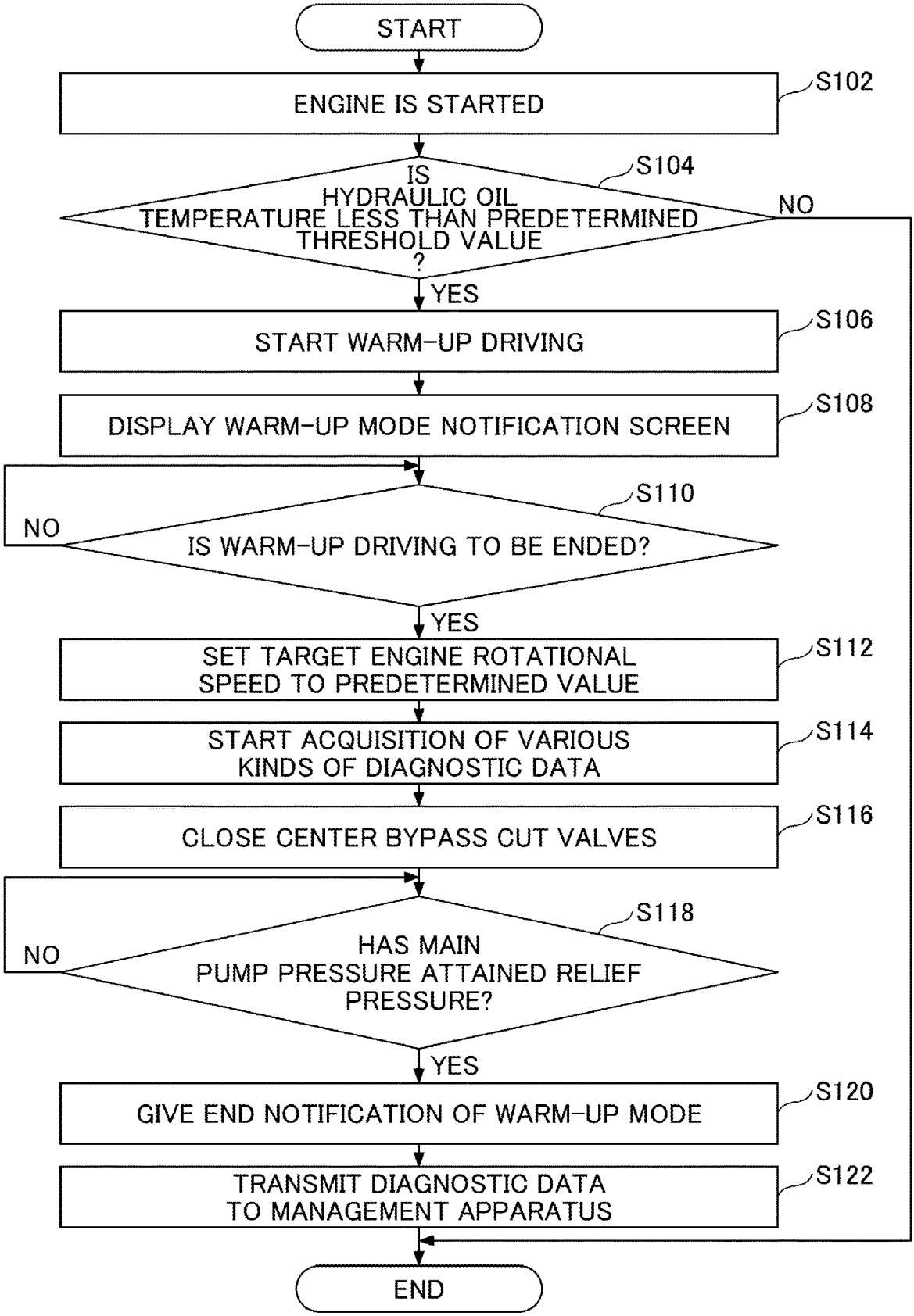
FIG. 5 is a flowchart schematically illustrating a first example of control processing performed by a controller to acquire diagnostic data.

FIG. 5 is a flowchart illustrating the first example of the diagnostic data acquisition processing performed by the controller 30.

First, when the engine 11 is started in the shovel 100 (step S102), the controller 30 (the automatic warm-up control unit 301) determines whether the hydraulic oil temperature is less than the predetermined threshold value on the basis of the detection value of the oil temperature sensor S7 configured to detect the hydraulic oil temperature (step S104). In a case where the controller 30 determines that the hydraulic oil temperature is equal to or more than the predetermined threshold value in a step S104 (step S104:NO), the controller 30 ends the series of processing as illustrated in FIG. 4.

Conversely, in a case where the controller 30 (the automatic warm-up control unit 301) determines that the hydraulic oil temperature is less than the predetermined threshold value in step S104 (step S104:YES), the controller 30 controls the ECU 74 of the shovel 100 to start the warm-up driving of the shovel 100 (step S106).

Likewise, the warm-up driving of the shovel 100 includes warm-up of the hydraulic system (the hydraulic oil). Therefore, the controller 30 may close the cut-off valves 44L, 44R when the warm-up driving of the shovel 100 starts. Accordingly, the discharge pressure of the main pump 14 (hereinafter referred to as a "main pump pressure") gradually increases. Then, when the main pump pressure reaches the relief pressure, the hydraulic oil is discharged from the relief valve to the hydraulic oil tank, and at that occasion, the hydraulic oil is gradually heated by frictional heat with the relief valve. Therefore, the temperature of hydraulic oil can be heated in a shorter period of time than when the hydraulic oil is circulated through the center bypass pipelines 40L, 40R.

Also, when the warm-up driving of the shovel 100 starts, the controller 30 switches the control mode (the movement mode) of the shovel 100 to the warm-up mode. Then, the controller 30 causes the display apparatus 50 to display a warm-up mode notification message for notifying the operator of the shovel 100 that the control mode is the warm-up mode (step S108). In this example, the implementation period of the warm-up mode includes a warm-up driving execution period and a diagnostic data collection period. The warm-up driving execution period is a period in which the warm-up driving of the shovel 100 is performed. The diagnostic data collection period is a period in which, after the warm-up driving of the shovel 100 is completed, diagnostic data is collected by applying a constant load. Specifically, in this example, the warm-up mode includes the diagnostic mode, and the diagnostic data collection period corresponds to the diagnostic mode. Also, in the warm-up mode, the gate lock is in the ON state (i.e., the gate lock valve 25V is in the non-communicating state) to start the engine 11, and accordingly, the operator cannot operate the operating apparatus 26.

Figure 6:
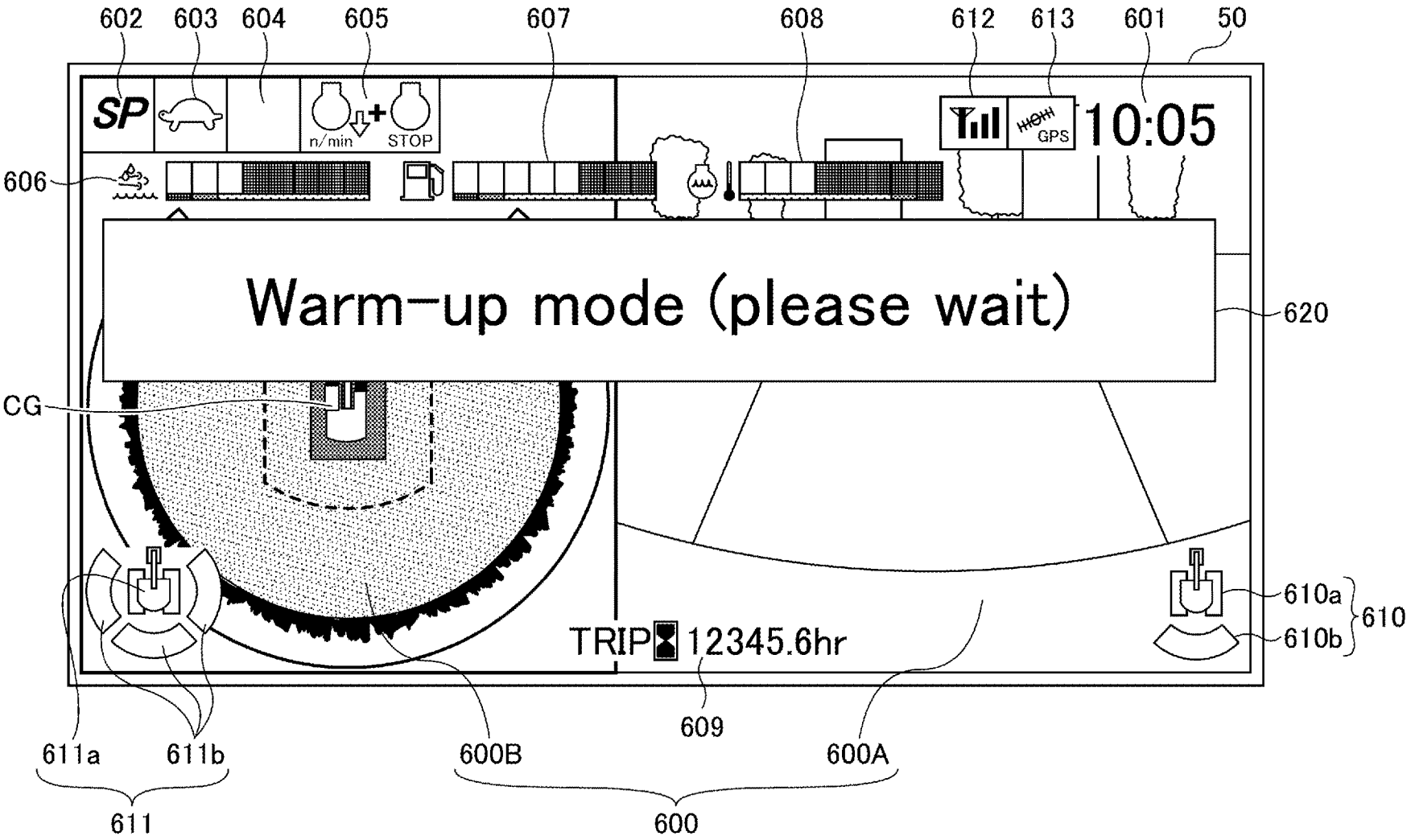
FIG. 6 is a diagram illustrating an example of a display content of a display apparatus in a warm-up mode.

For example, FIG. 6 is a diagram illustrating an example of a display content displayed by the display apparatus 50 in the warm-up mode. Specifically, FIG. 6 is a diagram illustrating an example of a warm-up mode notification message. The display screen as illustrated in FIG. 6 is an example of a screen displayed on the display apparatus 50 of the shovel 100 when the shovel 100 is in the warm-up mode.

As illustrated in FIG. 6, for example, the display apparatus 50 displays a surroundings image 600 of the shovel 100 on the basis of the output (the captured image) of the camera S6. Also, the display apparatus 50 displays indication components 601 to 613, indicating various kinds of information about the shovel 100, in an overlapping manner on the surroundings image 600.

The surroundings image 600 includes surroundings images 600A, 600B.

The surroundings image 600A is displayed on the substantially right half of the display area of the display apparatus 50. The surroundings image 600B is displayed on the substantially left half of the display area of the display apparatus 50.

The indication component 601 indicates the current time.

The indication component 602 indicates the operating mode corresponding to the engine rotational speed that is set with a predetermined input means (for example, the rotational speed throttle volume 52 and the engine rotational speed adjustment dial).

The indication component 603 indicates the type of the traveling mode that is set. The traveling mode indicates the setting state of the traveling hydraulic motors 1L, 1R using variable displacement motors. For example, the traveling mode includes a low-speed mode and a high-speed mode. A "turtle"-shaped mark is displayed for the low-speed mode, and a "rabbit"-shaped mark is displayed for the high-speed mode.

The indication component 604 indicates an icon representing the type of the currently attached attachment.

The indication component 605 indicates the control state of the engine 11. In this example, an "automatic deceleration-and-automatic stop mode" is selected as the control state of the engine 11. The automatic deceleration-and-automatic stop mode means a control state in which the engine rotational speed is automatically regenerated in accordance with the length of time in which the non-operation state continues, and further, the engine 11 is automatically stopped. The control state of the engine 11 indicated by the indication component 605 may further include an "automatic deceleration mode", an "automatic stop mode", a "manual deceleration mode", and the like.

The indication component 606 indicates the remaining amount of urea water stored in the urea tank to be used in the urea SCR system, which is an example of the NOx regeneration apparatus. In this example, the indication component 606 has a bar gauge displayed to indicate the current remaining amount state of urea water. The remaining amount of the urea water is displayed on the basis of the data that is output from a urea water remaining amount sensor provided in the urea tank.

The indication component 607 indicates the remaining amount state of fuel stored in the fuel tank. In this example, the indication component 607 has a bar gauge displayed to indicate the current remaining amount state of fuel. The remaining amount of fuel is displayed on the basis of data that is output from a fuel remaining amount sensor provided in the fuel tank.

The indication component 608 indicates a temperature state of cooling water (hereinafter referred to as "engine cooling water") of the engine 11. In this example, the indication component 608 has a bar gauge displayed to indicate the temperature state of the engine cooling water. The temperature of the engine cooling water is displayed on the basis of data that is output from the water temperature sensor provided in the engine 11.

The indication component 609 indicates the total running time of the engine 11. In this example, in the indication component 609, the total running time since the operator starts counting is displayed together with the unit "hr" (hours). In the indication component 609, either a lifetime running time indicating the entire period of time since the manufacture of the shovel 100 or a partial running time counted after a restart of counting by the operator may be displayed.

The indication component 610 indicates a range of surroundings image displayed as the surroundings image 600A. The indication component 610 includes: a shovel image 610*a* indicating the shape of the shovel 100; and a direction display image 610*b* in a belt shape indicating the image-capturing direction of the camera S6 that captures the image corresponding to the surroundings image being displayed.

In this example, the direction display image 610*b* is displayed on the lower side of the shovel image 610*a* (on an opposite side from the figure indicating the attachment). This indicates that an image behind the shovel 100 that is captured by the rear camera included in the camera S6 is displayed as the surroundings image 600A. For example, in a case where an image captured by the right camera included in the camera S6 is displayed as the surroundings image 600, the direction display image 610*b* is displayed on the right side of the shovel image 610*a*. Also, for example, in a case where an image captured by the left camera included in the camera S6 is displayed as the surroundings image 600, the direction display image 610*b* is displayed on the left side of the shovel image 610*a*.

The indication component 611 indicates a range of surroundings image displayed as the surroundings image 600B. Similarly with the indication component 610, the indication component 611 includes: a shovel image 611*a* indicating the shape of the shovel 100; and a direction display image 611*b* in a belt shape indicating the image-capturing direction of the camera S6 that captures the image corresponding to the surroundings image being displayed.

In this example, the direction display image 611*b* is displayed on the left, lower, and right sides of the shovel image 611*a*. This indicates that a composite image generated based on the left, rear, and right images of the shovel 100 captured by the left camera, the rear camera, and the right camera included in the camera S6 is displayed as the surroundings image 600B. Specifically, the surroundings image 600B is a perspective view image of the surroundings (the left, rear, and right sides) of the shovel 100 as seen from immediately above the shovel 100. Also, in the surroundings image 600B, a shovel image CG representing the shovel 100 is displayed at substantially the center in such a manner that the position of the image-capturing range shown in the perspective view image and the position of the shovel 100 are aligned with each other. Accordingly, in which direction any given image portion of the surroundings image 600B is located with reference to the shovel 100 can be easily understood.

For example, by pressing a predetermined switch provided in the cab 10, the operator can switch images displayed as the surroundings images 600A, 600B to an image captured by another camera, a predetermined composite image, and the like.

In a case where the camera S6 is not provided in the shovel 100, the display apparatus 50 may display different information, instead of displaying the surroundings image 600 (the surroundings images 600A, 600B).

The indication component 612 indicates a connection quality with the predetermined communication network for communicating with the outside through the transmission apparatus S1 and the reception apparatus S2. Specifically, the indication component 612 includes an antenna image in the shape of an antenna and multiple bar icons (three bar icons in this example) of different lengths that are arranged stepwise besides the antenna image. Up to three bar icons are displayed. The number of bar icons displayed is changed such that the number of bar icons increases in accordance with an increase in the connection quality with the communication network, and the number of bar icons decreases in accordance with a decrease in the connection quality with the communication network. Based on the number of display bar icons, the user can ascertain the connection quality with the communication network, i.e., the user can ascertain whether a good condition for communicating with the outside through the communication network is attained.

The indication component 613 is an icon representing a reception quality of GNSS signals with the positioning apparatus S3. Specifically, the indication component 613 includes a satellite image in the shape of a GPS satellite that is an icon indicating the reception quality of GPS signals with the positioning apparatus S3; and a character image of "GPS". In a case where the reception quality of the GPS signals is high and the position of the shovel 100 can be determined with the positioning apparatus S3, the icon of the indication component 613 is displayed. In a case where the reception quality of the GPS signals is low and the position of the shovel 100 cannot be determined with the positioning apparatus S3, the icon of the indication component 613 is hidden. Based on whether the icon of the indication component 613 is displayed, the user can determine the reception quality of the GPS signals, i.e., the user can ascertain whether the position of the shovel 100 can be determined with the positioning apparatus S3.

In addition to a display content displayed at the start of the warm-up mode (the surroundings image 600 and the indication components 601 to 613 in this example), the display apparatus 50 displays a notification component 620 for notifying the operator that the shovel 100 is now in the warm-up mode, in an overlapping manner on the display content.

The notification component 620 is displayed in the central portion in the vertical direction of the display area of the display apparatus 50. In this example, in the notification component 620, "Warm-up mode (please wait)" is displayed as the warm-up mode notification message. Accordingly, the operator of the shovel 100 can recognize that the shovel 100 has transitioned to the warm-up mode, and the automatic warm-up function is being executed. Also, the operator can recognize that, because the shovel 100 is in the warm-up mode, the user cannot operate the shovel 100.

In the warm-up mode, the shovel 100 does not necessarily have to invalidate operations with the operating apparatus 26 and remote operations, and may be in an operable state.

Back to FIG. 5, next, the controller 30 determines whether the warm-up driving of the shovel 100 is to be ended (step S110). For example, the warm-up driving of the shovel 100 ends when a predetermined end condition (for example, a case where the hydraulic oil temperature detected by the oil temperature sensor attains a predetermined threshold value) is satisfied. In a case where the warm-up driving of the shovel 100 is not ended, i.e., the end condition is not satisfied in step S110 (step S110:NO), the controller 30 (the automatic warm-up control unit 301) repeatedly executes processing of step S110 until an end condition is satisfied.

Conversely, in a case where the warm-up driving of the shovel 100 is to be ended in step S110 (step S110:YES), the controller 30 (the diagnostic data acquisition control unit 305) sets the target engine rotational speed to a predetermined value (step S112). Then, the controller 30 (the diagnostic data acquisition control unit 305) starts acquisition of various kinds of diagnosis data (step S114). Accordingly, on every acquisition of various kinds of diagnoses data, the controller 30 can bring the water temperature of the engine 11, the oil temperature of the hydraulic oil, and the like to a constant state at the end of the warm-up driving. Also, on every acquisition of various kinds of diagnoses data, the controller 30 can bring the rotational speed of the engine 11 to the above-described predetermined value. Therefore, the controller 30 can acquire the diagnostic data by causing the engine 11 and the hydraulic system to be in a constant driving condition.

As described above, in a case where rapid warm-up driving is performed by closing the cut-off valves 44L, 44R, the cut-off valves 44L, 44R are once opened at the end of the warm-up driving, and as explained above, after the start of acquisition of the diagnostic data, the cut-off valves 44L, 44R are closed again.

After a predetermined period of time elapses since the start of acquisition of the diagnostic data, the diagnostic data acquisition control unit 305 closes the cut-off valves 44L, 44R (step S116). Accordingly, the main pump pressure (the pressure of hydraulic oil in the center bypass pipelines 40L, 40R) gradually increases, and the hydraulic load for the engine 11 (the hydraulic system) increases. Then, the diagnostic data acquisition control unit 305 determines whether the main pump pressure has attained the relief pressure (step S118). In the present embodiment, the main pump pressure having attained the relief pressure is referred to as a "constant (hydraulic) load". Therefore, in this case, the controller 30 confirms that the main pump pressure has attained the relief pressure. In a case where the main pump pressure is determined not to have attained the relief pressure in step S118 (step S118:NO), the diagnostic data acquisition control unit 305 repeatedly executes the processing of step S118 until the main pump pressure attains the relief pressure.

Conversely, in a case where the main pump pressure is determined to have attained the relief pressure in step S118 (step S118:YES), the diagnostic data acquisition control unit 305 continues acquisition of the diagnostic data until a predetermined period of time (for example, one minute) elapses since the start of acquisition of the diagnostic data. Also, the diagnostic data acquisition control unit 305 may continue acquisition of the diagnostic data until a constant period of time elapses since a point in time when the main pump pressure is determined to have attained the relief pressure. Therefore, the controller 30 can acquire diagnostic data including: data that is acquired before a constant load is applied to the engine 11 and the hydraulic system; data in a transitional state that is acquired when a constant load is applied thereto; and data acquired after the constant load is applied thereto. Also, on every acquisition, the controller 30 can acquire the diagnostic data in a constant driving condition corresponding to the state in which a constant hydraulic load is applied.

For example, the diagnostic data acquisition control unit 305 acquires, as the diagnostic data, the fuel injection rate (0 to 100%) of the engine 11, the rotational speed command value of the engine 11, the actual rotational speed of the engine 11, the tilt angles of the swash plates of the main pumps 14L, 14R, the discharge pressures of the main pumps. 14L, 14R, the boost pressure of the turbine provided in the engine 11, the common rail pressure, the oil pressure of the engine 11, the temperature of the exhaust gas, the NOx measurement value of the exhaust gas, the hydraulic oil temperature, and the like. The controller 30 stores various kinds of diagnoses data acquired while a constant period of time elapses to a predetermined storage destination (for example, an auxiliary storage device, a communicably connected external storage device, and the like). In this case, the controller 30 stores, in association with the diagnostic data, date and time information (for example, date and time) about date and time at which the diagnostic data is acquired, position information about the position (for example, latitude, longitude, altitude, and the like).

The diagnostic data acquisition control unit 305 may acquire at least the diagnostic data according to the target of the malfunction diagnosis. For example, in a case where the load rate of the engine 11 is adopted as the target of the malfunction diagnosis, the diagnostic data acquisition control unit 305 may acquire at least the fuel injection rate of the engine 11, the rotational speed command value of the engine 11, and the actual rotational speed of the engine 11. Also, the diagnostic data acquisition control unit 305 may determine which diagnostic data is to be acquired on the basis of setting information stored in the controller 30. In this case, the setting information may be changeable by a user (for example, an operator, an engineer, or the like) through predetermined input means.

When the constant period of time elapses, the diagnostic data acquisition control unit 305 ends the acquisition of the diagnostic data, and the controller 30 transitions the control mode from the warm-up mode to the normal mode, and also gives an end notification of the warm-up mode (step S120). For example, the controller 30 notifies the operator that the warm-up mode has ended by displaying an end message of the warm-up mode on the display apparatus 50, or outputting sound indicating an end of the warm-up mode from a speaker.

Also, via wireless communication with the management apparatus 300 through the transmission apparatus S1, the controller 30 (the diagnostic data transmission unit 306) transmits various kinds of diagnoses data acquired, the position information, and the date and time information to the management apparatus 300 at a predetermined point in time (step S122). Then, when the processing of step S122 is completed, the controller 30 ends the series of processing as illustrated in FIG. 5.

Through the reception apparatus 330, the management apparatus 300 receives various kinds of diagnoses data transmitted from the shovel 100. Therefore, as described above, the control apparatus 310 (the diagnostic unit 3101) can perform the malfunction diagnosis of the shovel 100 on the basis of various kinds of diagnoses data. For example, the diagnostic unit 3101 performs the malfunction diagnosis of the shovel 100 by using a conventional statistical method (for example, a predetermined algorithm such as Bayesian estimation method, Mahalanobis method, vector analysis, and the like). Further, as described above, the diagnostic unit 3101 may transmit data of the diagnostic result to the shovel 100, or another management apparatus (for example, a portable terminal such as a user's smartphone and the like) through the transmission apparatus 320.

In this manner, while the above-described warm-up mode notification message is displayed on the display apparatus 50, i.e., during the warm-up mode, the diagnostic data acquisition control unit 305 may acquire the diagnostic data by applying a constant load to the engine 11 and the hydraulic system of the shovel 100. Therefore, while the operator waits for the warm-up mode to end without performing an operation, the diagnostic data acquisition control unit 305 can acquire the diagnostic data in the background (i.e., without causing the operator to feel uncomfortable).

In particular, the diagnostic data collection period is extremely shorter than the warm-up driving execution period (for example, 1/10 or less), and therefore, the diagnostic data acquisition control unit 305 does not let the operator clearly notice that the acquisition of the diagnostic data is also performed during the warm-up mode. Further, the diagnostic data acquisition control unit 305 acquires the diagnostic data when the warm-up driving of the shovel 100 has ended, and therefore, the driving condition of the shovel 100 (the engine 11 and the hydraulic system) during the acquisition of the diagnostic data can be made constant.

In at least one of the warm-up driving execution period and the diagnostic data collection period, the controller 30 continues to monitor, with the surroundings monitor apparatus (for example, the camera S6), whether there is a monitor object entering the monitor area in the surroundings of the shovel 100.

Even if the surroundings monitor apparatus detects an entry of a monitor object into the monitor area in the surroundings of the shovel 100, the gate lock valve 25V is maintained in the locked state in the warm-up driving execution period and the diagnostic data collection period. Therefore, even if the operator operates the operating apparatus 26, the hydraulic actuators of the shovel 100 are unmovable. Also, in a case where the operating apparatus 26 is of an electric type that outputs an electric signal corresponding to an operation content or in a case where the shovel 100 is remotely operated, a control command from the controller 30 to an operation hydraulic control valve that applies a pilot pressure to the control valve 17 is invalidated. Therefore, in this case, the movement of the hydraulic actuators is invalidated. Accordingly, even when the monitor object enters the monitor area in the surroundings of the shovel 100 in the warm-up driving execution period and the diagnostic data collection period, the shovel 100 can be prevented from moving.

Also, in a case where the monitor object (for example, a person) is detected while the display apparatus 50 displays the content of FIG. 6 in the warm-up mode (the diagnostic mode), the display apparatus 50 may display a notification indicating that the monitor object is detected together with the notification component 620. Also, in a case where the monitor object (for example, a person) is detected while the display apparatus 50 displays the content of FIG. 6 in the warm-up mode (the diagnostic mode), the display apparatus 50 may display a notification indicating that the monitor object is detected, instead of displaying the notification component 620. In this case, in substantially the same manner as the notification component 620, the notification indicating that the monitor object is detected may be displayed in an overlapping manner on the surroundings image 600 and the indication components 601 to 613. Hereinafter, the above may also be applicable to the case where the monitor object (for example, a person) is detected while the display apparatus 50 displays the content of FIG. 12 and FIG. 15 explained later.

Further, as described above, in a case where the monitor object continues to be detected in the monitor area in the surroundings of the shovel 100 after the warm-up driving execution period and the diagnostic data collection period end, the movement of the hydraulic actuators of the shovel 100 may be limited. This is because when the warm-up driving execution period and the diagnostic data collection period end and the control mode transitions from the warm-up mode to the normal mode, the hydraulic actuators of the shovel 100 are rendered operable. Accordingly, the attachment and the like of the shovel 100 is inhibited from coming in proximity to the monitor object (for example, a person) when the driven unit of the attachment and the like of the shovel 100 moves rapidly after the warm-up driving execution period and the diagnostic data collection period end.

Specific Example of Diagnostic Data

Figure 7:
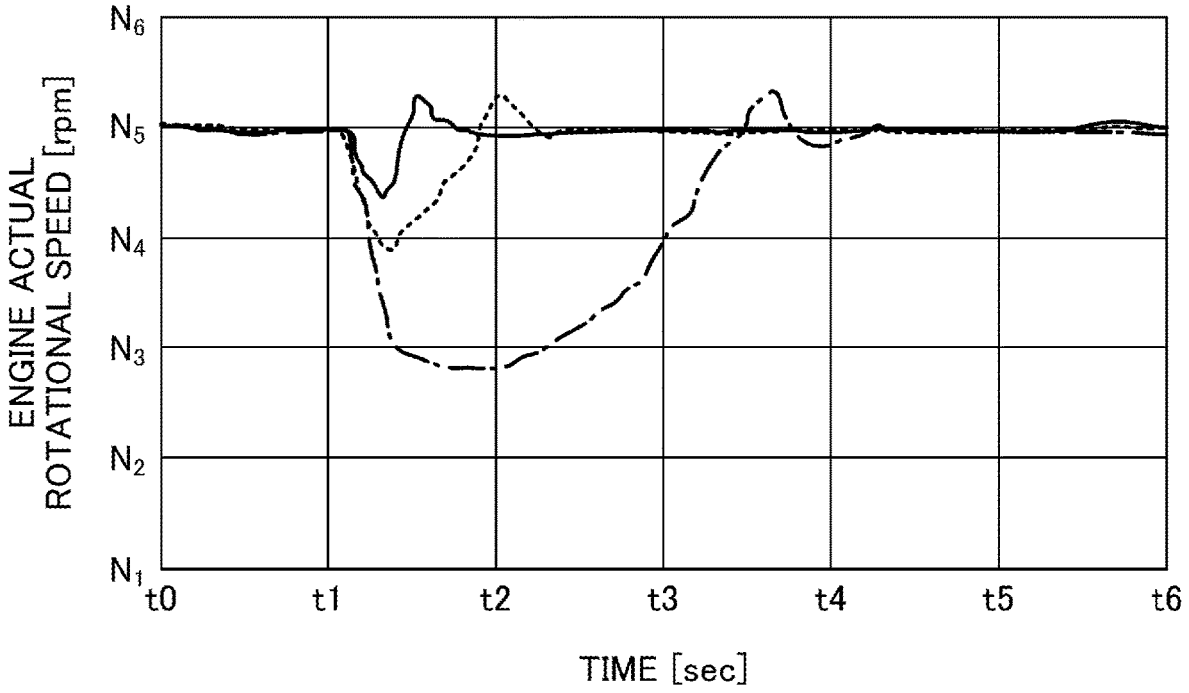
FIG. 7 is a diagram illustrating an example of diagnostic data that is acquired by the shovel.

FIG. 7 is a diagram illustrating an example of diagnostic data acquired in the shovel 100. FIG. 7 illustrates an actual engine rotational speed acquired as the diagnostic data by the diagnostic data acquisition control unit 305.

In FIG. 7, a solid line, a broken line, and a long dashed short dashed line represent actual engine rotational speeds during an abnormal state of the swash plate of the main pump 14, a normal state, and an abnormal state of the injector, respectively. Any of the time-series data of these actual engine rotational speeds corresponds to the diagnostic data acquired by the diagnostic data acquisition control unit 305 while a constant load is applied to the hydraulic system of the shovel 100 (i.e., while the main pump pressure attains the relief pressure) during the above diagnostic data collection period in the warm-up mode.

In the example as illustrated in FIG. 7, with the target engine rotational speed being set to a predetermined value $N_5$ [rpm] (see step S112 of FIG. 6), the acquisition of the diagnostic data starts at a point in time t0 (see step S114 of FIG. 6). Then, at a point in time t1 after a predetermined time elapses since the point in time t0, the cut-off valves 44L, 44R are closed, so that a constant hydraulic load is applied to the hydraulic system of the shovel 100 (see step S116 of FIG. 6). Therefore, at the point in time t1, the actual engine rotational speed decreases in any of the normal state, the abnormal state of the swash plate of the main pump 14, and the abnormal state of the injector.

Then, as illustrated in FIG. 7, in the abnormal state of the swash plate of the main pump 14 and the abnormal state of the injector, the required time and the waveform until the actual engine rotational speed is stabilized again at the target engine rotational speed are different from the normal state.

Specifically, in the abnormal state of the swash plate of the main pump 14, the discharge quantity of the main pump 14 is excessively decreased in response to an increase in the discharge pressure of the main pump 14, and therefore, the amount of decrease in the rotational speed of the engine is less than that in the normal state. Conversely, in the abnormal state of the injector, the fuel injection quantity with respect to the target engine rotational speed becomes insufficient, and accordingly, the amount of decrease in the rotational speed of the engine is greater than that in the normal state. Therefore, for example, the diagnostic unit 3101 of the management apparatus 300 can perform the malfunction diagnosis of the shovel 100 on the basis of such a difference in the diagnostic data by using a conventional statistical method (for example, a predetermined algorithm such as Bayesian estimation method, Mahalanobis method, vector analysis, and the like). In this case, as described above, on every acquisition, various kinds of diagnoses data is acquired in the same (constant) driving condition. Therefore, the diagnostic unit 3101 can perform the malfunction diagnosis of the shovel 100 relatively accurately.

The target of the malfunction diagnosis by the diagnostic unit 3101 is not limited to the main pump 14 and the injector of the engine 11, and may be an exhaust gas recirculation (EGR), a turbo charger, and the like.

Modified Embodiment of Procedure of Diagnostic Data Acquisition Processing

Figure 8:
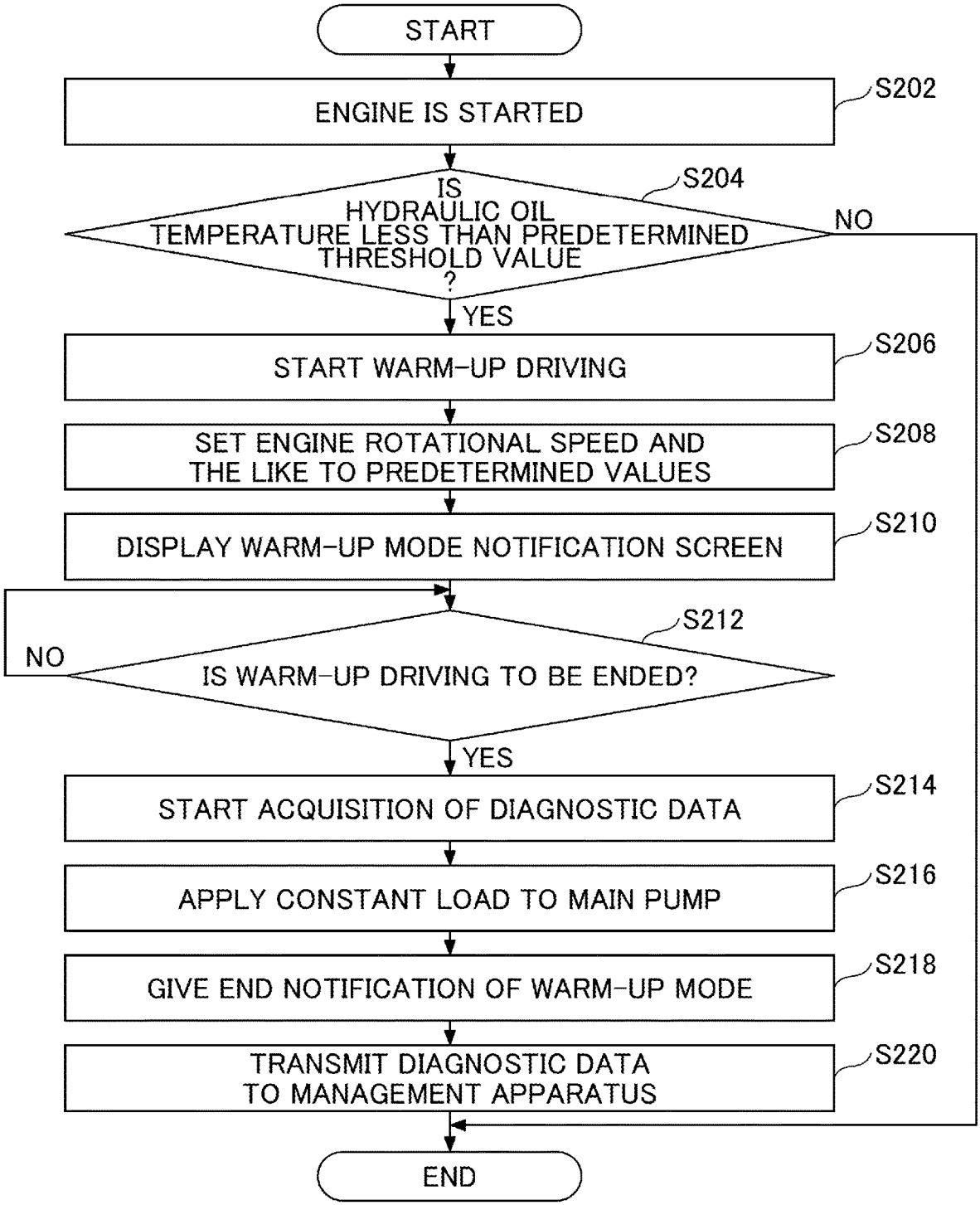
FIG. 8 is a flowchart schematically illustrating a modified embodiment of control processing performed by the controller to acquire diagnostic data.
Figure 9:
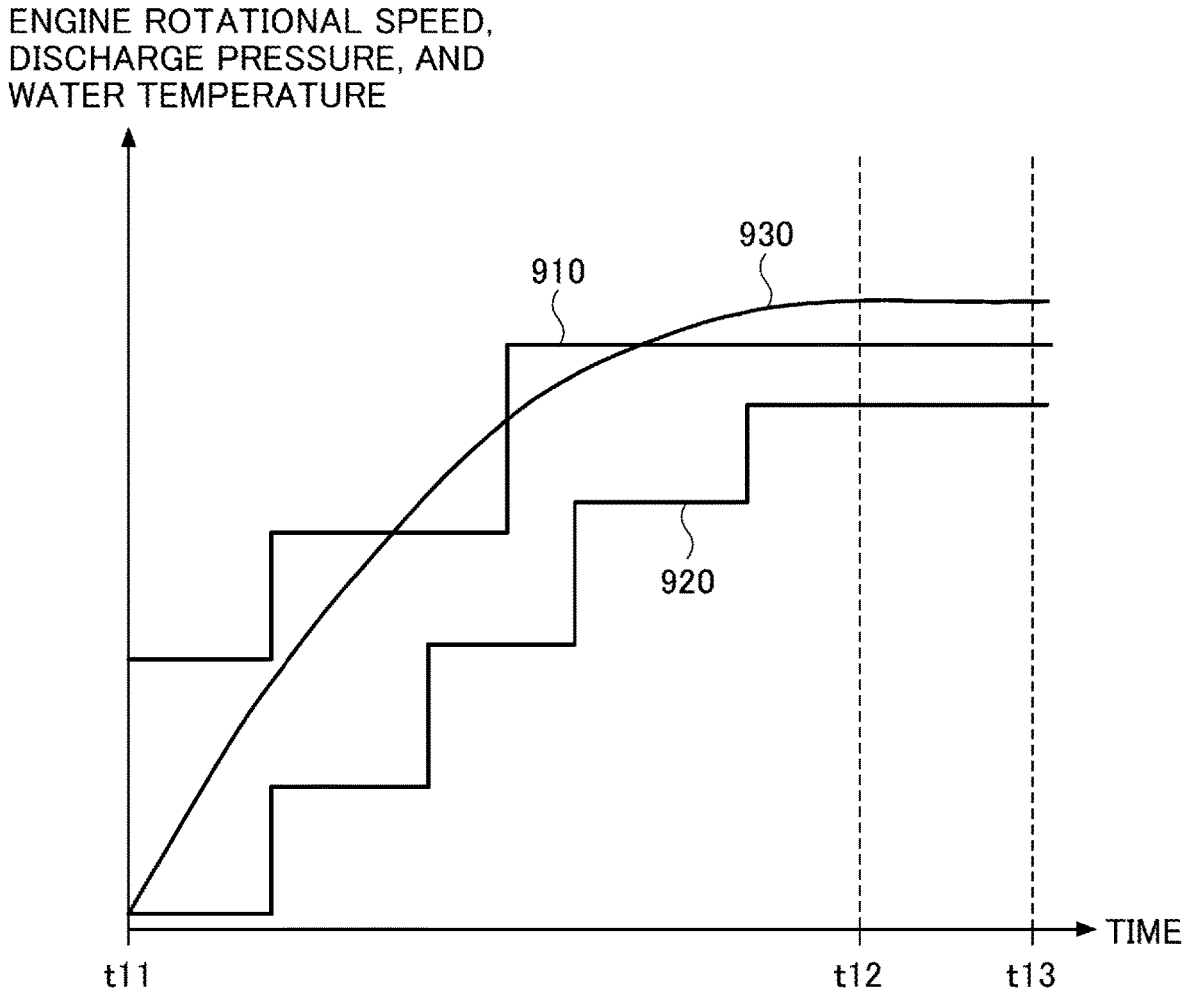
FIG. 9 is a time chart illustrating an example of temporal change of an engine rotational speed, a discharge pressure of a main pump, and a water temperature of the engine when control processing for acquiring diagnostic data is executed.

FIG. 8 is a flowchart schematically illustrating a modified embodiment of diagnostic data acquisition processing performed by the controller 30. For example, this flowchart is executed in a case where the key switch of the shovel 100 is turned ON with the gate lock being in the locked state (i.e., the gate lock switch that is synchronized with the gate lock being in the ON state). FIG. 9 includes time charts 910 to 930 which indicate an engine rotational speed (a target rotational speed) during execution of the diagnostic data acquisition processing, a discharge pressure (a setting value) of the main pump 14, and a temporal change of the water temperature of the engine 11, respectively.

The oil temperature of the hydraulic oil of the hydraulic driving system (the hydraulic system) during the execution of the diagnostic data acquisition processing exhibits substantially the same temporal change as the water temperature of the engine 11, and is therefore omitted in FIG. 9.

As illustrated in FIG. 8, in step S202, the controller 30 starts the engine 11 by controlling, via the ECU 74, various kinds of actuators of the engine 11 (for example, the injector and the like) while activating the starter 11*b*, and proceeds to step S204. At this moment, as described above, as a prerequisite condition, the gate lock is in the locked state, so that the gate lock valve 25V interposed in the pilot line 25 between the pilot pump 15 and the operating apparatus 26 shuts off the communication through the pilot line 25, and the operation of (the hydraulic actuators of) the shovel 100 using the operating apparatus 26 is invalidated. Accordingly, when the engine 11 of the shovel 100 is started, the shovel 100 can be prevented from moving when the operating apparatus 26 is erroneously operated.

As described above, the shovel 100 may be remotely operated. In this case, instead of or in addition to operations using the operating apparatus 26, the controller 30 may invalidate remote operations.

In step S204, the automatic warm-up control unit 301 determines whether the oil temperature of the hydraulic oil of the hydraulic system is less than the predetermined threshold value. In a case where the oil temperature of the hydraulic oil is less than the predetermined threshold value, the automatic warm-up control unit 301 proceeds to step S206, and in the other case, the current processing is ended.

In step S206, the automatic warm-up control unit 301 starts the warm-up driving of the shovel 100 (i.e., transitions the operation mode of the shovel 100 to the warm-up mode corresponding to the automatic warm-up function), and proceeds to step S208.

In step S208, the automatic warm-up control unit 301 performs the automatic warm-up driving of the shovel 100 by setting the target rotational speed of the engine 11 and the hydraulic load (the discharge pressure) of the main pump 14 to predetermined values. In this case, the predetermined value may be varied according to an elapse of time (see FIG. 9).

For example, as illustrated in FIG. 9, at a time t11, when the engine 11 is started, the target rotational speed of the engine 11 is raised stepwise according to an elapse of time, and accordingly, the engine rotational speed increases stepwise (see the time chart 910). Accordingly, after the time t11, the water temperature of the engine 11 increases toward the right side of the graph (see the time chart 930).

Also, likewise, at the time t11, when the engine 11 is started, the setting value of the discharge pressure of the main pump 14 is raised stepwise according to an elapse of time, and accordingly, the actual value thereof also increases stepwise. Accordingly, after the time t11, similarly with the water temperature of the engine 11, the oil temperature of the hydraulic oil of the hydraulic driving system increases toward the right side of the graph. In this manner, the shovel 100 can raise the water temperature of the engine 11 and the oil temperature of the hydraulic oil in accordance with an increase in the engine rotational speed and an increase in the hydraulic load.

Back to FIG. 8, in step S210, the automatic warm-up control unit 301 causes the display apparatus 50 to display a notification that the operation mode has transitioned to the warm-up mode, and proceeds to step S212.

For example, the display apparatus 50 displays the display content of FIG. 6.

In step S212, the automatic warm-up control unit 301 determines whether the warm-up driving of the shovel 100 is to be ended. For example, the automatic warm-up control unit 301 may determine that, in a case where the water temperature of the engine 11 and the oil temperature of the hydraulic oil of the hydraulic driving system are equal to or more than the respective predetermined threshold values, the warm-up driving is to be ended. In a case where the warm-up driving of the shovel 100 is to be ended, the automatic warm-up control unit 301 proceeds to step S214, and in the other case, the automatic warm-up control unit 301 waits until a point in time at which the warm-up driving of the shovel 100 is to be ended (i.e., repeats the processing of this step).

In step S214, the controller 30 (the diagnostic data acquisition control unit 305) starts processing for acquiring (collecting) data (diagnostic data) for performing various kinds of diagnoses of the shovel 100, and proceeds to step S216. In this case, the controller 30 continues the locked state of the gate lock (i.e., the ON state of the gate lock switch) from the engine start. Accordingly, the operation of (the hydraulic actuators of) the shovel 100 is invalidated. Therefore, a reduction in the reliability of the collected diagnostic data caused by operations of the hydraulic actuators of the shovel 100 can be alleviated.

The diagnostic data is constituted by time-series data at predetermined time intervals in a predetermined period of time. The collection target diagnostic data may be specified in advance according to the diagnosis target device, the content of diagnosis, and the like. For example, in a case where the diagnosis target device is the engine 11, the diagnostic data may include: a fuel injection rate of the engine 11, a command value of the engine rotational speed, a measurement value of the engine rotational speed, a boost pressure of the turbo charger of the engine 11, a pressure (a common rail pressure) of the fuel injection apparatus (the common rail) of the engine 11, a pressure of oil (an oil pressure) of the engine 11, a temperature of the exhaust gas, a measurement value of NOx in the exhaust gas, command values of the tilt angle of the swashplate of the main pumps 14L, 14R, a measurement value of the discharge pressure of the main pump 14, a measurement value of the oil temperature of the hydraulic oil of the hydraulic driving system (the hydraulic system), and the like. The controller 30 stores the diagnostic data acquired (collected) from various kinds of sensors during the predetermined period of time into an internal memory (for example, an auxiliary storage device) or a communicably connected external storage device. Together with this, the controller 30 also stores information (for example, date and time) about the date and time at which the diagnostic data is acquired (hereinafter referred to as "acquisition date and time information"), information about position (for example, latitude, longitude, altitude, and the like) (hereinafter referred to as "acquisition position information").

In step S216, after the predetermined period of time elapses since the start of acquisition of the diagnostic data, the controller 30 (the diagnostic data acquisition control unit 305) controls the regulator 13 to apply (set) a constant load to the main pump 14. In this case, the controller 30 may close the cut-off valves 44L, 44R so that a pipeline (a PT line) between the main pump 14 and the hydraulic oil tank attains a constant pressure, and may shut off the communication through the center bypass pipelines 40L, 40R. Accordingly, with the effect of the above-described relief valve, the pressure of the PT line is maintained constant. Then, when the predetermined period of time elapses since the start of acquisition of the diagnostic data, the controller 30 (the diagnostic data acquisition control unit 305) ends the acquisition of the diagnostic data, and proceeds to step S218.

For example, as illustrated in FIG. 9, when it is determined that the warm-up driving of the shovel 100 is to be ended at a time t12, the engine rotational speed (the target rotational speed of the engine 11) and the discharge pressure of the main pump 14 (the setting value) at the end of the warm-up driving are maintained. Then, in that state, the diagnostic data is acquired (collected) from the time t12 to the time t13. Accordingly, the controller 30 can perform both of the warm-up driving of the shovel 100 and the collection of the diagnostic data by providing the collection period for performing the collection of the diagnostic data at the end of the warm-up driving of the shovel 100. Specifically, the collection period of the diagnostic data is set in the warm-up mode. In this manner, the controller 30 maintains the state of the warm-up driving of the shovel 100 even in the collection period of the diagnostic data, and therefore, this prevents the operator from feeling uncomfortable even if the diagnostic data is collected at the end of the warm-up driving of the shovel 100.

Back to FIG. 8, in step S218, the automatic warm-up control unit 301 gives a notification indicating the end of the warm-up mode (the warm-up driving) to the operator, transitions to the normal mode, and proceeds to step S220. For example, the automatic warm-up control unit 301 causes a speech indicating the end of the warm-up mode to be output from the speaker in the cab 10, or causes character information indicating the end of the warm-up mode to be displayed on the display apparatus 50. Accordingly, the controller 30 notifies the end of the warm-up driving of the shovel 100 after the collection of the diagnostic data is completed, and therefore, the diagnostic data can be collected together with the warm-up driving of the shovel 100, without causing the operator to feel uncomfortable.

In step S220, the controller 30 (the diagnostic data transmission unit 306) transmits the acquired (collected) diagnostic data to the management apparatus 300 through the transmission apparatus S1, and the current processing is ended. In this case, for example, the controller 30 may transmit not only the diagnostic data but also the above-described acquisition date and time information, the acquisition position information, and the like corresponding to the diagnostic data to the management apparatus 300. Accordingly, the management apparatus 300 (the control apparatus 310) can perform various kinds of diagnoses of the shovel 100 on the basis of the diagnostic data received from the shovel 100. In this case, as described above, the management apparatus 300 may perform the diagnosis of the shovel 100 by using a conventional statistical method (for example, a predetermined algorithm such as Bayesian estimation method, Mahalanobis method, vector analysis, and the like).

Instead of transmitting the diagnostic data to the management apparatus 300 on every acquisition of the diagnostic data, the diagnostic data may be transmitted in another point in time. For example, the diagnostic data may be transmitted to the management apparatus 300 in a case where the shovel 100 is stopped (i.e., the key switch is turned OFF) or when the shovel 100 starts next time (i.e., the key switch is turned ON). Also, for example, when diagnostic data for several times of diagnoses have been accumulated, the accumulated diagnostic data may be transmitted to the management apparatus 300 at a time.

The controller 30 continues to monitor, with the surroundings monitor apparatus (for example, the camera S6), whether there is a monitor object entering the monitor area in the surroundings of the shovel 100 in the collection period of the diagnostic data. Also, the controller 30 may monitor, with surroundings monitor apparatus, whether there is a monitor object entering the monitor area in the surroundings of the shovel 100 in the warm-up driving (i.e., the warm-up mode).

Even if an entry of the monitor object into the monitor area in the surroundings of the shovel 100 is detected with the surroundings monitor apparatus, the gate lock valve is maintained in the locked state in the collection period of the diagnostic data. Therefore, even if the operator operates the operating apparatus 26, the actuators of the shovel 100 are immovable. Also, in a case where the operating apparatus 26 is of an electric type that outputs an electric signal corresponding to an operation content, or the shovel 100 is remotely operated, a control command from the controller 30 to the operation hydraulic control valve that applies the pilot pressure to the control valve 17 is invalidated. Therefore, in this case, the actuators are also rendered immovable. Therefore, even if the monitor object enters the monitor area in the surroundings of the shovel 100 during the warm-up driving, in particular, during the collection period of the diagnostic data, the shovel 100 is prevented from moving.

Also, in a case where the monitor object (for example, a person) is detected in the warm-up mode (the diagnostic mode) while the display apparatus 50 is displaying the content of FIG. 6, not only the notification component 620 but also a notification indicating that the monitor object is detected may be displayed on the display apparatus 50. Also, in a case where the monitor object (for example, a person) is detected in the warm-up mode (the diagnostic mode) while the display apparatus 50 is displaying the content of FIG. 6, a notification indicating that the monitor object is detected may be displayed on the display apparatus 50, instead of displaying the notification component 620. In this case, similarly with the notification component 620, a notification indicating that the monitor object is detected may be displayed in an overlapping manner on the surroundings image 600 and the indication components 601 to 613.

Furthermore, as described above, in a case where the monitor object continues to be detected in the monitor area in the surroundings of the shovel 100 after the collection period of the diagnostic data ends, the movement of the hydraulic actuators of the shovel 100 may be limited. This is because, when the collection period of the diagnostic data ends, and the control mode transitions from the warm-up mode to the normal mode, the hydraulic actuators of the shovel 100 become operable, as described above. Accordingly, the attachment and the like of the shovel 100 is inhibited from coming in proximity to the monitor object (for example, a person) when the driven unit of the attachment and the like of the shovel 100 moves rapidly after the collection period of the diagnostic data ends.

In this manner, in this example, in a case where the warm-up driving of the shovel 100 is performed, the controller 30 collects the diagnostic data for performing the diagnosis of the shovel 100. Specifically, the controller 30 collects the diagnostic data in the background processing (i.e., without causing the operator to feel uncomfortable even if the diagnostic data is collected) according to the warm-up driving of the shovel 100. Accordingly, without relying on operator's operations, highly reliable diagnostic data can be automatically acquired with a relatively small variation in the output of the shovel 100. Specifically, the controller 30 can more easily acquire the diagnostic data of the shovel 100.

<Effects>

In this manner, in this example, the shovel 100 (the controller 30) collects (acquires) the diagnostic data of the shovel 100 when the engine 11 and the hydraulic system are driven under a constant driving condition. Specifically, the constant driving condition may include a condition indicating that variation in the load applied to the engine 11 and the hydraulic system is relatively small (for example, a constant load is applied to the engine 11 and the hydraulic system). Also, the constant driving condition may include a condition indicating that the engine 11 and the hydraulic system are in a predetermined state (for example, the water temperature of the engine 11 and the oil temperature of the hydraulic oil are in a predetermined temperature state).

Accordingly, on every acquisition, the shovel 100 can acquire the diagnostic data under a constant driving condition. Therefore, for example, pieces of diagnostic data can be compared with each other easily, and various kinds of diagnoses can be performed with a higher degree of accuracy. Therefore, the shovel 100 can collect highly reliable diagnostic data.

Also, in this example, the shovel 100 includes an engine 11 and a main pump 14 (a hydraulic pump) driven by the engine 11, and may acquire diagnostic data by applying a constant load. This may also be applicable to the second example to the fifth example explained later.

For example, the above-described Patent Document 1 discloses a technique in which a shovel transmits, to a management apparatus, detection values acquired by various kinds of sensors during execution of a specified movement that is specified by an operator, and professional staff analyze detection values received by the management apparatus to determine the state of the shovel (malfunction and disorder).

However, in the Patent Document 1, the shovel is less likely to be in a constant load condition during the specified movement such as movement of the attachment, turning movement, and the like. Therefore, in order to perform output diagnosis and malfunction diagnosis of the shovel, a service engineer and the like may have to actually go to the site and perform lever operations to raise the main pump pressure to the relief pressure, and acquire diagnostic data such as an actual engine rotational speed and the like.

In contrast, in this example, the shovel 100 can easily acquire diagnostic data of the shovel 100 under a constant load condition.

Also, in this example, the shovel 100 may transmit acquired data to the management apparatus 300. This may also be applicable to the first example to the fourth example explained later.

Accordingly, the shovel 100 can cause the management apparatus 300 to perform malfunction diagnosis on the diagnostic data of the shovel 100 under the constant load condition.

Also, in this example, the shovel 100 may acquire data by applying a constant load that is generated irrespective of operator's operations (i.e., the constant load is not a load that is generated according to operator's operations). This may also be applicable to the second example to the fifth example explained later.

Accordingly, the shovel 100 can more easily acquire the diagnostic data of the shovel 100 under the constant load condition.

Also, in this example, the shovel 100 may acquire data by applying a hydraulic load as a constant load. This may also be applicable to the second example to the fifth example explained later.

Accordingly, the shovel 100 can easily acquire the diagnostic data of the shovel 100 under the constant hydraulic load.

Also, in this example, the shovel 100 may generate a hydraulic load with the cut-off valves 44L, 44R. This may also be applicable to the second example to the fifth example explained later.

Accordingly, the shovel 100 can more reliably reproduce a constant hydraulic load.

Also, in this example, the shovel 100 raises the pressure of the main pump 14 to a relief pressure (a constant load) after diagnostic data starts to be collected.

Accordingly, the shovel 100 can acquire the diagnostic data over a period ranging from a state before the constant hydraulic load is applied to the hydraulic system, through a transitional state in which the constant hydraulic load is applied, to a state after the constant hydraulic load is applied. Therefore, various kinds of diagnoses can be performed with a higher degree of accuracy on the basis of time-series change of data over the period ranging before and after the constant hydraulic load is applied.

In this example, a hydraulic load is generated by reducing the openings of the cut-off valves 44L, 44R. Alternatively, the hydraulic load may be generated by shutting off the communications through the control valves 171 to 174, 175L, 175R, 176L, and 176R. Still alternatively, the hydraulic load may be generated by increasing the discharge flow rate of the main pump 14. This may also be applicable to the first example to the fourth example explained later. In this manner, the controller 30 can collect stable diagnostic data by generating the constant hydraulic load in the non-operation state.

Also, in this example, the shovel 100 (the controller 30) may collect the diagnostic data of the shovel 100 when a predetermined condition (hereinafter referred to as a "data collection condition") corresponding to the case where variation in the output of the engine 11 is relatively small (i.e., the output of the engine 11 is stable) is satisfied. Specifically, in this example, the shovel 100 may collect the diagnostic data when a predetermined event of the shovel 100 occurs that relatively reduces variation in the output of the engine 11.

For example, the above-described Patent Document 1 discloses a technique in which a shovel is caused to perform a specified movement according to operator's operations, and detection data of various sensors of the shovel at the time of the specified movement is acquired as diagnostic data related to the shovel.

However, in the technique of the above-described Patent Document 1, it is necessary for the operator to perform the lever operations to cause the shovel to perform the specified movement such as a movement of an attachment and a turning movement. Therefore, the opportunities of collection of diagnostic data may be limited.

In contrast, in this example, in response to a satisfaction of a data collection condition (i.e., an occurrence of a predetermined event) as a trigger, the shovel 100 can collect the diagnostic data of the shovel 100 without relying on operator's operations. Therefore, the shovel 100 can more easily collect the diagnostic data of the shovel 100. Also, the shovel 100 can easily bring the driving state of the engine 11 and the hydraulic system to a constant driving condition. Accordingly, the shovel 100 can collect highly reliable diagnostic data.

Also, in this example, the data collection condition may be that "the warm-up driving of the shovel 100 is performed". Specifically, the predetermined event may be "the warm-up driving of the shovel 100".

Accordingly, the shovel 100 can collect the diagnostic data by specifically selecting a situation in which variation in the output of the engine 11 is relatively small. Therefore, the shovel 100 can collect highly reliable diagnostic data.

Also, in this example, the shovel 100 (the controller 30) may collect the diagnostic data when a predetermined movement (i.e., a predetermined event) of the shovel 100 corresponding to the data collection condition (the warm-up driving of the shovel 100 in this example) is completed.

Accordingly, specifically, the shovel 100 can achieve both of: the predetermined movement (the predetermined event) corresponding to the data collection condition, i.e., the originally intended movement (event) of the shovel 100; and the collection of the diagnostic data.

Also, in this example, when the predetermined movement (the predetermined event) of the shovel 100 corresponding to the data collection condition is completed, the shovel 100 (the controller 30) may collect the diagnostic data by continuing the state of the engine 11 and the hydraulic system corresponding to the constant driving condition of the predetermined movement (the predetermined event) (in this example, the load state of the engine 11, the state of the water temperature of the engine 11, the state of the oil temperature of the hydraulic oil, and the like in the warm-up driving of the shovel 100) for a predetermined period of time.

Accordingly, when the predetermined movement (predetermined event) of the shovel 100 ends, the shovel 100 can prevent the operator from feeling uncomfortable even if the diagnostic data is collected.

Also, in this example, after the collection of the diagnostic data is completed, the shovel 100 (the controller 30) may notify the operator of the end of the predetermined movement (the predetermined event) of the shovel 100 corresponding to the data collection condition (in this example, the warm-up driving of the shovel 100).

Accordingly, in accordance with the predetermined movement of the shovel 100, the shovel 100 can prevent the operator from feeling uncomfortable even if the diagnostic data is collected.

Also, in this example, during the movement related to the diagnosis of the shovel 100 (for example, collection of data for monitor, diagnostic processing based on data for monitor, and the like), the shovel 100 may continue to monitor, with the surroundings monitor apparatus (for example, the camera S6), whether there is a monitor object that enters (the monitor area) in the surroundings of the shovel 100. This may also be applicable to the second example to the fifth example explained later.

Accordingly, the safety of the shovel 100 during the movement related to the diagnosis of the shovel 100 can be improved.

Second Example of Diagnostic Data Acquisition Processing

Next, a second example of the diagnostic data acquisition processing performed by the controller 30 is explained with reference to FIG. 10 to FIG. 12.

<Overview>

For example, the diagnostic data acquisition control unit 305 may acquire diagnostic data of the shovel 100 by applying a constant load to the engine 11 and the hydraulic system when manual regeneration of the exhaust gas processing apparatus (the PM regeneration apparatus) is performed on the shovel 100.

For example, the controller 30 (the manual regeneration control unit 303) switches the control mode of the shovel 100 to the manual regeneration mode when the manual regeneration of the PM regeneration apparatus starts in the shovel 100. The implementation period of the manual regeneration mode includes a manual regeneration execution period and a diagnostic data collection period. The manual regeneration execution period is a period in which the manual regeneration of the PM regeneration apparatus is performed. The diagnostic data collection period is a period in which, after the manual regeneration of the PM regeneration apparatus is completed, diagnostic data is collected by applying a constant load to the engine 11 and the hydraulic system. Specifically, in this example, the manual regeneration mode includes a diagnostic mode, and the diagnostic data collection period corresponds to the diagnostic mode. In the manual regeneration mode, the controller 30 (the manual regeneration control unit 303) causes the display apparatus 50 to display a notification screen (for example, see FIG. 12) for notifying the operator of the shovel 100 that the shovel 100 is in the manual regeneration mode.

In this manner, the diagnostic data acquisition control unit 305 acquires the diagnostic data by applying a constant load to the engine 11 and the hydraulic system while the above-described notification screen is displayed on the display apparatus 50, i.e., during the manual regeneration mode. Therefore, the diagnostic data acquisition control unit 305 can acquire the diagnostic data with the constant load being applied to the engine 11 and the hydraulic system, in the background, while the operator is waiting for the manual regeneration mode to end without performing any operation.

In particular, the diagnostic data collection period is greatly shorter than the manual regeneration execution period (for example, 1/10 or less), and therefore, the diagnostic data acquisition control unit 305 does not let the operator appreciably notice that even the acquisition of the diagnostic data is performed in the manual regeneration mode. Furthermore, the diagnostic data acquisition control unit 305 acquires the diagnostic data while the manual regeneration of the PM regeneration apparatus of the shovel 100 has ended, and therefore, the driving condition of the shovel 100 (the engine 11 and the hydraulic system) during the acquisition of the diagnostic data can be made constant.

<Procedure of Diagnostic Data Acquisition Processing>

Figure 10:
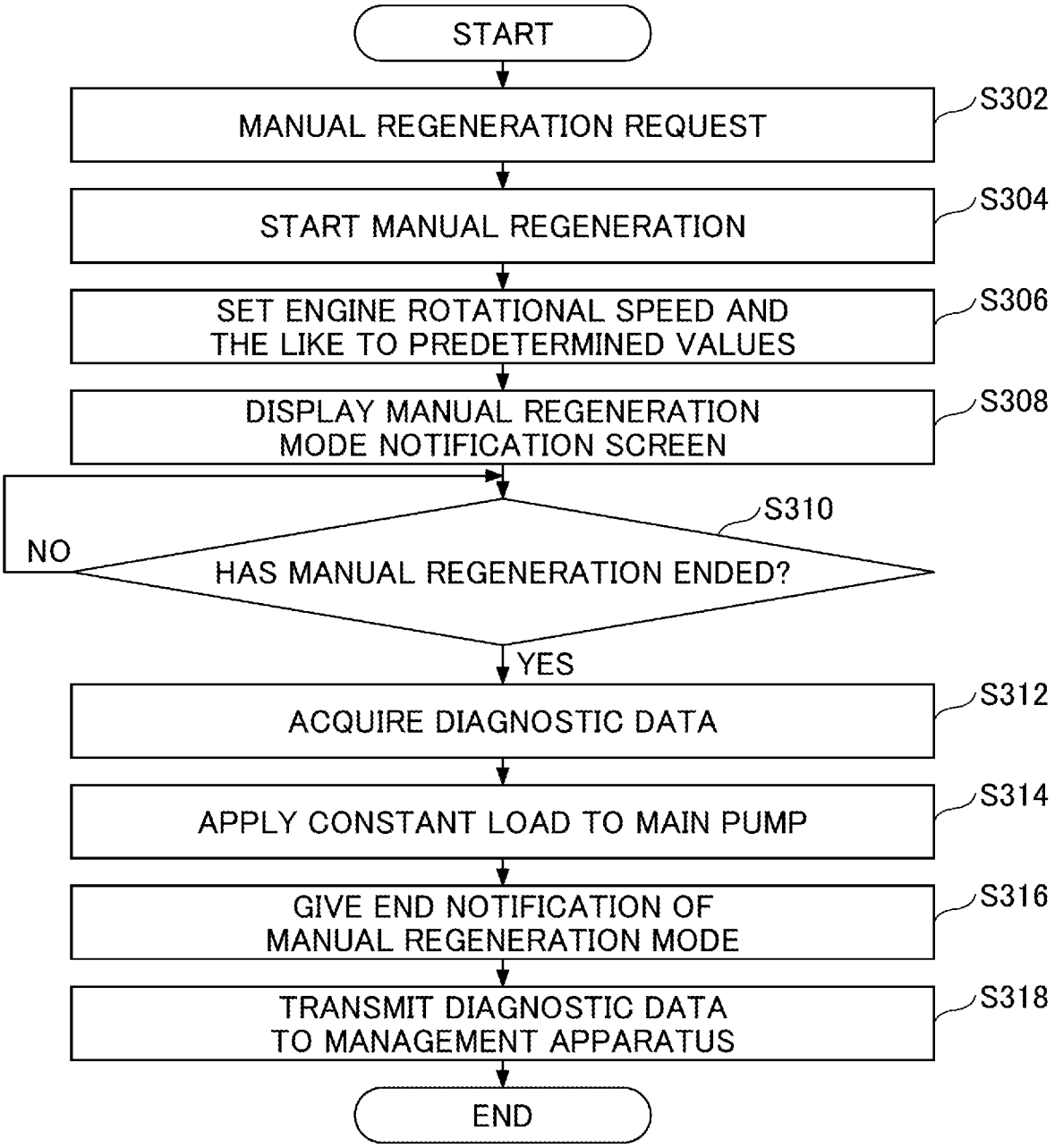
FIG. 10 is a flowchart schematically illustrating a second example of control processing performed by the controller to acquire diagnostic data.

FIG. 10 is a flowchart schematically illustrating a second example of diagnostic data acquisition processing performed by the controller 30. For example, this flowchart is executed in a case where the controller 30 gives the operator a notification that the regeneration of the exhaust gas processing apparatus cannot be completed with only the automatic regeneration function. FIG. 11 includes time charts 1110, 1120 illustrating an example of temporal change of the engine rotational speed and the discharge pressure of the main pump 14 during the execution of the diagnostic data acquisition processing. FIG. 12 is a diagram illustrating an example of display content displayed by the display apparatus 50 during the manual regeneration mode.

As illustrated in FIG. 10, in step S302, the controller 30 acquires a manual regeneration request that is output in response to an operator's operation with the manual regeneration button 54.

In step S304, in response to the acquisition of the manual regeneration request as a trigger, the manual regeneration control unit 303 starts the manual regeneration of the exhaust gas processing apparatus (the PM regeneration apparatus) (i.e., transitions the operation mode of the shovel 100 to the manual regeneration mode corresponding to the manual regeneration function), and proceeds to step S306.

In step S306, the manual regeneration control unit 303 sets the target rotational speed of the engine 11 and the discharge pressure of the main pump 14 to predetermined values, and proceeds to step S308. Accordingly, the controller 30 achieves a relatively high load state of the engine 11, and proceeds with a step of burning soot and PM accumulated in the exhaust gas processing apparatus with a high-temperature exhaust gas.

Figure 11:
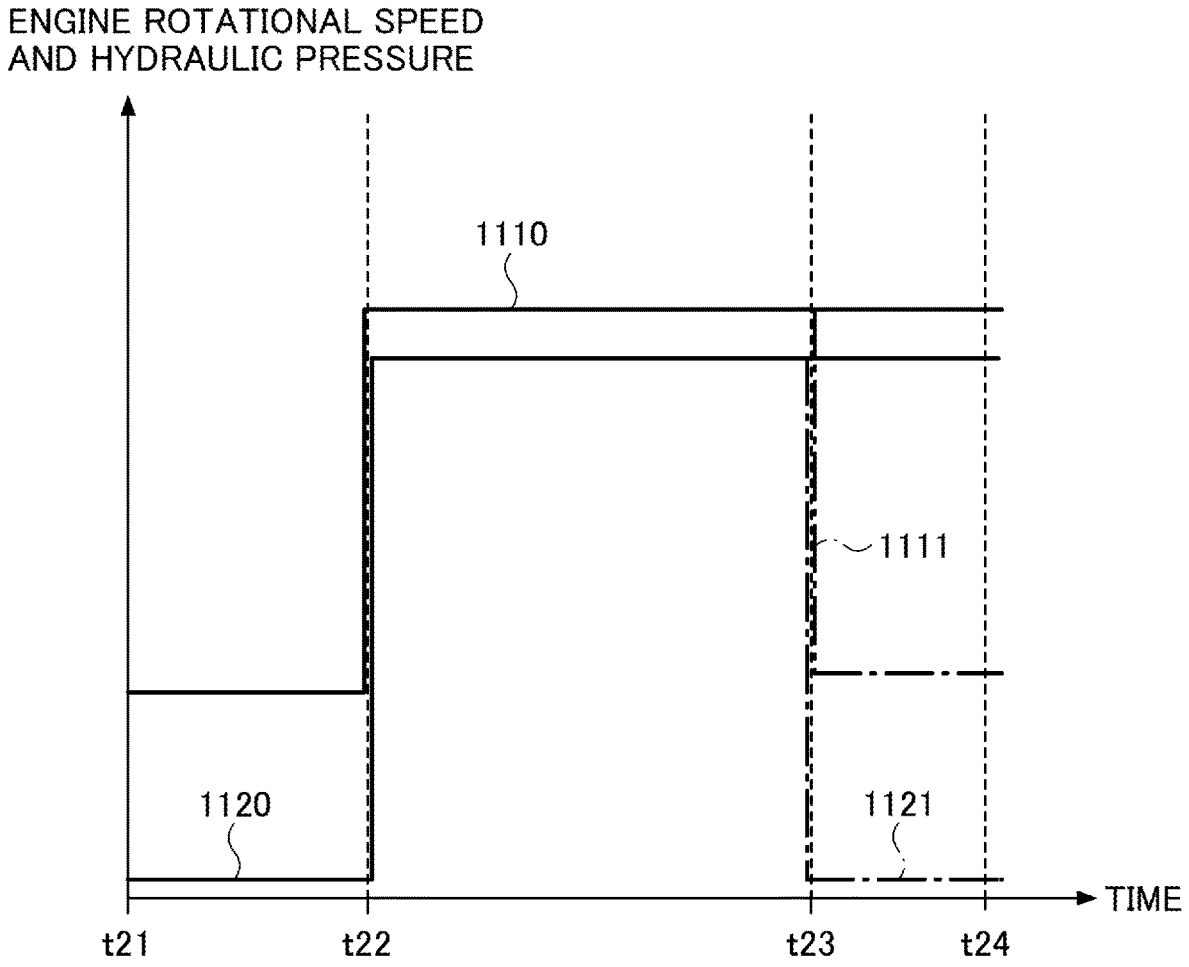
FIG. 11 is a time chart illustrating an example of temporal change of an engine rotational speed and a discharge pressure of the main pump when control processing for acquiring diagnostic data is executed.

For example, as illustrated in FIG. 11, at a time t21, when a manual regeneration request is acquired, the target rotational speed of the engine 11 is raised to a relatively high value, and accordingly, the engine rotational speed increases to a relatively high state (see a time chart 1110). This is also applicable to the main pump 14 (see a time chart 1120). Accordingly, a relatively high load state of the engine 11 is achieved, and soot and PM accumulated in the exhaust gas processing apparatus are burnt with the high-temperature exhaust gas discharged from the engine 11.

Back to FIG. 10, in step S308, the manual regeneration control unit 303 causes the display apparatus 50 to display a notification indicating that the operation mode has transitioned to the manual regeneration mode, and proceeds to step S310.

Figure 12:
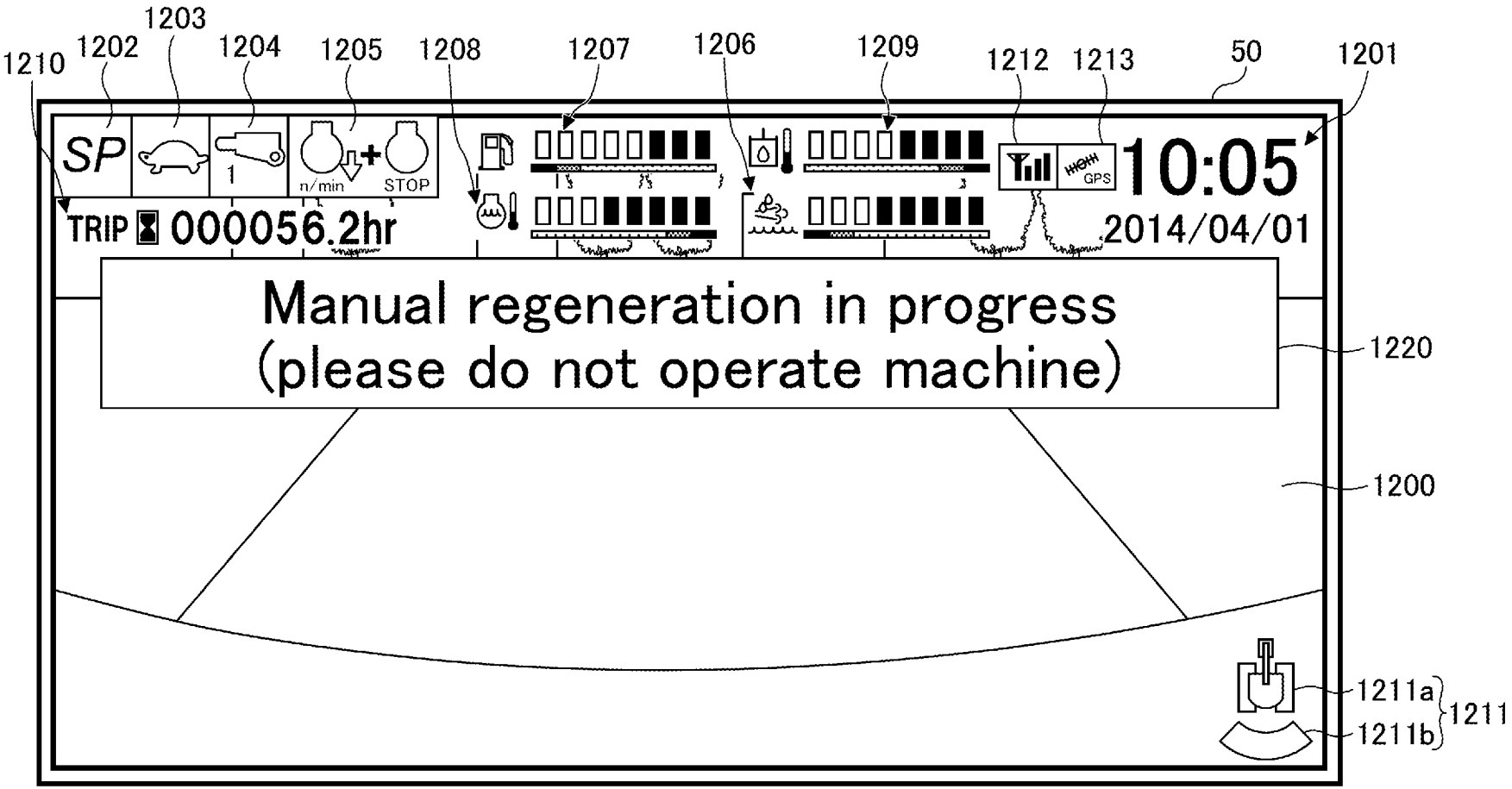
FIG. 12 is a diagram illustrating an example of display content displayed by the display apparatus during a manual regeneration mode.

For example, the display apparatus 50 displays the display content of FIG. 12.

As illustrated in FIG. 12, for example, the display apparatus 50 displays a surroundings image 1200 of the shovel 100 on the basis of the output (the captured image) of the camera S6. Also, the display apparatus 50 displays indication components 1201 to 1213 indicating various kinds of information about the shovel 100 in an overlapping manner on the surroundings image 900.

The surroundings image 1200 and the indication components 1201 to 1208 and 1210 to 1213 are substantially the same as the surroundings image 600A and the indication components 601 to 610, 612, and 613 of FIG. 6, and accordingly, explanation thereabout is omitted.

The indication component 1209 indicates the temperature state of hydraulic oil of the hydraulic system of the shovel 100. In this example, the indication component 1209 has a bar gauge displayed to indicate the temperature state of hydraulic oil. The temperature state of hydraulic oil is displayed on the basis of data that is output from the oil temperature sensor S7.

Also, in addition to a display content displayed at the start of the manual regeneration (the surroundings image 1200 of the shovel 100 based on captured images captured by the camera S6 and the indication components 1201 to 1211 in this example), the display apparatus 50 displays a notification component 1220 displayed in an overlapping manner on the display content. Specifically, the notification component 1220 is displayed in the central portion in the vertical direction of the display area of the display apparatus 50. In this example, in the notification component 1220, a character information, "Manual regeneration in progress (please do not operate machine)", is displayed. Accordingly, when the operator of the shovel 100 operates the manual regeneration button 54, the operator can recognize that the shovel 100 transitions to the manual regeneration mode, and executes the manual regeneration function. Also, the operator can recognize that the operation of the shovel 100 is prohibited during the manual regeneration.

Back to FIG. 10, in step S310, the manual regeneration control unit 303 determines whether the manual regeneration of the exhaust gas processing apparatus has ended. In a case where the manual regeneration of the exhaust gas processing apparatus has ended, the manual regeneration control unit 303 proceeds to step S312, and in a case where the manual regeneration of the exhaust gas processing apparatus has not ended, the manual regeneration control unit 303 is on standby until the manual regeneration of the exhaust gas processing apparatus ends (i.e., repeats the processing of this step).

In step S312, the controller 30 (the diagnostic data acquisition control unit 305) starts processing of acquiring (collecting) the diagnostic data of the shovel 100, and proceeds to step S316.

In step S314, the controller 30 (the diagnostic data acquisition control unit 305) controls the regulator 13 to give (set) a constant load to the main pump 14 after a predetermined period of time elapses since the start of acquisition of the diagnostic data. In this case, the controller 30 may close the cut-off valves 44L, 44R so that the pressure of the PT line attains a constant pressure, and may shut off the communication through the center bypass pipelines 40L, 40R. Then, when the predetermined period of time elapses since the start of acquisition of the diagnostic data, the controller 30

(the diagnostic data acquisition control unit 305) ends the acquisition of the diagnostic data, and proceeds to step S316.

For example, as illustrated in FIG. 11, when the manual regeneration of the exhaust gas processing apparatus ends at a time t23, normally, a high load driving state of the engine 11 ends, and the engine rotational speed (see a long dashed short dashed line 1111) and the discharge pressure of the main pump 14 (see a long dashed short dashed line 1121) are brought back to a relatively low state similar to a state before the start of the manual regeneration.

In contrast, in this example, when the manual regeneration of the exhaust gas processing apparatus is determined to have ended at the time t23, the engine rotational speed (the target rotational speed of the engine 11) and the discharge pressure (the setting value) of the main pump 14 at the end of the manual regeneration of the exhaust gas processing apparatus are maintained. Then, in that state, the diagnostic data is acquired (collected) from the time t23 to a time t24. Accordingly, the controller 30 provides a collection period for performing the collection of the diagnostic data when the manual regeneration of the exhaust gas processing apparatus ends, so that both of the manual regeneration of the exhaust gas processing apparatus and the collection of the diagnostic data can be achieved. Specifically, the collection period of the diagnostic data is set in the manual regeneration mode. In this manner, the controller 30 maintains the state of the manual regeneration of the exhaust gas processing apparatus even in the collection period of the diagnostic data, and therefore, the operator does not feel uncomfortable even if the diagnostic data is collected when the manual regeneration of the exhaust gas processing apparatus ends.

Back to FIG. 10, in step S316, the manual regeneration control unit 303 notifies the operator of the end of the manual regeneration mode, transitions to the normal mode, and proceeds to step S318. For example, the manual regeneration control unit 303 causes a speech indicating the end of the manual regeneration mode to be output from the speaker in the cab 10, or causes character information indicating the end of the manual regeneration mode to be displayed on the display apparatus 50. Accordingly, the controller 30 notifies the end of the manual regeneration of the exhaust gas processing apparatus after the collection of the diagnostic data is completed, and therefore, the diagnostic data can be collected together with the manual regeneration of the exhaust gas processing apparatus, without causing the operator to feel uncomfortable.

Step S318 is the same as the processing of step S220 of FIG. 8, and therefore, explanation is omitted.

In this manner, in this example, in a case where the manual regeneration of the exhaust gas processing apparatus of the shovel 100 is performed, the controller 30 collects the diagnostic data for performing the diagnosis of the shovel 100. Specifically, the controller 30 collects the diagnostic data in the background processing (i.e., without causing the operator to feel uncomfortable even if the diagnostic data is collected) according to the manual regeneration of the exhaust gas processing apparatus of the shovel 100. Accordingly, without relying on operator's operations, a highly reliable diagnostic data can be automatically acquired with a small variation in the output of the shovel 100. Specifically, the controller 30 can more easily acquire the diagnostic data of the shovel 100.

<Effects>

In this manner, in this example, similarly with the above-described first example, the shovel 100 (the controller 30) collects (acquires) the diagnostic data of the shovel 100 when the engine 11 and the hydraulic system are driven under a constant driving condition.

Accordingly, the shovel 100 can achieve substantially the same operations and effects as the above-described first example.

Also, in this example, similarly with the above-described first example, the shovel 100 (the controller 30) may collect the diagnostic data of the shovel 100 when the data collection condition corresponding to the case where variation in the output of the engine 11 is relatively small (i.e., the output of the engine 11 is stable) is satisfied. Specifically, in this example, similarly with the case of the above-described first example, the shovel 100 may collect the diagnostic data when a predetermined event of the shovel 100 occurs that relatively reduces variation in the output of the engine 11.

Accordingly, similarly with the above-described first example, the shovel 100 can achieve substantially the same operations and effects.

Also, in this example, the data collection condition may be that "the regeneration of the exhaust gas processing apparatus of the engine 11 is performed". Specifically, the predetermined event may be "the regeneration of the exhaust gas processing apparatus of the engine 11".

Accordingly, the shovel 100 can collect the diagnostic data by specifically selecting a situation in which variation in the output of the engine 11 is relatively small.

Also, in this example, similarly with the above-described first example, the shovel 100 (the controller 30) may collect the diagnostic data when a predetermined movement (i.e., a predetermined event) of the shovel 100 corresponding to the data collection condition (the manual regeneration of the exhaust gas processing apparatus of the shovel 100 in this example) is completed.

Accordingly, similarly with the above-described first example, the shovel 100 can achieve substantially the same operations and effects.

Also, in this example, similarly with the above-described first example, when the predetermined movement (the predetermined event) of the shovel 100 corresponding to the data collection condition is completed, the shovel 100 (the controller 30) may collect the diagnostic data by continuing the state of the engine 11 and the hydraulic system corresponding to the constant driving condition of the predetermined movement (the predetermined event) (in this example, the load state of the engine 11, the state of the water temperature of the engine 11, the state of the oil temperature of the hydraulic oil, and the like in the manual regeneration of the exhaust gas processing apparatus) for a predetermined period of time.

Accordingly, similarly with the above-described first example, the shovel 100 can achieve substantially the same operations and effects.

Also, in this example, similarly with the above-described first example, after the collection of the diagnostic data is completed, the shovel 100 (the controller 30) may notify the operator of the end of the predetermined movement (the predetermined event) of the shovel 100 corresponding to the data collection condition (in this example, the manual regeneration of the exhaust gas processing apparatus).

Accordingly, similarly with the above-described first example, the shovel 100 can achieve substantially the same operations and effects.

Third Example of Diagnostic Data Acquisition Processing

Next, a third example of the diagnostic data acquisition processing performed by the controller 30 is explained.

<Overview>

For example, when turbo cooling (cooling driving of supercharger) is performed to cool a supercharger (turbo charger) provided in the engine 11 in the shovel 100, the diagnostic data acquisition control unit 305 may acquire the diagnostic data of the shovel 100 by applying a constant load to the engine 11 and the hydraulic system.

For example, cooling driving of the supercharger is executed in a case where the shovel 100 is stopped (i.e., the key switch is turned OFF) according to the temperature state of the supercharger (for example, when the supercharger is in a high temperature state in which the temperature is relatively high).

For example, at a point in time when the turbo cooling starts, the controller 30 switches the control mode of the shovel 100 to the turbo cooling mode in the shovel 100. The implementation period of the turbo cooling mode includes a turbo cooling execution period and a diagnostic data collection period. The turbo cooling execution period is a period in which turbo cooling is performed. The diagnostic data collection period is a period in which, after the turbo cooling is completed, diagnostic data is collected by applying a constant load to the engine 11 and the hydraulic system. Specifically, in this example, the turbo cooling mode includes the diagnostic mode, and the diagnostic data collection period corresponds to the diagnostic mode. In the turbo cooling mode, the diagnostic data acquisition control unit 305 causes the display apparatus 50 to display a notification screen for notifying the operator of the shovel 100 that the shovel 100 is in the turbo cooling mode.

In this manner, the diagnostic data acquisition control unit 305 acquires the diagnostic data by applying a constant load to the engine 11 and the hydraulic system of the shovel 100 while the above-described notification screen is displayed on the display apparatus 50, i.e., during the turbo cooling mode. Therefore, the diagnostic data acquisition control unit 305 can acquire the diagnostic data with the constant load being applied, in the background, while the operator is waiting for the turbo cooling mode to end without performing any operation.

In particular, the diagnostic data collection period is extremely shorter than the turbo cooling execution period (for example, 1/10 or less), and therefore, the diagnostic data acquisition control unit 305 does not let the operator clearly notice that the acquisition of the diagnostic data is also performed during the turbo cooling mode.

<Effects>

In this manner, in this example, similarly to the above-described first example and the like, the shovel 100 (the controller 30) collects (acquires) the diagnostic data of the shovel 100 when the engine 11 and the hydraulic system are driven under a constant driving condition.

Accordingly, similarly to the above-described first example and the like, the shovel 100 can achieve substantially the same operations and effects.

In this example, similarly to the above-described first example and the like, the shovel 100 (the controller 30) may collect the diagnostic data of the shovel 100 when the data collection condition corresponding to the case where variation in the output of the engine 11 is relatively small (i.e., the output of the engine 11 is stable) is satisfied. In other words, in this example, the shovel 100 may collect the diagnostic data when a predetermined event of the shovel 100 occurs that relatively reduces variation in the output of the engine 11.

Accordingly, similarly to the above-described first example and the like, the shovel 100 can achieve substantially the same operations and effects.

Also, in this example, the data collection condition may be that "the cooling driving of the supercharger (the turbo charger) provided in the engine 11 is performed". Specifically, the predetermined event may be "the cooling driving of the supercharger (turbo charger) provided in the engine 11".

Accordingly, similarly to the case of the warm-up driving and the like, the shovel 100 (the controller 30) can collect the diagnostic data during the cooling driving of the supercharger of the engine 11 (during the turbo cooling mode) without causing the operator to feel uncomfortable. Accordingly, the shovel 100 can collect the diagnostic data by specifically selecting a situation in which variation in the output of the engine 11 is relatively small.

Also, in this example, similarly to the above-described first example and the like, the shovel 100 (the controller 30) may collect the diagnostic data when the predetermined movement (the predetermined event) of the shovel 100 corresponding to the data collection condition (the cooling driving of the supercharger of the engine 11 in this example) is completed.

Accordingly, similarly to the above-described first example and the like, the shovel 100 can achieve substantially the same operations and effects.

Also, in this example, similarly to the above-described first example and the like, when the predetermined movement (the predetermined event) of the shovel 100 corresponding to the data collection condition is completed, the shovel 100 (the controller 30) may collect the diagnostic data by continuing the state of the predetermined movement (the predetermined event) (in this example, the load state of the engine 11, the state of the water temperature of the engine 11, the state of the oil temperature of the hydraulic oil, and the like in the cooling driving of the supercharger) for a predetermined period of time.

Accordingly, similarly to the above-described first example and the like, the shovel 100 can achieve substantially the same operations and effects.

Also, in this example, similarly to the above-described first example and the like, after the collection of the diagnostic data is completed, the shovel 100 (the controller 30) may notify the operator of the end of the predetermined movement (the predetermined event) of the shovel 100 corresponding to the data collection condition (in this example, cooling driving of the supercharger).

Accordingly, similarly to the above-described first example and the like, the shovel 100 can achieve substantially the same operations and effects.

Fourth Example of Diagnostic Data Acquisition Processing

Next, a fourth example of the diagnostic data acquisition processing performed by the controller 30 is explained.

<Overview>

For example, the controller 30 (the diagnostic data acquisition control unit 305) may acquire the diagnostic data in a calibration mode in which the output value of orientation detection apparatus S4 is calibrated.

The output value of the orientation detection apparatus S4 changes due to the outside temperature and the like. In this case, an error occurs in the position information of the working portion. Therefore, it is necessary for the controller 30 to solve the error in the position information of the working portion by transitioning the control mode to the calibration mode at a predetermined time and by calibrating the output value of orientation detection apparatus S4 in the calibration mode. Accordingly, the controller 30 acquires the diagnostic data during the calibration mode after the calibration ends, so that the controller 30 can acquire the diagnostic data without causing the operator to feel uncomfortable. Specifically, in this example, the calibration mode includes the diagnostic mode, and the diagnostic data collection period after the calibration of the orientation detection apparatus S4 is completed corresponds to the diagnostic mode.

<Effects>

In this manner, in this example, the shovel 100 (the controller 30), similarly to the above-described first example and the like, when the engine 11 and the hydraulic system are driven under a constant driving condition, collects (acquires) the diagnostic data of the shovel 100.

Accordingly, the shovel 100 can achieve substantially the same operations and effects as the above-described first example and the like.

Also, in this example, similarly to the above-described first example and the like, the shovel 100 (the controller 30) may collect the diagnostic data of the shovel 100 when the data collection condition corresponding to the case where variation in the output of the engine 11 is relatively small (i.e., the output of the engine 11 is stable) is satisfied. Specifically, in this example, the shovel 100 may collect the diagnostic data when a predetermined event of the shovel 100 occurs that relatively reduces variation in the output of the engine 11.

Accordingly, the shovel 100 can achieve substantially the same operations and effects as the above-described first example and the like.

Also, in this example, the data collection condition may be that "the calibration of the orientation detection apparatus S4 has been performed". Specifically, the predetermined event may be "the calibration of the orientation detection apparatus S4".

Accordingly, similarly to the case of the warm-up driving and the like of the shovel 100, the shovel 100 (the controller 30) can collect the diagnostic data during the calibration (during the calibration mode) of the output value of orientation detection apparatus S4, without causing the operator to feel uncomfortable. Therefore, the shovel 100 can collect the diagnostic data by specifically selecting a situation in which variation in the output of the engine 11 is relatively small.

Also, in this example, similarly to the above-described first example and the like, the shovel 100 (the controller 30) may collect the diagnostic data, when the operation of the predetermined movement (the predetermined event) of the shovel 100 corresponding to the data collection condition (in this example, calibration of the output value of orientation detection apparatus S4) is completed.

Accordingly, the shovel 100 can achieve substantially the same operations and effects as the above-described first example and the like.

Also, in this example, similarly to the above-described first example and the like, the shovel 100 (the controller 30) may collect the diagnostic data by continuing the state of the predetermined movement (the predetermined event) (in this example, the load state of the engine 11 during calibration of the output value of orientation detection apparatus S4, the state of the water temperature of the engine 11, the state of the oil temperature of the hydraulic oil, and the like) for a predetermined period of time when the predetermined movement (the predetermined event) of the shovel 100 corresponding to the data collection condition is completed.

Accordingly, the shovel 100 can achieve substantially the same operations and effects as the above-described first example and the like.

Also, in this example, similarly to the above-described first example and the like, the shovel 100 (the controller 30) notifies the operator of the end of the predetermined movement (the predetermined event) of the shovel 100 corresponding to the data collection condition (in this example, calibration of the output value of orientation detection apparatus S4) after the collection of the diagnostic data is completed.

Accordingly, the shovel 100 can achieve substantially the same operations and effects as the above-described first example and the like.

Fifth Example of Diagnostic Data Acquisition Processing

Next, a fifth example of the diagnostic data acquisition processing performed by the controller 30 is explained.

In the first example to the fourth example explained above, the diagnostic data acquisition control unit 305 collects the diagnostic data by applying a constant load to the shovel 100 when the warm-up driving, the regeneration of the exhaust gas processing apparatus, the turbo cooling, or calibration of the orientation detection apparatus S4 is performed in the shovel 100, but is not limited thereto.

For example, the diagnostic data acquisition control unit 305 may collect the diagnostic data by applying a constant load to the shovel 100 when other processing is performed in the shovel 100. Examples of other processing include purge processing of the urea SCR system (regeneration processing of catalyst) and the like. Specifically, in this example, the control mode in which the purge processing of the urea SCR system is performed includes the diagnostic mode, and the diagnostic data collection period after the purge processing is completed corresponds to the diagnostic mode.

Sixth Example of Diagnostic Data Acquisition Processing

Next, a sixth example of the diagnostic data acquisition processing performed by the controller 30 is explained with reference to FIG. 13 to FIG. 15.

<Procedure of Diagnostic Data Acquisition Processing>

Figure 13:
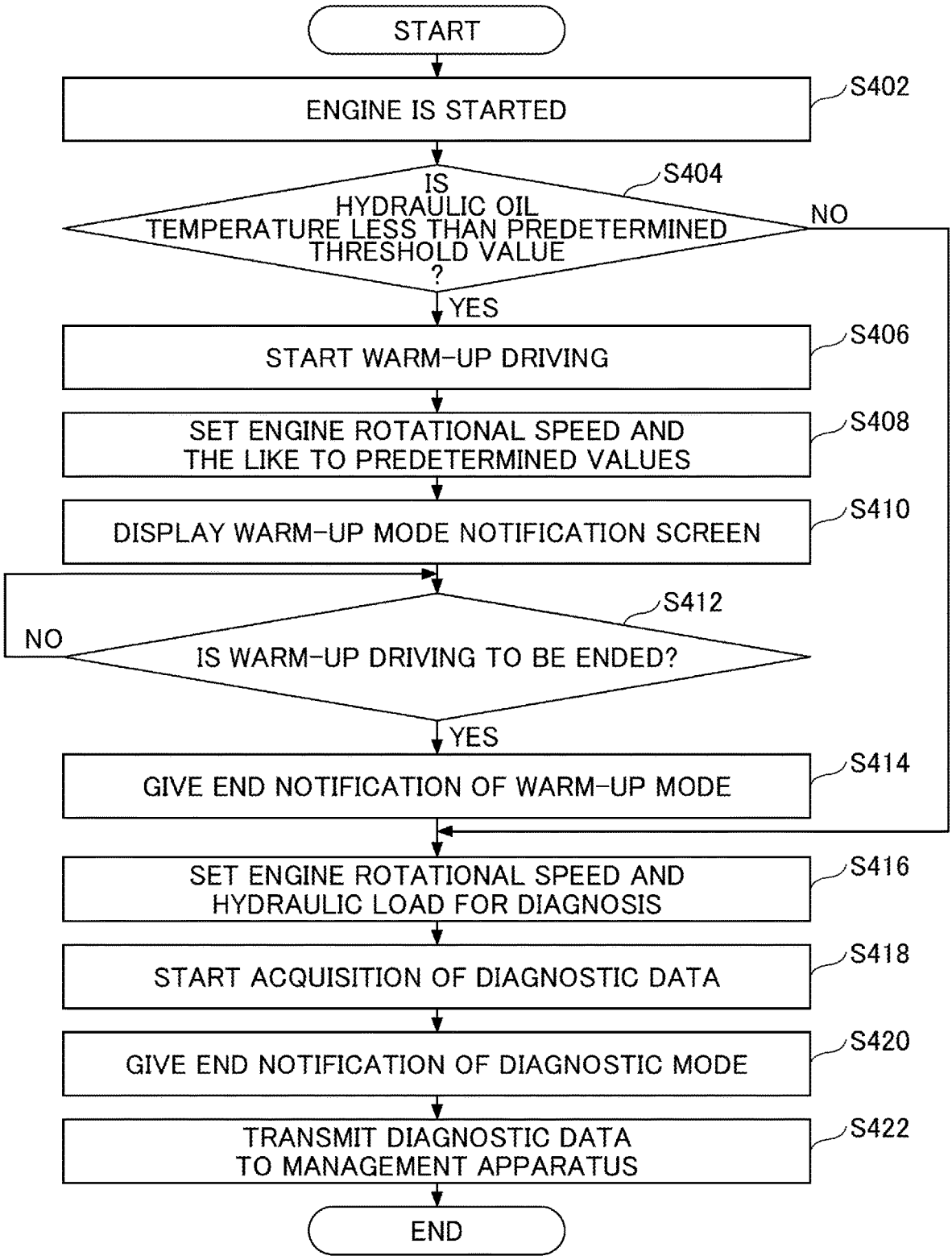
FIG. 13 is a flowchart schematically illustrating a sixth example of control processing performed by the controller to acquire diagnostic data.

FIG. 13 is a flowchart schematically illustrating the sixth example of the diagnostic data acquisition processing performed by the controller 30. For example, this flowchart is executed when the key switch of the shovel 100 is turned ON while the gate lock is in the locked state (i.e., the gate lock switch that is synchronized with the gate lock is in the ON state). FIG. 14 includes time charts 1410 to 1430 indicating the engine rotational speed (the target rotational speed), the discharge pressure of the main pump 14 (the setting value), and the temporal change of the water temperature of the engine 11 during the execution of the diagnostic data acquisition processing. FIG. 15 is a diagram illustrating an example of display content displayed by the display apparatus 50 during the execution of the diagnostic data acquisition processing.

Figure 14:
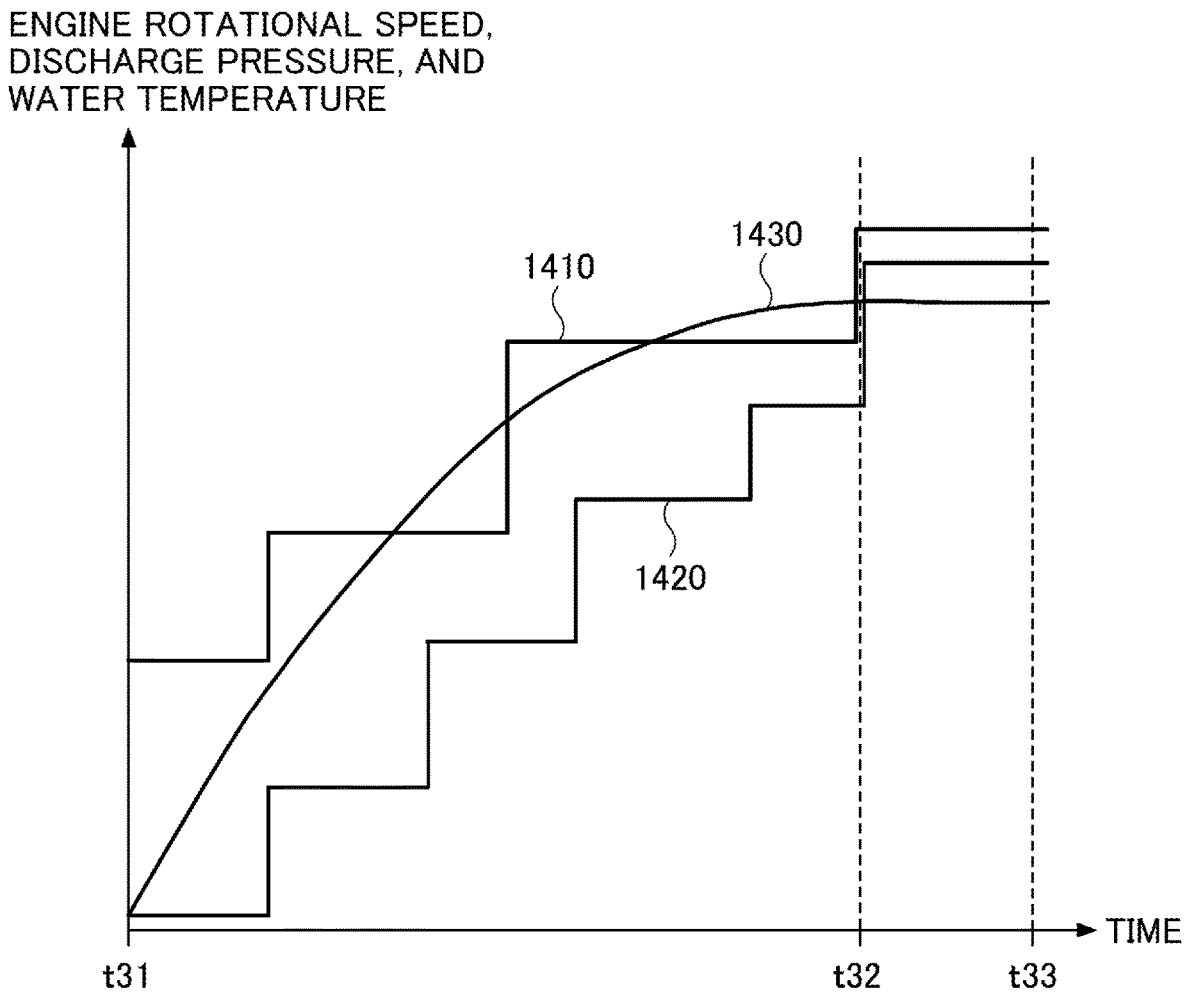
FIG. 14 is a time chart illustrating an example of temporal change of an engine rotational speed, a discharge pressure of the main pump, and a water temperature of the engine when control processing for acquiring diagnostic data is executed.

The oil temperature of the hydraulic oil of the hydraulic driving system (the hydraulic system) during the execution of the diagnostic data acquisition processing according to this example exhibits substantially the same temporal change as the water temperature of the engine 11, and is therefore omitted in FIG. 14.

As illustrated in FIG. 13, in step S402, the controller 30 (the automatic warm-up control unit 301) starts the engine 11 by controlling, via the ECU 74, various kinds of actuators of the engine 11 (for example, the injector and the like) while activating the starter 11*b*, and proceeds to step S404. In this case, as described above, as a prerequisite condition, the gate lock is in the locked state, so that the gate lock valve interposed in the pilot line 25 between the pilot pump 15 and the operating apparatus 26 shuts off the communication through the pilot line 25, and the operation of (the hydraulic actuators of) the shovel 100 using the operating apparatus 26 is invalidated. Accordingly, when the engine 11 of the shovel 100 is started, the shovel 100 can be prevented from moving when the operating apparatus 26 is erroneously operated.

As described above, the shovel 100 may be remotely operated. In this case, instead of or in addition to operations using the operating apparatus 26, the controller 30 may invalidate remote operations.

In step S404, the controller 30 (the automatic warm-up control unit 301) determines whether the oil temperature of the hydraulic oil of the hydraulic system is less than the predetermined threshold value. In a case where the oil temperature of the hydraulic oil is less than the predetermined threshold value, the controller 30 proceeds to step S406, and in the other case, the controller determines that the diagnostic data can be collected, and proceeds to step S416.

In step S406, the controller 30 (the automatic warm-up control unit 301) starts the warm-up driving of the shovel 100 (i.e., transitions the operation mode of the shovel 100 to the warm-up mode corresponding to the automatic warm-up function), and proceeds to step S408.

In step S408, the controller 30 (the automatic warm-up control unit 301) sets the target rotational speed of the engine 11 and the hydraulic load (the discharge pressure) of the main pump 14 to the predetermined values, starts the automatic warm-up driving of the shovel 100, and proceeds to step S410. In this case, the predetermined value may be changed according to an elapse of time (see FIG. 14).

For example, as illustrated in FIG. 14, at a time t31, when the engine 11 is started, the target rotational speed of the engine 11 is raised stepwise according to an elapse of time, and the engine rotational speed increases stepwise (see the time chart 1410). Accordingly, after the time t31, the water temperature of the engine 11 increases toward the right side of the graph (see the time chart 1430).

Also, likewise, at the time t31, when the engine 11 is started, the setting value of the discharge pressure of the main pump 14 is raised stepwise according to an elapse of time, and the actual value thereof also increases stepwise. Accordingly, after the time t31, similarly to the case of the water temperature of the engine 11, the oil temperature of the hydraulic oil of the hydraulic driving system increases toward the right side of the graph. In this manner, the shovel 100 can raise the water temperature of the engine 11 and the oil temperature of the hydraulic oil in accordance with an increase in the engine rotational speed and an increase in the hydraulic load.

Back to FIG. 13, in step S410, the controller 30 (the automatic warm-up control unit 301) causes the display apparatus 50 to display a notification that the operation mode has transitioned to the warm-up mode, and proceeds to step S412.

Accordingly, the operator of the shovel 100 can recognize that the shovel 100 has transitioned to the warm-up mode, and the automatic warm-up function is being executed. Also, the operator can recognize that, because the shovel 100 is in the warm-up mode, the operator cannot operate the shovel 100.

In the warm-up mode, the shovel 100 does not necessarily have to invalidate operations with the operating apparatus 26 and remote operations, and may be in an operable state.

In step S412, the controller 30 (the automatic warm-up control unit 301) determines whether the warm-up driving of the shovel 100 is to be ended. For example, in a case where the water temperature of the engine 11 and the oil temperature of the hydraulic oil of the hydraulic driving system are equal to or more than the respective predetermined threshold values, the controller 30 may determine that the warm-up driving is to be ended. In a case where the warm-up driving of the shovel 100 is to be ended, the controller 30 proceeds to step S414, and in the other case, the controller 30 waits until a point in time at which the warm-up driving of the shovel 100 is to be ended (i.e., repeats the processing of this step).

In the step S414, the controller 30 (the automatic warm-up control unit 301) gives a notification indicating the end of the warm-up mode (the warm-up driving) to the operator, and proceeds to step S416. For example, the controller 30 causes a speech indicating the end of the warm-up mode to be output from the speaker in the cab 10, or causes character information indicating the end of the warm-up mode to be displayed on the display apparatus 50. Accordingly, the controller 30 can let the operator recognize the end of the warm-up driving of the shovel 100 (i.e., the end of the warm-up mode).

In step S416, the diagnostic mode setting unit 304 sets the operation mode of the shovel 100 to the diagnostic mode. In this case, the diagnostic mode setting unit 304 continues the locked state of the gate lock (i.e., the ON state of the gate lock switch) from the engine start. Accordingly, in the diagnostic mode, the operations of (the hydraulic actuators of) the shovel 100 are invalidated. Therefore, during the diagnostic mode, a reduction in the reliability of the collected diagnostic data caused by operations of the hydraulic actuators of the shovel 100 can be alleviated.

Specifically, the diagnostic mode setting unit 304 controls the engine 11 and the regulator 13, sets the engine rotational speed (the target rotational speed of the engine 11) and the hydraulic load of the main pump 14 (the discharge pressure of the main pump 14) to unique values for the diagnostic mode, and proceeds to step S418. Specifically, similarly to the case of the above-described first example and the like, the diagnostic mode setting unit 304 may set the unique values for the diagnostic mode so that the engine 11 and the hydraulic system are driven under a constant driving condition. Accordingly, the diagnostic data acquisition control unit 305 can acquire the diagnostic data while the engine 11 and the hydraulic system are driven under a constant driving condition. Also, similarly to the case of the above-described first example and the like, the diagnostic mode setting unit 304 may set the unique values for the diagnostic mode (the hydraulic load of the main pump 14) so that a constant hydraulic load is applied to the hydraulic system after the start of acquisition of the diagnostic data. Accordingly, the diagnostic data acquisition control unit 305 can acquire the diagnostic data over the period ranging before and after the constant hydraulic load is applied. In this case, the diagnostic data acquisition control unit 305 may shut off the communication through the center bypass pipelines 40L, 40R by closing the cut-off valves 44L, 44R, so that a pipeline (a PT line) between the main pump 14 and the hydraulic oil tank attains constant pressure after a predetermined period of time elapses since the start of acquisition of the diagnostic data. Accordingly, with the effect of the relief valve, the pressure of the PT line is maintained constant, so that the constant hydraulic load can be applied.

In step S418, the diagnostic data acquisition control unit 305 starts acquisition (collection) of the diagnostic data. Then, when a predetermined period (for example, 30 seconds) elapses since the start of acquisition of the diagnostic data, the diagnostic data acquisition control unit 305 ends the acquisition (collection) of the diagnostic data, and proceeds to step S420.

Similarly to the case of the above-described first example and the like, the diagnostic data may be constituted by time-series data at predetermined time intervals in a predetermined period of time. The collection target diagnostic data may be specified in advance according to the diagnosis target device, the content of diagnosis, and the like. For example, in a case where the diagnosis target device is the engine 11, the diagnostic data may include a fuel injection rate of the engine 11, a command value of the engine rotational speed, a measurement value of the engine rotational speed, a boost pressure of the turbo charger of the engine 11, a pressure (a common rail pressure) of the fuel injection apparatus (the common rail) of the engine 11, a pressure of oil (an oil pressure) of the engine 11, a temperature of the exhaust gas, a measurement value of NOx in the exhaust gas, command values of the tilt angle of the swashplate of the main pumps 14L, 14R, a measurement value of the discharge pressure of the main pump 14, a measurement value of the oil temperature of the hydraulic oil of the hydraulic driving system (the hydraulic system), and the like. The controller 30 stores the diagnostic data acquired (collected) from various kinds of sensors during the predetermined period of time into an internal memory (for example, an auxiliary storage device) or a communicably connected external storage device. Together with this, the controller 30 also stores information (for example, date and time) about the date and time at which the diagnostic data is acquired (hereinafter referred to as "acquisition date and time information"), information about position (for example, latitude, longitude, altitude, and the like) (hereinafter referred to as "acquisition position information").

For example, as illustrated in FIG. 14, immediately before a time t32, when it is determined that the warm-up driving of the shovel 100 is to be ended, the acquisition of the diagnostic data is started. Then, at the time t32 after the start of acquisition of the diagnostic data, the engine rotational speed (the target rotational speed of the engine 11) and the discharge pressure (the setting value) of the main pump 14 increase to the unique values for the diagnostic mode. Then, in this state, diagnostic data is acquired (collected) until a time t33.

In the diagnostic mode, specifically, the controller 30 (the diagnostic mode setting unit 304) causes the display apparatus 50 to display a message that the shovel 100 is in the diagnostic mode during the processing of steps S416, S418.

Figure 15:
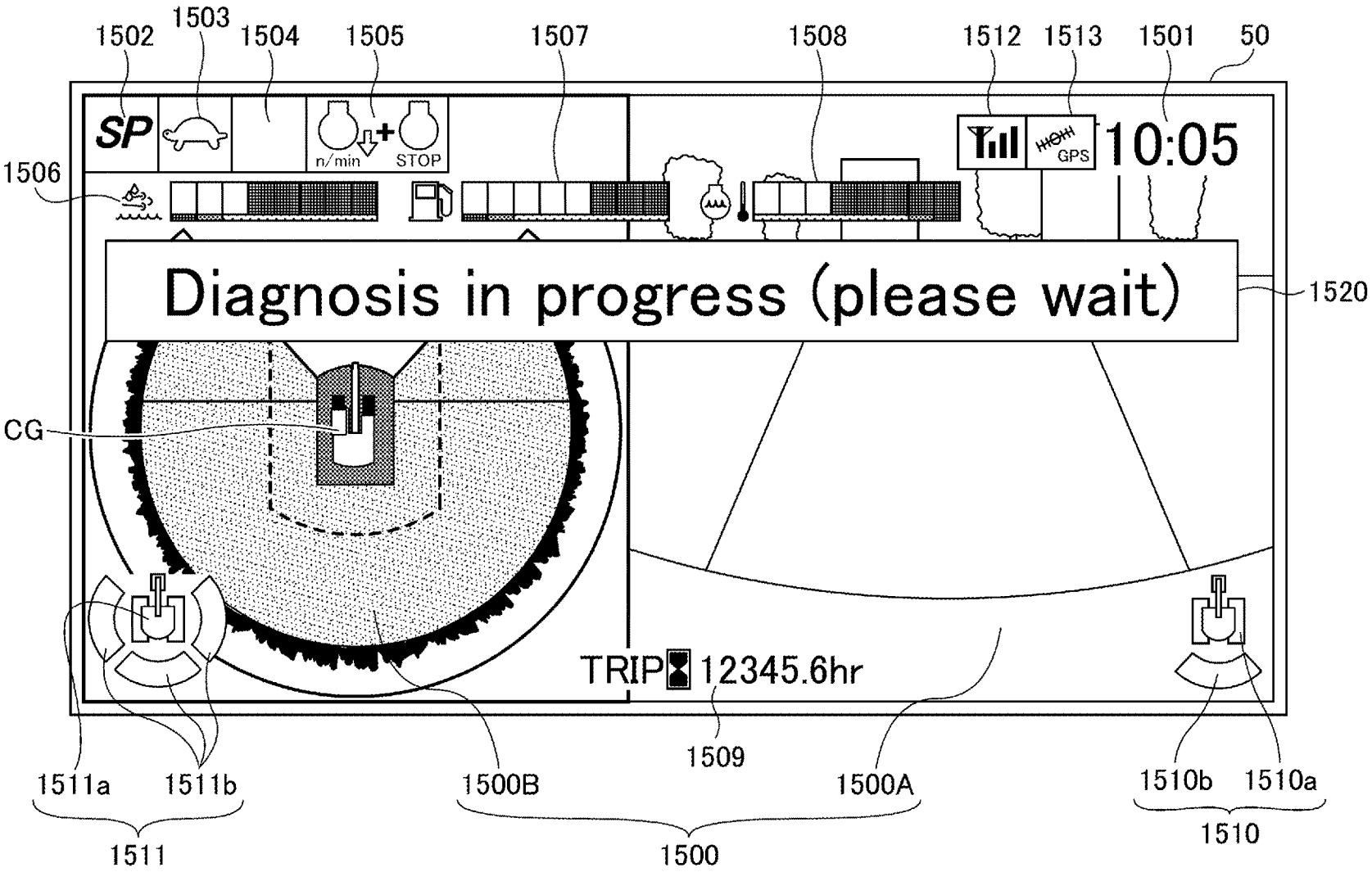
FIG. 15 is a diagram illustrating an example of display content displayed by the display apparatus when control processing for acquiring diagnostic data is executed.

For example, the display apparatus 50 displays the display content of FIG. 15.

As illustrated in FIG. 15, for example, the display apparatus 50 displays a surroundings image 1500 of the shovel 100 on the basis of the output (the captured image) of the camera S6. Also, the display apparatus 50 displays indication components 1501 to 1513, indicating various kinds of information about the shovel 100, in an overlapping manner on the surroundings image 1500.

The contents of the surroundings image 1500 and the indication components 1501 to 1513 are substantially the same as the surroundings image 600 and the indication component 613 of FIG. 6, and therefore, explanation thereabout is omitted.

Also, in addition to a display content displayed at the start of the diagnostic mode (the surroundings image 1500 and the indication components 1501 to 1513 in this example), the display apparatus 50 displays a notification component 1520 displayed in an overlapping manner on the display content.

The notification component 1520 is displayed in the central portion in the vertical direction of the display area of the display apparatus 50. In this example, character information, "Diagnosis in progress (please wait)", is displayed. Accordingly, the operator of the shovel 100 can recognize that the shovel 100 has transitioned to the diagnostic mode, and the collection of the diagnostic data is being executed. Also, the operator can recognize that, because the shovel 100 is in the diagnostic mode, the operator cannot operate the shovel 100.

In the diagnostic mode, the shovel 100 does not necessarily have to invalidate operations with the operating apparatus 26 and remote operations, and may be in an operable state.

Back to FIG. 13, in step S420, the controller 30 gives a notification indicating the end of the diagnostic mode (the collection of the diagnostic data) to the operator, transitions to the normal mode, and proceeds to step S422. For example, the controller 30 causes a speech indicating the end of the diagnostic mode to be output from the speaker in the cab 10, or causes character information indicating the end of the diagnostic mode to be displayed on the display apparatus 50. Accordingly, the controller 30 can let the operator recognize the end of the collection of the diagnostic data, separately from the end of the warm-up driving of the shovel 100, after the collection of the diagnostic data is completed.

In this example (FIG. 13), the controller 30 is configured in advance so that the controller 30 automatically transitions to the diagnostic mode after the end of the warm-up mode, but the controller 30 may ask the operator whether to execute the diagnostic mode after the end of the warm-up mode. In this case, even after the end of the warm-up mode, the controller 30 does not automatically transition to the diagnostic mode. For example, after the end of the warm-up mode, the controller 30 may ask the operator whether to transition to the diagnostic mode through display on the display apparatus 50, speech output from the speaker, and the like, and may execute the diagnostic mode in a case where the operator turns ON the diagnostic mode switch 56.

In step S422, the diagnostic data transmission unit 306 transmits the acquired (collected) diagnostic data to the management apparatus 300 through the transmission apparatus S1, and ends the current processing. In this case, for example, the controller 30 may transmit, to the management apparatus 300, not only the diagnostic data but also the above-described acquisition date and time information, the acquisition position information, and the like corresponding to the diagnostic data. Accordingly, the management apparatus 300 (the control apparatus 310) can perform various kinds of diagnoses of the shovel 100 on the basis of the predetermined algorithm using the diagnostic data received from the shovel 100. In this case, similarly to the case of the above-described first example and the like, the management apparatus 300 may perform the diagnosis of the shovel 100 by using a conventional statistical method (for example, a predetermined algorithm such as Bayesian estimation method, Mahalanobis method, vector analysis, and the like).

Instead of transmitting the diagnostic data to the management apparatus 300 on every acquisition of the diagnostic data, the diagnostic data may be transmitted in another point in time. For example, the diagnostic data may be transmitted to the management apparatus 300 in a case where the shovel 100 is stopped (i.e., the key switch is turned OFF) or when the shovel 100 starts next time (i.e., the key switch is turned ON). Also, for example, when diagnostic data for several times of diagnoses have been accumulated, the accumulated diagnostic data may be transmitted to the management apparatus 300 as a batch.

The controller 30 continues to monitor, with the surroundings monitor apparatus (for example, the camera S6), whether there is a monitor object entering the monitor area in the surroundings of the shovel 100 in the collection of the diagnostic data period, i.e., the diagnostic mode of the shovel 100. Also, the controller 30 may monitor, with the surroundings monitor apparatus, whether there is a monitor object entering the monitor area in the surroundings of the shovel 100 in the warm-up driving, i.e., during the warm-up mode of the shovel 100.

Even if an entry of the monitor object into the monitor area in the surroundings of the shovel 100 is detected with the surroundings monitor apparatus, the gate lock valve is maintained in the locked state in the collection period of the diagnostic data. Therefore, even if the operator operates the operating apparatus 26, the actuators of the shovel 100 are immovable. Also, in a case where the operating apparatus 26 is of an electric type that outputs an electric signal corresponding to an operation content, or the shovel 100 is remotely operated, a control command from the controller 30 to the control valve that applies the pilot pressure to the control valve 17 is invalidated. Therefore, in this case, the actuators are also rendered immovable. Therefore, even if the monitor object enters the monitor area in the surroundings of the shovel 100 during the collection period of the diagnostic data, the shovel 100 is prevented from moving.

Furthermore, as described above, in a case where the monitor object continues to be detected in the monitor area in the surroundings of the shovel 100 after the end of the collection period of the diagnostic data, the movement of the hydraulic actuators of the shovel 100 may be limited. This is because, when the collection period of the diagnostic data ends, and the control mode transitions from the diagnostic mode to the normal mode, the hydraulic actuators of the shovel 100 become operable, as described above. Accordingly, the attachment and the like of the shovel 100 is inhibited from coming in proximity to the monitor object (for example, a person) when the driven unit of the attachment and the like of the shovel 100 moves rapidly after the collection period of the diagnostic data ends.

In this manner, in this example, in a case where the warm-up driving of the shovel 100 is performed, the controller 30 automatically transitions to the diagnostic mode. Then, the controller 30 sets a unique engine rotational speed and a unique hydraulic load of the main pump 14 corresponding to the diagnostic mode, and collects the diagnostic data for performing the diagnosis of the shovel 100. Specifically, in this example, the warm-up mode and the diagnostic mode of the shovel 100 are synchronized. Accordingly, the controller 30 can acquire the diagnostic data under a constant condition. Therefore, the controller 30 can acquire more reliable diagnostic data. Also, in this example, according to the warm-up driving of the shovel 100, highly reliable diagnostic data can be automatically acquired without relying on operator's operations.

Modified Embodiment of Procedure of Diagnostic Data Acquisition Processing

For example, the diagnostic mode setting unit 304 transitions the operation mode of the shovel 100 to the diagnostic mode in response to an ON operation of the diagnostic mode switch 56.

Specifically, when the diagnostic mode switch 56 is turned ON, the diagnostic mode setting unit 304 sets the operation mode of the shovel 100 to the diagnostic mode. In this case, the diagnostic mode setting unit 304 transitions the gate lock to the locked state (i.e., turns ON the gate lock switch). Accordingly, in the diagnostic mode, operator's operations with the operating apparatus 26 are invalidated. Therefore, during the diagnostic mode, a reduction in the reliability of the collected diagnostic data caused by operations of the hydraulic actuators of the shovel 100 can be alleviated.

The diagnostic mode setting unit 304 controls the engine 11 and the regulator 13, and similarly to the processing of FIG. 13, the diagnostic mode setting unit 304 sets the engine rotational speed (the target rotational speed of the engine 11) and the hydraulic load of the main pump 14 (the discharge pressure of the main pump 14) to the unique values for the diagnostic mode. Then, the diagnostic mode setting unit 304 acquires the diagnostic data during the predetermined period of time (for example, 30 seconds), and transmits the acquired (collected) diagnostic data through the transmission apparatus S1 to the management apparatus 300. Also, the diagnostic mode setting unit 304 may reduce the opening of the cut-off valve 44 to a predetermined size of opening area in order to cause the hydraulic load to attain a predetermined value. Also, solenoid valves for generating predetermined hydraulic loads for collection of the diagnostic data may be provided in the center bypass pipelines 40L, 40R. Also, electromagnetic proportional valves may be provided in pilot circuits of hydraulic pilot-type control valves 171, 172, 173, 174, 175L, 175R, 176L, and 176R. Also, the diagnostic mode setting unit 304 may generate a predetermined hydraulic load by controlling the electromagnetic proportional valves.

Specifically, when the diagnostic mode switch 56 is turned ON, the diagnostic mode setting unit 304 executes the same processing as steps S416, S418, and S420 of FIG. 13.

Accordingly, similarly with the case of FIG. 13, the controller 30 can acquire the diagnostic data under a constant condition. Therefore, the controller 30 can acquire more reliable diagnostic data.

In a case where the water temperature of the engine 11 or the oil temperature of the hydraulic oil is relatively low (for example, substantially the same determination condition as step S404 of FIG. 13 is satisfied) when the diagnostic mode switch 56 is turned ON, the warm-up driving may be performed before the collection of the diagnostic data, similarly with FIG. 13. For example, in a case where the water temperature of the engine 11 or the oil temperature of the hydraulic oil is lower than a predetermined temperature when the diagnostic mode switch 56 is turned ON, the controller 30 may switch the operation mode of the shovel 100 to the warm-up mode, perform the warm-up driving, transition to the diagnostic mode after the end of the warm-up driving, and collect the diagnostic data.

<Effects>

In this manner, in this example, similarly to the above-described first example and the like, when the engine 11 and the hydraulic system are driven under a constant driving condition, the shovel 100 (the controller 30) collects (acquires) the diagnostic data of the shovel 100.

Accordingly, the shovel 100 can achieve substantially the same operations and effects as the above-described first example and the like.

Also, in this example, the shovel 100 may include, as a movement mode, a diagnostic mode for performing the diagnosis of the shovel 100. Then, in a case where the operation mode of the shovel 100 is the diagnostic mode, the controller 30 may collect the diagnostic data of the shovel 100.

For example, the above-described Patent Document 1 discloses a technique in which a shovel is caused to perform a specified movement according to operator's operations, and detection data of various sensors of the shovel at the time of the specified movement is acquired as diagnostic data related to the shovel.

However, in the technique of the above-described Patent Document 1, it is necessary for the operator to perform the lever operations to cause the shovel to perform the specified movement such as a movement of an attachment and a turning movement. Therefore, it may be impossible to acquire sufficiently reliable diagnostic data due to the movement of the hydraulic actuators.

In contrast, in this example, the shovel 100 can collect the diagnostic data of the shovel 100 under the constant condition corresponding to the diagnostic mode. Therefore, the shovel 100 can collect more reliable diagnostic data.

Also, in this example, in a case where the operation mode of the shovel 100 is the diagnostic mode, the controller 30 may set a unique engine rotational speed corresponding to the diagnostic mode.

Accordingly, in the diagnostic mode, the shovel 100 can maintain a condition related to the engine rotational speed at a constant level. Therefore, the shovel 100 can specifically collect more reliable diagnostic data.

Also, in this example, in a case where the operation mode of the shovel 100 is the diagnostic mode, the controller 30 may set a unique hydraulic load corresponding to the diagnostic mode with the main pump 14.

Accordingly, in the diagnostic mode, the shovel 100 can maintain a condition related to the hydraulic load of the main pump 14 at a constant level. Therefore, the shovel 100 can specifically collect more reliable diagnostic data.

Also, in this example, in a case where a predetermined condition about the movement of the shovel 100 (hereinafter referred to as a "diagnostic mode transition condition") is satisfied, the controller 30 may automatically transition the operation mode of the shovel 100 to the diagnostic mode. For example, when the warm-up driving corresponding to the automatic warm-up function of the shovel. 100 ends, the controller 30 transitions the operation mode of the shovel 100 to the diagnostic mode. Specifically, the diagnostic mode transition condition may be that "the warm-up driving of the shovel 100 has ended (has been completed)".

Accordingly, the shovel 100 can collect the diagnostic data by automatically transitioning to the diagnostic mode in accordance with the movement state of the shovel 100 suitable for the collection of the diagnostic data. Therefore, the shovel 100 can acquire more reliable diagnostic data without letting the operator be aware that the diagnostic data is being collected.

The diagnostic mode transition condition may be a condition other than the condition related to the warm-up driving of the shovel 100, so long as the condition corresponds to the movement state of the shovel 100 suitable for the collection of the diagnostic data. For example, the diagnostic mode transition condition may be that "the manual regeneration of the exhaust gas processing apparatus has ended (has been completed)" and "the cooling (turbo cooling) of the turbo charger of the engine 11 has ended (has been completed)".

Also, in this example, when a predetermined operation is performed (for example, the diagnostic mode switch 56 is turned ON), the controller 30 may transition the operation mode of the shovel 100 to the diagnostic mode.

Accordingly, the shovel 100 can transition to the diagnostic mode and collect the diagnostic data in accordance with the intention of the operator, service engineers, and the like.

The predetermined operation for causing the shovel 100 to transition to the diagnostic mode may be performed outside of the shovel 100 (for example, the management apparatus 300). For example, as described above, the function of the diagnostic mode switch 56 may be achieved by the management apparatus 300.

Also, in this example, in a case where the movement mode is the diagnostic mode, the controller 30 may invalidate the operation of the shovel 100.

Accordingly, for example, the shovel 100 can alleviate a reduction in the reliability of the collected diagnostic data due to operations of the hydraulic actuators during the collection of the diagnostic data.

As described above, the shovel 100 may be remotely operated. In this case, operations that are invalidated in the diagnostic mode of the shovel 100 include not only operations using the operating apparatus 26 but also the remote operation.

Also, in this example, the shovel 100 may transition to the diagnostic mode synchronized with a predetermined movement mode (for example, the warm-up mode).

Accordingly, for example, the shovel 100 can transition to the diagnostic mode according to execution of a movement mode suitable for movement related to diagnosis of the shovel 100. In this case, the shovel 100 can improve the reliability of the collected diagnostic data.

Also, in this example, during the movement related to the diagnosis of the shovel 100 (for example, collection of the diagnostic data, diagnostic processing based on the diagnostic data, and the like), the display apparatus 50 may display a message indicating that the shovel 100 is moving.

Accordingly, the shovel 100 can notify the operator that the shovel 100 is in the movement related to the diagnosis of the shovel 100. Therefore, for example, during the movement related to the diagnosis of the shovel 100, the shovel 100 can prompt the operator not to perform inappropriate operations during the movement. Therefore, the shovel 100 can improve the reliability of the collected diagnostic data.

Seventh Example of Diagnostic Data Acquisition Processing

Next, a seventh example of the diagnostic data acquisition processing performed by the controller 30 is explained with reference to FIG. 16 to FIG. 18.

<Procedure of Diagnostic Data Acquisition Processing>

Figure 16:
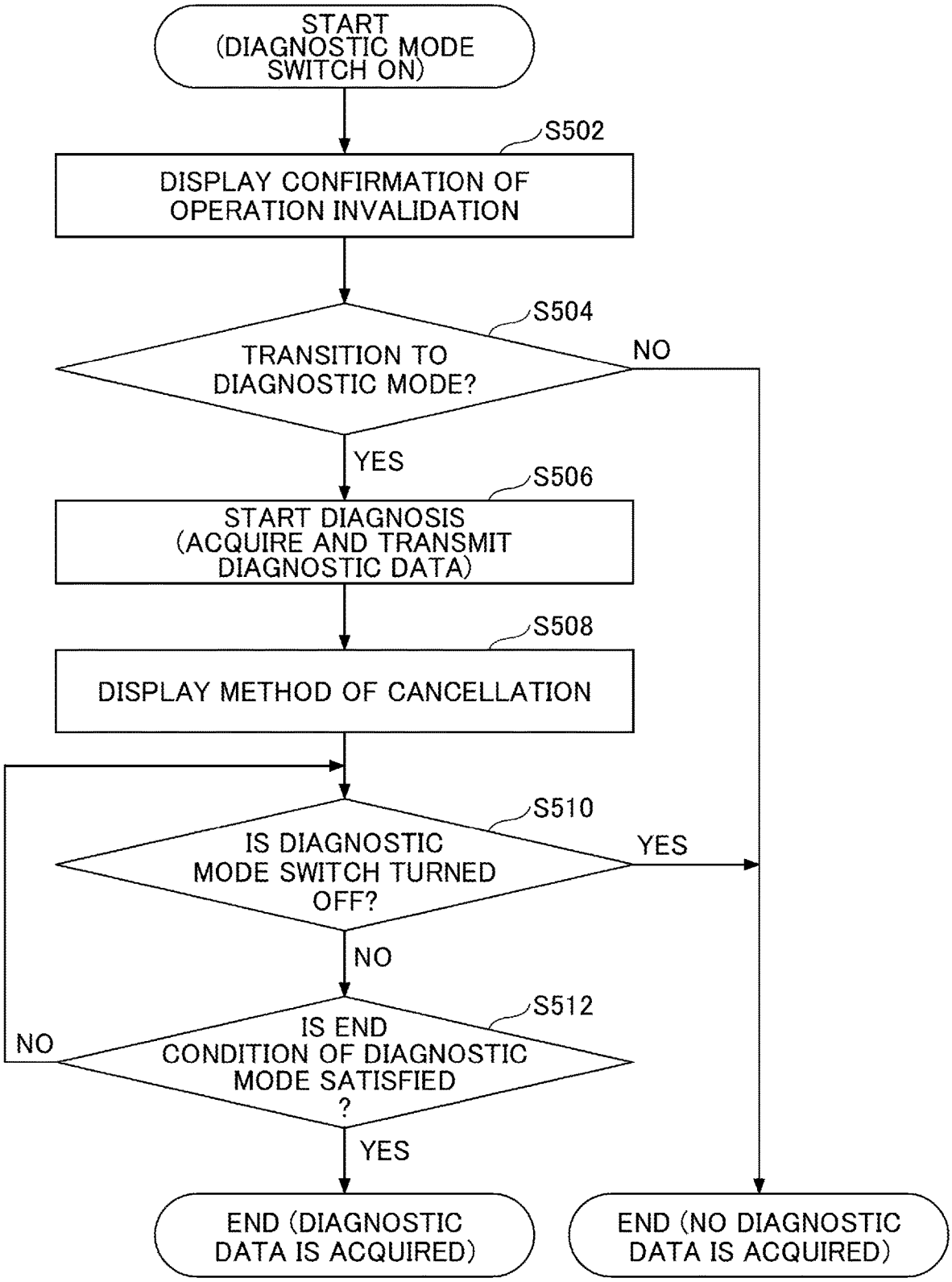
FIG. 16 is a flowchart schematically illustrating a seventh example of control processing performed by the controller to acquire diagnostic data.

FIG. 16 is a flowchart schematically illustrating a seventh example of the diagnostic data acquisition processing performed by the controller 30. For example, this flowchart is executed when the diagnostic mode switch 56 is turned ON. Also, this flowchart is executed upon an occurrence of an event (for example, completion of the warm-up mode, completion of the manual regeneration mode, and the like) serving as a trigger for transition to the diagnostic mode other than an ON operation of the diagnostic mode switch 56. FIG. 17 and FIG. 18 are drawings illustrating specific examples of display contents displayed on the display apparatus 50 during execution of the diagnostic mode setting processing.

As illustrated in FIG. 16, in step S502, when the shovel 100 transitions to the diagnostic mode, the diagnostic mode setting unit 304 displays, on the display apparatus 50, a message for prompting to confirm that operations of (the hydraulic actuators of) the shovel 100 are invalidated (hereinafter referred to as a "confirmation of operation invalidation"). Then, after the processing of step S502 is completed, the controller 30 proceeds to step S504.

Figure 17:
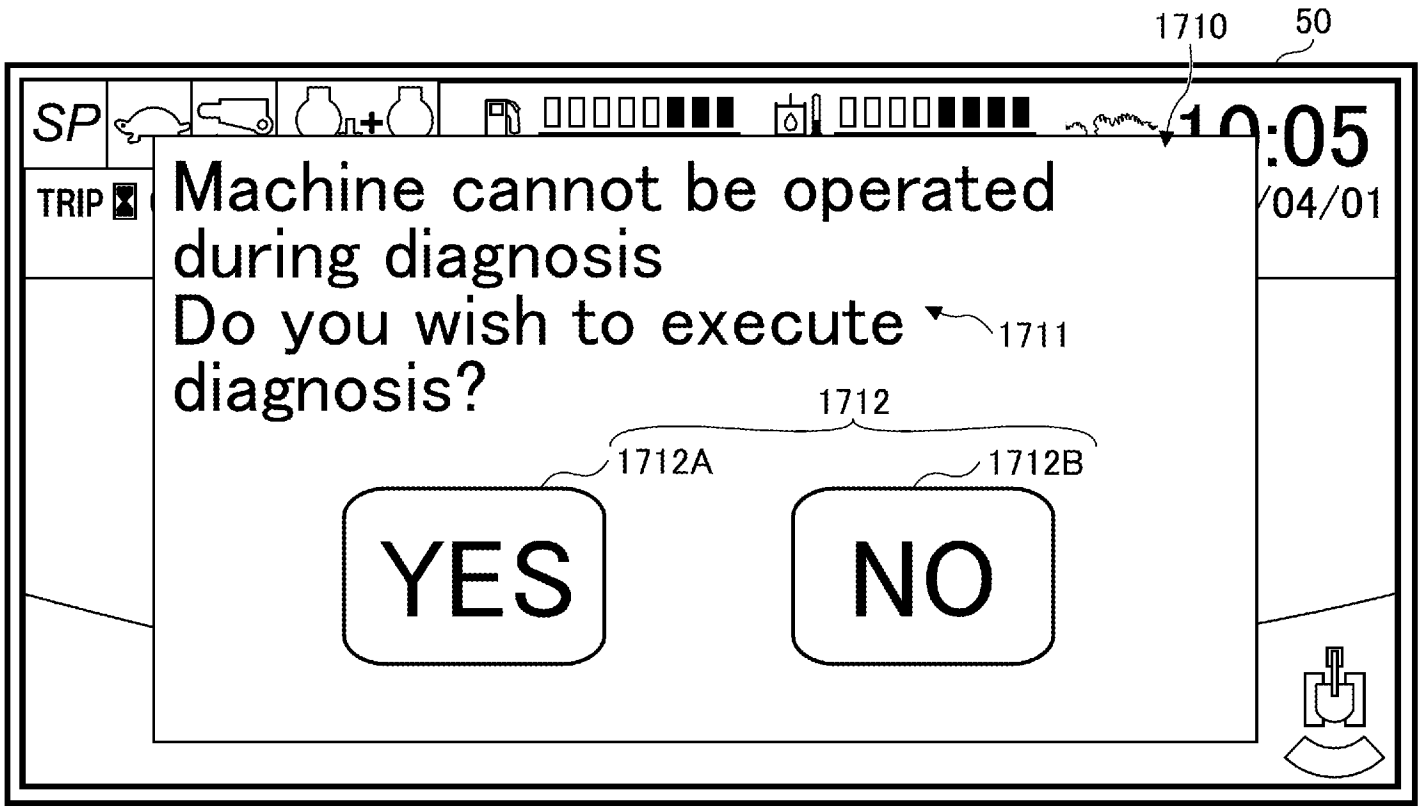
FIG. 17 is a drawing illustrating a specific example of display content displayed by the display apparatus when control processing for acquiring diagnostic data is executed.

For example, as illustrated in FIG. 17, a pop-up notification 1710 for prompting confirmation of operation invalidation is displayed on the display apparatus 50 in an overlapping manner on the display content displayed when the diagnostic mode switch 56 is turned ON (the surroundings image of the shovel 100 based on a captured image captured by the camera S6 in this example).

The pop-up notification 1710 includes a message information 1711 and an operation icon 1712.

The message information 1711 includes a message, "Machine cannot be operated during diagnosis. Do you wish to execute diagnosis?". Accordingly, in the diagnostic mode, the operator can recognize that the operation of the shovel 100 cannot be performed. Also, with the operation icon 1712, the operator can recognize that it is possible to select whether to transition the shovel 100 to the diagnostic mode or to stop the transition to the diagnostic mode.

The operation icon 1712 includes an operation icon 1712A and an operation icon 1712B.

The operation icon 1712A is used to select the transition to the diagnostic mode of the shovel 100. The operator can cause the shovel 100 to transition to the diagnostic mode by performing an operation for selecting and confirming the operation icon 1712A (for example, a touch operation at a position corresponding to the operation icon 1712A of the touch panel) through a predetermined input apparatus (for example, a touch panel and the like implemented on the display apparatus 50).

The operation icon 1712B is used to select stopping of the transition to the diagnostic mode of the shovel 100. The operator can stop the transition to the diagnostic mode of the shovel 100 by performing an operation to select and confirm the operation icon 1712B through the predetermined input apparatus.

Back to FIG. 16, in step S504, the diagnostic mode setting unit 304 determines whether to transition the operation mode of the shovel 100 to the diagnostic mode. Specifically, in a case where the operator performs a predetermined operation (for example, an operation on the operation icon 1712A of FIG. 17) for selecting transition to the diagnostic mode, the diagnostic mode setting unit 304 may determine that the operation mode of the shovel 100 is to be transitioned to the diagnostic mode. Conversely, in a case where the operator performs a predetermined operation (for example, an operation on the operation icon 1712B of FIG. 17) for selecting stopping of transition to the diagnostic mode, the diagnostic mode setting unit 304 may determine that the operation mode of the shovel 100 is not to be transitioned to the diagnostic mode. In a case where the operation mode of the shovel 100 is transitioned to the diagnostic mode, the diagnostic mode setting unit 304 proceeds to step S506, and in a case where the operation mode of the shovel 100 is not transitioned to the diagnostic mode, the current processing is ended in a state in which no diagnostic data has been acquired.

In step S506, the diagnostic mode setting unit 304 sets the operation mode of the shovel 100 to the diagnostic mode, starts processing of the diagnosis of the shovel 100, and proceeds to step S508. For example, the controller 30 (the diagnostic mode setting unit 304) may start a series of processing for collecting (acquiring) data for performing diagnosis of the shovel 100 (hereinafter referred to as diagnostic data) during the predetermined period of time and transmitting the collected diagnostic data to the management apparatus 300. In this case, similarly to the case of the above-described first example and the like, the controller (the diagnostic data acquisition control unit 305) acquires the diagnostic data while the engine 11 and the hydraulic system are driven under a constant driving condition. Also, similarly to the case of the above-described first example and the like, the controller. 30 (the diagnostic data acquisition control unit 305) may control the hydraulic load of the hydraulic system (the main pump 14) so as to apply a constant hydraulic load to the hydraulic system after the start of acquisition of the diagnostic data. Also, in a case where the function of the diagnostic unit 3101 of the management apparatus 300 is achieved by the shovel 100 (for example, the controller 30), the series of processing may include processing for performing the diagnosis of the shovel 100 on the basis of the collected diagnostic data, instead of the processing for transmitting the diagnostic data to the management apparatus 300.

The controller 30 stores the diagnostic data acquired (collected) from various kinds of sensors during the predetermined period of time into an internal memory (for example, an auxiliary storage device) or a communicably connected external storage device. Together with this, the controller 30 also stores information (for example, date and time) about the date and time at which the diagnostic data is acquired (hereinafter referred to as "acquisition date and time information"), information about position (for example, latitude, longitude, altitude, and the like) (hereinafter referred to as "acquisition position information"). Also, the controller 30 may transmit not only the diagnostic data but also the above-described acquisition date and time information, the acquisition position information, and the like corresponding to the diagnostic data to the management apparatus 300.

Instead of transmitting the diagnostic data to the management apparatus 300 on every acquisition of the diagnostic data, the diagnostic data may be transmitted in another point in time. For example, the diagnostic data may be transmitted to the management apparatus 300 in a case where the shovel 100 is stopped (i.e., the key switch is turned OFF) or when the shovel 100 starts next time (i.e., the key switch is turned ON). Also, for example, when diagnostic data for several times of diagnoses have been accumulated, the accumulated diagnostic data may be transmitted to the management apparatus 300 at a time.

As described above, in the diagnostic mode of the shovel 100, the diagnostic mode setting unit 304 invalidates the operations of (the hydraulic actuators of) the shovel 100. For example, irrespective of the actual state of the gate lock lever, the diagnostic mode setting unit 304 may cause the gate lock into the locked state, i.e., may turn ON the gate lock switch synchronized with the gate lock. Accordingly, the gate lock valve 25V interposed in the pilot line 25 between the pilot pump 15 and the operating apparatus 26 shuts off the communication through the pilot line 25, which invalidates the operation of (the hydraulic actuators of) the shovel 100 using the operating apparatus 26.

Also, in the period in which at least diagnostic data is collected in the diagnostic mode of the shovel 100, the diagnostic mode setting unit 304 sets the engine rotational speed and the hydraulic load (the discharge flow rate) of the main pump 14 to respective unique values corresponding to the diagnostic mode. In other words, in this period, the diagnostic mode setting unit 304 prohibits the change of the engine rotational speed and the hydraulic load (the discharge flow rate) of the main pump 14. Accordingly, the condition related to the engine 11 and the main pump 14 suitable for the collection of the diagnostic data are maintained, even if an operation related to change of the engine rotational speed (for example, an operation of the rotational speed throttle volume 52) and an operation related to change of the discharge flow rate of the main pump 14 (for example, an operation of the operating apparatus 26) are performed. Therefore, the controller 30 can acquire more reliable diagnostic data.

Also, in the diagnostic mode of the shovel 100, the controller 30 continues to monitor, with the surroundings monitor apparatus (for example, the camera S6), whether there is a monitor object entering the monitor area in the surroundings of the shovel 100.

Even if an entry of the monitor object into the monitor area in the surroundings of the shovel 100 is detected with the surroundings monitor apparatus, the gate lock valve is maintained in the locked state in the diagnostic mode. Therefore, even if the operator operates the operating apparatus 26, the actuators of the shovel 100 are immovable. Also, in a case where the operating apparatus 26 is of an electric type that outputs an electric signal corresponding to an operation content, or the shovel 100 is remotely operated, a control command from the controller 30 to the control valve that applies the pilot pressure to the control valve 17 is invalidated. Therefore, even if the monitor object enters the monitor area in the surroundings of the shovel 100 during the diagnostic mode, the shovel 100 is prevented from moving.

Furthermore, as described above, in a case where the monitor object continues to be detected in the monitor area in the surroundings of the shovel 100 after the end of the diagnostic mode, the movement of the hydraulic actuators of the shovel 100 may be limited. This is because, when the diagnostic mode ends, and the control mode transitions from the diagnostic mode to the normal mode, the hydraulic actuators of the shovel 100 become operable, as described above. Accordingly, the attachment and the like of the shovel 100 is inhibited from coming in proximity to the monitor object (for example, a person) when the driven unit of the attachment and the like of the shovel 100 moves rapidly after the collection period of the diagnostic data ends.

Figure 18:
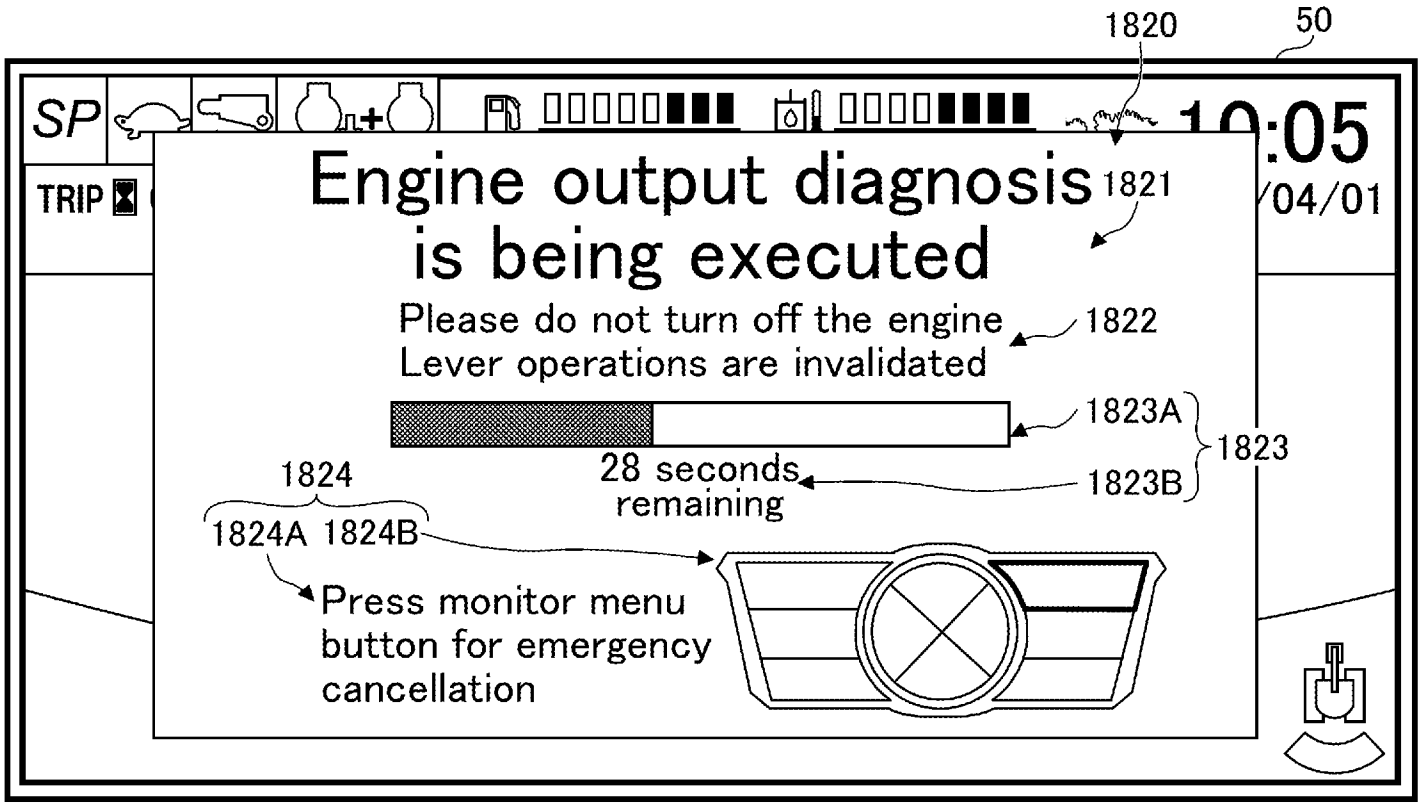
FIG. 18 is a drawing illustrating a specific example of display content displayed by the display apparatus when control processing for acquiring diagnostic data is executed.

In step S508, the diagnostic mode setting unit 304 causes the display apparatus 50 to display a method for forcibly cancelling the diagnostic mode of the shovel 100 (see FIG. 18). Then, when the processing of step S508 is completed, the controller 30 proceeds to step S510.

For example, as illustrated in FIG. 18, the display apparatus 50 displays a pop-up notification 1820 that teaches a cancellation method in an overlapping manner on the display content displayed when the diagnostic mode switch 56 is turned ON (in this example, the same surroundings image of the shovel 100 as FIG. 17).

Message information 1821, 1822, remaining time information 1823, and forcible cancellation-related information 1824 are displayed in the pop-up notification 1820.

Only some of the message information 1821, 1822, the remaining time information 1823, and the forcible cancellation-related information 1824 may be displayed in the pop-up notification 1820. For example, only the message information 1822 may be displayed in the pop-up notification 1820.

The message information 1821 indicates that processing related to the diagnosis of the shovel 100 is being executed. In this example, the message information 1821 includes a message, "Engine output diagnosis is being executed". Accordingly, the operator can recognize that the processing related to the diagnosis of the shovel 100 (in this example, processing related to the output diagnosis of the engine 11) is currently being executed.

The message information 1822 notifies prohibited actions in the diagnostic mode of the shovel 100. In this example, the message information 1822 includes a message, "Please do not turn off the engine", and a message, "Lever operations are invalidated". Accordingly, the operator can recognize that the engine 11 is not to be stopped, i.e., it is prohibited to stop the engine 11 (turn OFF the key switch) in the diagnostic mode. Also, the operator can recognize that the operation of the shovel 100 using the operating apparatus 26 is prohibited (invalidated) in the diagnostic mode of the shovel 100.

The remaining time information 1823 indicates the remaining time of the diagnostic mode of the shovel 100, i.e., the remaining time until the processing related to the diagnosis of the shovel 100 is completed and the diagnostic mode is normally cancelled. The remaining time information 1823 includes a bar graph 1823A indicating a remaining time until the diagnostic mode is normally cancelled (hereinafter referred to as a "normal cancellation") and value information 1823B indicating the remaining time until the normal cancellation of the diagnostic mode. Accordingly, the operator can find the remaining time until the diagnostic mode of the shovel 100 is normally cancelled.

Any one of the bar graph 1823A and the numerical value information 1823B may be displayed as the remaining time information 1823.

The forcible cancellation-related information 1824 indicates information related to forcible cancellation of the diagnostic mode (hereinafter referred to as a "forcible cancellation"). The forcible cancellation-related information 1824 includes message information 1824A and illustration information 1824B.

The message information 1824A indicates a method of forcible cancellation (emergency cancellation) by words. In this example, the message information 1824A includes a message, "Press monitor menu button for emergency cancellation". Accordingly, the operator can recognize that the diagnostic mode of the shovel 100 can be forcibly cancelled by the menu button (the diagnostic mode switch 56) in an operation input portion attached to in the monitor (the display apparatus 50).

The illustration information 1824B indicates a method of forcible cancellation (emergency cancellation) by illustration. In this example, the illustration information 1824B includes an illustration of the operation input portion attached to the monitor (display apparatus 50), and the menu button (the diagnostic mode switch 56) is surrounded by a frame. Accordingly, the operator can more specifically recognize the operation target for forcibly cancelling the diagnostic mode of the shovel 100.

In the forcible cancellation-related information 1824, only one of the message information 1824A and the illustration information 1824B may be displayed.

Back to FIG. 16, in step S510, the diagnostic mode setting unit 304 determines whether the diagnostic mode switch 56 is turned OFF. In a case where the diagnostic mode switch 56 is not turned off, the diagnostic mode setting unit 304 proceeds to step S512, and in a case where the diagnostic mode switch 56 is turned off, the current processing is ended in a state in which no diagnostic data has been acquired.

In step S512, the diagnostic mode setting unit 304 determines whether a condition of a normal end of the diagnostic mode (hereinafter simply referred to as an "end condition") is satisfied. For example, in a case where the collection of the diagnostic data has ended, and transmission of the diagnostic data to the management apparatus 300 has been completed, the diagnostic mode setting unit 304 may determine that the end condition of the diagnostic mode is satisfied. Also, in a case where the function of the diagnostic unit 3101 of the management apparatus 300 is achieved by the shovel 100 (the controller 30), the diagnostic mode setting unit 304 may determine that the end condition of the diagnostic mode is satisfied when the collection of the diagnostic data has ended and the diagnosis of the shovel 100 based on the diagnostic data has been completed. In a case where the end condition of the diagnostic mode is not satisfied, the diagnostic mode setting unit 304 goes back to step S510 to repeat the processing of steps S510, S512, and in a case where the end condition of the diagnostic mode is satisfied, the diagnostic mode setting unit 304 ends the current processing in a state in which the diagnostic data has been acquired, and transitions to the normal mode.

<Effects>

In this manner, in this example, similarly to the above-described first example and the like, when the engine 11 and the hydraulic system are driven under a constant driving condition, the shovel 100 (the controller 30) collects (acquires) the diagnostic data of the shovel 100.

Accordingly, the shovel 100 can achieve substantially the same operations and effects as the above-described first example and the like.

Also, in this example, the shovel 100 is provided with multiple sensors for detecting the physical quantities about the movement state of the shovel 100. The controller 30 may include a diagnostic mode setting unit 304 for performing processing of diagnosis of a device of the shovel 100 (for example, diagnosis of the engine 11) on the basis of the detection values of these multiple sensors. In addition, the controller 30 may prohibit the movement of the shovel 100 in a case where the processing related to the diagnosis of the shovel 100 is performed.

For example, Japanese Patent Laid-Open No. 2016-23489 discloses a technique for collecting diagnostic data related to a shovel in an idling state of the shovel.

However, when the shovel is operated during diagnostic data collection, variation occurs in the condition related to the state of the shovel during the data collection, which may reduce the reliability of the collected diagnostic data, or the collection of data may have to be cancelled.

In contrast, in this example, the shovel 100 can prohibit the movement of the shovel 100 during the collection of the diagnostic data. Therefore, the shovel 100 can more reliably collection highly reliable diagnostic data.

Also, in this example, in a case where the processing related to the diagnosis of the shovel 100 is performed, the controller 30 may prohibit the change of the engine rotational speed.

Accordingly, the shovel 100 can prevent reduction of the reliability of the diagnostic data due to a change in the condition related to the engine rotational speed during the collection of the diagnostic data. Therefore, the shovel 100 can collect more reliable diagnostic data.

Also, in this example, in a case where the processing related to the diagnosis of the shovel 100 is performed, the controller 30 may prohibit the change of the discharge flow rate of the main pump 14.

Accordingly, the shovel 100 can prevent reduction of the reliability of the diagnostic data due to a change in the condition related to the main pump 14 during the collection of the diagnostic data. Therefore, the shovel 100 can collect more reliable diagnostic data.

Also, in this example, in a case where the processing related to the diagnosis of the shovel 100 is performed, the controller 30 may invalidate the operation of the shovel 100.

Accordingly, the shovel 100 can more reliably stop the movement of the hydraulic actuators of the shovel 100 during the collection of the diagnostic data. Therefore, the shovel 100 can more reliably collect highly reliable diagnostic data.

Also, in this example, in a case where the processing related to the diagnosis of the shovel 100 is performed, the display apparatus 50 may display a warning message indicating that the operation of the shovel 100 cannot be performed (is prohibited).

Accordingly, the shovel 100 can prompt the operator not to perform the operation of the shovel 100 during the collection of the diagnostic data. Therefore, the shovel 100 can more reliably collect highly reliable diagnostic data.

As described above, the shovel 100 may be remotely operated. In this case, a similar warning message may be given to the operator who performs remote operation (hereinafter referred to as a "remote operation operator"). For example, in a case where remote operations are performed by way of the management apparatus 300, the display apparatus 340 may display a similar warning message.

Also, in this example, when the operator intends to immediately operate the shovel 100 before starting the processing related to the diagnosis of the shovel 100, the display apparatus 50 may display a message for prompting the user not to perform the processing related to the diagnosis of the shovel 100.

Accordingly, the shovel 100 can provide the operator who intends to immediately operate the shovel 100 with an opportunity to cancel the processing related to the diagnosis of the shovel 100.

The shovel 100 may be remotely operated, as described above. In this case, a similar prompting message may be given to a remote operation operator. For example, in a case where remote operations are performed by way of the management apparatus 300, the display apparatus 340 may display a similar prompting message.

Also, in this example, in a case where the processing related to the diagnosis of the shovel 100 is performed, the display apparatus 50 may display a method for cancelling the execution of the processing related to the diagnosis of the shovel 100.

Accordingly, the operator can readily cancel the execution of the processing related to the diagnosis of the shovel 100. Therefore, for example, in a situation where the operator needs to urgently operate the shovel 100, the operator can immediately cancel execution of the processing related to the diagnosis of the shovel 100 and perform the operation of the shovel 100.

The shovel 100 may be remotely operated, as described above. In this case, a notification of a method for cancelling the execution of the processing related to the diagnosis of the shovel 100 may be similarly given to the remote operation operator. For example, in a case where remote operations are performed by way of the management apparatus 300, the display apparatus 340 may display a similar message about the method for cancellation.

Eighth Example of Diagnostic Data Acquisition Processing

Next, an eighth example of the diagnostic data acquisition processing performed by the controller 30 is explained with reference to FIG. 19.

Figure 19:
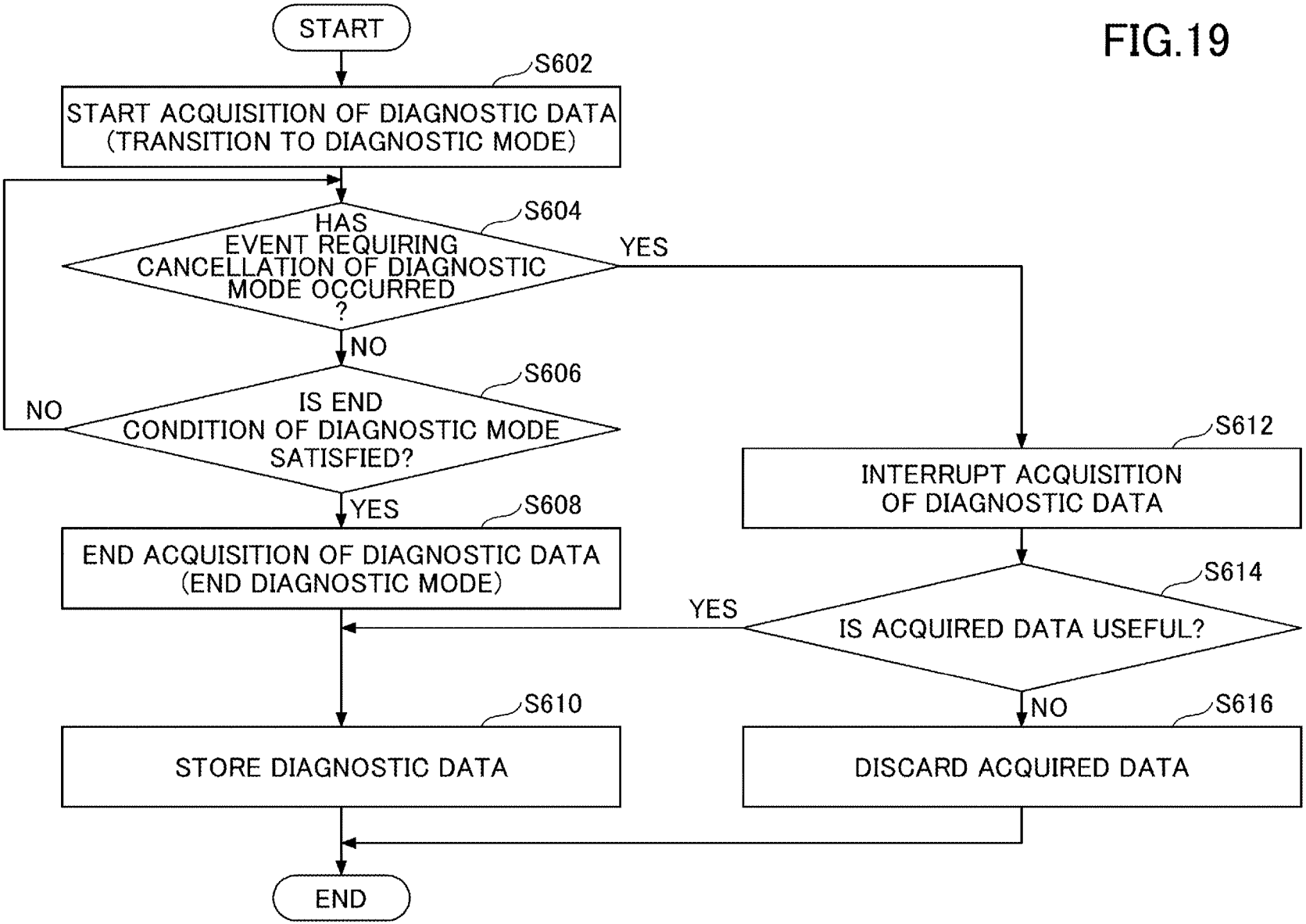
FIG. 19 is a flowchart schematically illustrating an eighth example of control processing performed by the controller to acquire diagnostic data.

FIG. 19 is a flowchart schematically illustrating the eighth example of the diagnostic data acquisition processing performed by the controller 30.

This flowchart is started when a trigger of transition to the diagnostic mode is satisfied. The diagnostic mode in this case may be a diagnostic mode that is included in another control mode (for example, a warm-up mode and the like) such as the above-described first example and the like. The trigger of transition to the diagnostic mode may be, for example, completion of the warm-up mode, the manual regeneration mode, the turbo cooling mode, the calibration mode, and the like, as described above. Also, the trigger of transition to the diagnostic mode may be, for example, an ON operation of the diagnostic mode switch 56, as described above.

When transitioning to a diagnostic mode that is included in another control mode such as the warm-up mode, the display apparatus 50 may display, during execution of this flowchart, a notification content (for example, screens of FIG. 6 and FIG. 12) indicating that another control mode is being executed.

As illustrated in FIG. 19, in step S602, the diagnostic mode setting unit 304 transitions to the diagnostic mode and starts acquisition of the diagnostic data. In this case, similarly to the case of the above-described first example and the like, the diagnostic mode setting unit 304 sets the rotational speed of the engine 11 and the hydraulic load of the hydraulic system (the main pump 14) and the like so that the engine 11 and the hydraulic system are driven under a constant driving condition. Accordingly, the diagnostic data acquisition control unit 305 can collect the diagnostic data while the engine 11 and the hydraulic system are driven under the constant driving condition on the basis of the setting by the diagnostic mode setting unit 304.

When the processing of step S602 is completed, the controller 30 proceeds to step S604.

In step S604, the diagnostic mode setting unit 304 determines whether an event of the shovel 100 which requires cancellation of the diagnostic mode (hereinafter referred to as "diagnostic mode cancellation event") has occurred. In a case where the diagnostic mode cancellation event has not occurred, the diagnostic mode setting unit 304 proceeds to step S606, and in a case where the diagnostic mode cancellation event has occurred, the diagnostic mode setting unit 304 proceeds to step S612.

The diagnostic mode cancellation event may include, for example, an event that "an operation related to an actuator (a driven unit) is performed". In this case, the operation related to the actuator includes not only operations of the operating apparatus 26 but also remote operations of the shovel 100. Accordingly, in a case where the operation related to the actuator is performed during the diagnostic mode, the controller 30 can enable the operation related to the actuator by prioritizing the operation related to the actuator and cancelling the diagnostic mode of the shovel 100.

Also, the diagnostic mode cancellation event may include, for example, an event that "an operation related to the rotational speed of the engine 11 is performed". The operation related to the rotational speed of the engine 11 may be, for example, an operation of the rotational speed throttle volume 52. Also, in a case where the shovel 100 is remotely operated, the operation of the rotational speed of the engine 11 may be reception of a signal for requesting the operation of the rotational speed of the engine 11 from an external apparatus (for example, the management apparatus 300) supporting remote operations. Accordingly, in a case where the operation of the rotational speed of the engine 11 is performed during the diagnostic mode, the controller 30 can enable the operation of the rotational speed of the engine 11 by prioritizing the operation of the rotational speed of the engine 11 and cancelling the diagnostic mode of the shovel 100.

Also, the diagnostic mode cancellation event may include, for example, an event that "an operation related to the emergency stop of the shovel 100 is performed". The operation related to the emergency stop of the shovel 100 may be, for example, an operation of an emergency stop switch provided in the cab 10 of the shovel 100. Also, in a case where the shovel 100 is remotely operated, the operation related to the emergency stop of the shovel 100 may be reception of a signal for requesting emergency stop from an external apparatus (for example, the management apparatus 300) supporting remote operations. Accordingly, in a case where the operation related to the emergency stop of the shovel 100 is performed during the diagnostic mode, the operation related to the emergency stop can be enabled by prioritizing the operation related to the emergency stop and cancelling the diagnostic mode of the shovel 100.

Also, the diagnostic mode cancellation event may include, for example, an event that "a signal related to abnormality of the shovel 100 is output". The signal related to the abnormality may be, for example, a predetermined error signal that is output from a predetermined device provided on the shovel 100. Accordingly, in a case where a predetermined device of the shovel 100 outputs a signal related to the abnormality, the processing for the signal can be enabled by prioritizing the processing for the signal and cancelling the diagnostic mode of the shovel 100.

In step S606, the diagnostic mode setting unit 304 determines whether a condition of a normal end of the diagnostic mode (an end condition) is satisfied. The end condition of the diagnostic mode may be similar to the case of the above-described seventh example. In a case where the end condition of the diagnostic mode is not satisfied, the diagnostic mode setting unit 304 returns back to step S604 to repeat the processing of steps S604, S606, and in a case where the end condition of the diagnostic mode is satisfied, the diagnostic mode setting unit 304 proceeds to step S608.

In step S608, the diagnostic mode setting unit 304 ends the acquisition of the diagnostic data. Accordingly, the diagnostic data acquisition control unit 305 ends the acquisition processing of the diagnostic data. Then, the diagnostic mode setting unit 304 ends the diagnostic mode, and transitions the control mode from the diagnostic mode to the normal mode.

When the processing of step S608 is completed, the controller 30 proceeds to step S610.

In step S610, the diagnostic mode setting unit 304 stores the diagnostic data acquired by the diagnostic data acquisition control unit 305 to a predetermined storage unit (for example, an auxiliary storage device of the controller 30, an external storage device communicably connected to the controller 30, and the like).

When the processing of step S610 is completed, the controller 30 ends the processing of this flowchart.

After the processing of step S610 is completed, the controller 30 (the diagnostic data transmission unit 306) may transmit the diagnostic data to the management apparatus 300 through the transmission apparatus S1, and thereafter, the processing of this flowchart may be ended.

In step S612, the diagnostic mode setting unit 304 interrupts the acquisition of the diagnostic data. Accordingly, the diagnostic data acquisition control unit 305 interrupts the acquisition processing of the diagnostic data.

In a case where the processing of step S612 is completed, the controller 30 proceeds to step S614.

In step S614, the diagnostic mode setting unit 304 determines whether data acquired until the interruption of the acquisition processing of the diagnostic data is useful. Whether the data is useful may be determined, for example, on the basis of the period of time in which the data has been acquired, and in a case where the period of time in which the data has been acquired is equal to or more than the predetermined threshold value, the data may be determined to be useful. In a case where the acquired data is determined to be useful, the diagnostic mode setting unit 304 proceeds to step S610, and in step S610, the diagnostic mode setting unit 304 stores the acquired data as diagnostic data to the predetermined storage unit. In a case where the acquired data is determined not to be useful, the diagnostic mode setting unit 304 proceeds to step S616.

In step S616, the diagnostic mode setting unit 304 discards the acquired data.

In a case where the processing of step S616 is completed, the controller 30 ends the processing of this flowchart.

<Effects>

In this manner, in this example, similarly to the case of the above-described first example and the like, when the engine 11 and the hydraulic system are driven under a constant driving condition, the shovel 100 (the controller 30) collects (acquires) the diagnostic data of the shovel 100, similarly to the above-described first example and the like.

Accordingly, the shovel 100 can achieve substantially the same operations and effects as the above-described first example and the like.

Also, in this example, in a case where the shovel 100 (the controller 30) detects a diagnostic mode cancellation event during the processing (i.e., during the diagnostic mode) related to the collection (acquisition) of the diagnostic data, the shovel 100 (the controller 30) may end the processing for acquisition of the diagnostic data. Specifically, the diagnostic mode cancellation event may include at least one of, for example, an operation of an actuator, an operation of the rotational speed of the engine 11, an operation related to emergency stop of the shovel 100, and a signal related to abnormality of the shovel 100.

Accordingly, the shovel 100 can enable various kinds of operations of the shovel 100 by prioritizing the various kinds of operations of the shovel 100 and ending the processing for acquisition of the diagnostic data. Also, in a state in which the shovel 100 is emergency stopped or in a state in which an abnormality occurs, the shovel 100 can end the processing for acquisition of the diagnostic data and prioritize the processing for dealing with such a state.

According to the above-described embodiment, a technique capable of collecting more reliable diagnostic data can be provided.

Modifications and Changes

Although the embodiment has been described in detail above, the present disclosure is not limited to the specific embodiment, and various modifications and changes can be made within the subject matters of the present disclosure described in the claims.

For example, although the shovel 100 is hydraulically driven in the above-described embodiment, at least some of the driven units (the left and right crawlers of the lower traveling body 1, the upper turning body 3, the boom 4, the arm 5, and the bucket 6) may be electrically driven. Specifically, the shovel 100 may be a hybrid shovel or an electric shovel. In this case, invalidation of an operation of the shovel 100 means invalidation of an operation of an electric actuator or a hydraulic actuator and an electric actuator that drive the driven units of the shovel 100.

The invention claimed is:

1. A shovel comprising:

a lower traveling body;

an upper turning body turnably mounted on the lower traveling body;

an engine mounted on the upper turning body;

a hydraulic pump mounted on the upper turning body and configured to be driven by the engine;

a storage in which a plurality of predetermined events are defined as a trigger for collecting diagnostic data of the shovel, the plurality of predetermined events including warm-up driving of the shovel, regeneration of an exhaust gas processing apparatus of the engine, cooling driving of a supercharger provided in the engine, calibration of an output value of an orientation detection apparatus of the shovel, purge processing of a urea selective catalytic regeneration system connected to the engine, and operation of a predetermined switch; and processing circuitry configured to collect the diagnostic data of the shovel with the engine being driven under a constant driving condition, in response to an occurrence of a predetermined event among the plurality of predetermined events of the shovel defined as the trigger in the storage.

2. The shovel according to claim 1, wherein the constant driving condition includes a condition indicating that a constant load is applied on the engine.

3. The shovel according to claim 1, wherein the constant driving condition includes a condition indicating that the engine is in a predetermined state.

4. The shovel according to claim 1, wherein the processing circuitry is configured to collect the diagnostic data by continuing, for a predetermined period of time, a state of the engine corresponding to the constant driving condition in the predetermined event in response to completion of the predetermined event.

5. The shovel according to claim 1, wherein the processing circuitry is configured to send an operator a notification indicating an end of the predetermined event, in response to completion of collecting the diagnostic data.

6. The shovel according to claim 1, further comprising:

a surroundings monitor apparatus configured to detect an object present in a monitor area within a predetermined distance from the shovel, wherein the processing circuitry is configured to monitor the monitor area with the surroundings monitor apparatus and continue monitoring the monitor area during at least one of the predetermined event or collecting of the diagnostic data.

7. The shovel according to claim 1, wherein a constant hydraulic pressure corresponding to the constant driving condition is generated by at least one of a center bypass cut-off valve, a control valve, and the hydraulic pump.

8. The shovel according to claim 7, wherein the processing circuitry is configured to increase a pressure of the hydraulic pump to a pressure corresponding to the constant hydraulic pressure after starting to collect the diagnosis data.

9. The shovel according to claim 8, wherein the processing circuitry is further configured to set the pressure of the hydraulic pump to a unique value or prohibit the pressure of the hydraulic pump from being changed during collecting of the diagnostic data of the shovel after increasing the pressure of the hydraulic pump to the pressure corresponding to the constant hydraulic pressure.

10. The shovel according to claim 1, wherein the processing circuitry is configured to end processing related to collecting of the diagnostic data in response to detecting at least one of an operation related to an actuator, an operation related to a rotational speed of the engine, an operation related to emergency stop of the shovel, and a signal related to abnormality of the shovel during the processing related to collecting of the diagnostic data.

11. The shovel according to claim 1, further comprising:

a display, wherein the processing circuitry is configured to display a warning message on the display when the processing circuitry performs processing related to diagnosis of the shovel, the warning message indicating that the shovel is inoperable.

12. The shovel according to claim 1, further comprising:

a display, wherein the processing circuitry is configured to display, on the display, a message that discourages an operator who intends to immediately operate the shovel from causing the processing circuitry to start processing related to diagnosis of the shovel, before the processing circuitry starts the processing related to the diagnosis of the shovel.

13. The shovel according to claim 1, further comprising:

a display, wherein the processing circuitry is configured to display a method for cancelling execution of processing related to diagnosis of the shovel on the display when the processing circuitry performs the processing related to the diagnosis of the shovel.

14. The shovel according to claim 1, wherein an output of the engine is stable in the predetermined event, and the processing circuitry is further configured to start to collect the diagnostic data of the shovel from a sensor of the shovel with the engine being driven under the constant driving condition, in response to completion of the predetermined event.

15. The shovel according to claim 1, wherein the processing circuitry is configured to automatically collect the diagnostic data of the shovel without a command for collecting the diagnostic data of the shovel, in response to the occurrence of the predetermined event.

16. The shovel according to claim 1, wherein the processing circuitry is configured to determine whether to end the predetermined event after the occurrence of the predetermined event, and automatically start collecting the diagnostic data of the shovel in response to determining to end the predetermined event.

17. The shovel according to claim 1, wherein a period for collecting the diagnostic data of the shovel is shorter than a period of the predetermined event.

18. The shovel according to claim 1, wherein the processing circuitry is further configured to diagnose a hydraulic system of the shovel using the collected diagnostic data of the shovel.

19. A shovel diagnostic system comprising:

a shovel including a lower traveling body, an upper turning body turnably mounted on the lower traveling body, an engine mounted on the upper turning body, a hydraulic pump mounted on the upper turning body and configured to be driven by the engine, a storage in which a plurality of predetermined events are defined as a trigger for collecting diagnostic data of the shovel, the plurality of predetermined events including warm-up driving of the shovel, regeneration of an exhaust gas processing apparatus of the engine, cooling driving of a supercharger provided in the engine, calibration of an output value of an orientation detection apparatus of the shovel, purge processing of a urea selective catalytic regeneration system connected to the engine, and operation of a predetermined switch, and first processing circuitry; and a management apparatus including second processing circuitry and configured to communicate with the shovel, wherein the first processing circuitry of the shovel is configured to collect the diagnostic data of the shovel with the engine being driven under a constant driving condition, in response to an occurrence of a predetermined event among the plurality of predetermined events of the shovel defined as the trigger in the storage, and transmit the collected diagnostic data to the management apparatus, and the second processing circuitry of the management apparatus is configured to perform diagnosis related to the shovel based on the data received from the shovel.

20. The shovel diagnostic system according to claim 19, wherein the constant driving condition includes a condition indicating that a constant load is applied on the engine.

* * * * *